US011441791B2

(12) United States Patent
Lei et al.

(10) Patent No.: US 11,441,791 B2
(45) Date of Patent: Sep. 13, 2022

(54) WINDOW AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Zhisheng Lei, Foshan (CN); Zhigang Xing, Foshan (CN); Kangwen Zhang, Foshan (CN); Yu Liu, Foshan (CN); Hui Yu, Foshan (CN); Yuhang Tang, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 403 days.

(21) Appl. No.: 16/704,886

(22) Filed: Dec. 5, 2019

(65) Prior Publication Data

US 2020/0248911 A1 Aug. 6, 2020

Related U.S. Application Data

(63) Continuation of application No. PCT/CN2019/104306, filed on Sep. 4, 2019.

(30) Foreign Application Priority Data

Feb. 3, 2019 (CN) ..... 201910108805.0
Feb. 3, 2019 (CN) ..... 201910108812.0
(Continued)

(51) Int. Cl.
*F24F 1/027* (2019.01)
*F24F 13/32* (2006.01)
*F24F 13/20* (2006.01)

(52) U.S. Cl.
CPC ..... *F24F 1/027* (2013.01); *F24F 13/32* (2013.01); *F24F 13/20* (2013.01)

(58) Field of Classification Search
CPC ..... F24F 1/027; F24F 13/32; F24F 13/20
(Continued)

(56) References Cited

U.S. PATENT DOCUMENTS 5,253,485 A * 10/1993 Kennedy ..... F24F 1/027 62/262
2020/0248911 A1 8/2020 Lei et al.

FOREIGN PATENT DOCUMENTS

CA 3057095 A1 2/2020
CN 2444166 Y 8/2001
(Continued)

OTHER PUBLICATIONS

The State Intellectual Property Office of PRC (SIPO) the Second Office Action for CN Application No. 201810956881.2 dated Jun. 12, 2020 15 Pages (Translation Included ).
(Continued)

*Primary Examiner* — Steve S Tanenbaum
(74) *Attorney, Agent, or Firm* — Anova Law Group PLLC

(57) ABSTRACT

A window air conditioner includes a housing including an outdoor portion and an indoor portion spaced apart from each other to form an accommodation groove, and a seal assembly including a rotary mounting base fixed at the housing, a fixation member rotatably connected with the rotary mounting base and configured to rotate out of the accommodation groove, and a seal mating member coupled to the fixation member and configured to rotate out of the accommodation groove when the fixation member rotates out of the accommodation groove.

20 Claims, 43 Drawing Sheets

(30) Foreign Application Priority Data

| | | |
|---|---|---|
| Feb. 3, 2019 | (CN) | 201910109479.5 |
| Feb. 3, 2019 | (CN) | 201920188021.9 |
| Feb. 3, 2019 | (CN) | 201920188046.9 |
| Feb. 3, 2019 | (CN) | 201920188058.1 |
| Apr. 12, 2019 | (CN) | 201910295532.5 |
| Apr. 12, 2019 | (CN) | 201920511024.1 |
| Apr. 12, 2019 | (CN) | 201920511066.5 |
| Apr. 12, 2019 | (CN) | 201920511262.2 |

(58) Field of Classification Search
USPC ..... 62/262
See application file for complete search history.

(56) References Cited

FOREIGN PATENT DOCUMENTS

| | | | |
|---|---|---|---|
| CN | 2622607 | Y | 6/2004 |
| CN | 102455025 | A | 5/2012 |
| CN | 104566672 | A | 4/2015 |
| CN | 107289602 | A | 10/2017 |
| CN | 206648183 | U | 11/2017 |
| CN | 207132495 | U | 3/2018 |
| CN | 107940724 | A | 4/2018 |
| CN | 207471698 | U | 6/2018 |
| CN | 108870565 | A | 11/2018 |
| CN | 109184456 | A | 1/2019 |
| CN | 208382345 | U | 1/2019 |
| CN | 109724168 | A | 5/2019 |
| CN | 109724170 | A | 5/2019 |
| CN | 109724171 | A | 5/2019 |
| CN | 109724172 | A | 5/2019 |
| CN | 109724173 | A | 5/2019 |
| CN | 109974128 | A | 7/2019 |
| CN | 209558559 | U | 10/2019 |
| CN | 209588203 | U | 11/2019 |
| KR | 100732319 | B1 | 6/2007 |
| WO | 2020037956 | A1 | 2/2020 |
| WO | 2020038239 | A1 | 2/2020 |
| WO | 2020155353 | A1 | 8/2020 |
| WO | 2020155625 | A1 | 8/2020 |

OTHER PUBLICATIONS

The State Intellectual Property Office of PRC (SIPO) the First Office Action for CN Application No. 202010605975.2 dated Mar. 18, 2021 13 Pages (Translation Included ).

World Intellectual Property Organization (WIPO) International Search Report for PCT/CN2019/104306 dated Apr. 9, 2019 22 Pages(Translation Included).

The State Intellectual Property Office of PRC (SIPO) the First Office Action for CN Application No. 201920511262.2 dated Nov. 11, 2019 5 Pages (Translation Included ).

The State Intellectual Property Office of PRC (SIPO) the Second Office Action for CN Application No. 201810956185.1 dated Nov. 11, 2020 24 Pages (Translation Included ).

Canadian Intellectual Property Office the Office Action for CA Application No. 3065409 dated Feb. 26, 2021 5 Pages.

The State Intellectual Property Office of PRC (SIPO) the Third Office Action for CN Application No. 201810956185.1 dated Apr. 20, 2021 15 Pages (Translation Included ).

World Intellectual Property Organization (WIPO) International Search Report and Written Opinion for PCT/CN2019/104306 with translation dated Dec. 3, 2019 22 Pages.

Canadian Intellectual Property Office the Office Action for CA Application No. 3057095 dated Feb. 2, 2021 5 Pages.

Canadian Intellectual Property Office the Office Action for CA Application No. 3057119 dated Jan. 28, 2021 5 Pages.

* cited by examiner

200

WINDOW AIR CONDITIONER

CROSS-REFERENCE TO RELATED APPLICATIONS

This application is a continuation of PCT Application No. PCT/CN2019/104306, filed on Sep. 4, 2019, which claims priority to and benefits of Chinese Patent Application Nos. 201920511262.2, 201910295532.5, 201920511024.1, and 201920511066.5, filed on Apr. 12, 2019, and Chinese Patent Application Nos. 201910109479.5, 201920188058.1, 201910108812.0, 201920188021.9, 201910108805.0, and 201920188046.9, filed on Feb. 3, 2019, the entire contents of all of which are incorporated herein by reference.

FIELD

The present application relates to the field of air conditioning technologies, and in particular, to a seal assembly for a window air conditioner and a window air conditioner having the same.

BACKGROUND

In related art, a window air conditioner is mounted in a window on a wall. Due to a fitting clearance between the window air conditioner and an inner wall of the window, in order to improve the cooling effect of the window air conditioner, a foldable louver is employed to seal the fitting clearance. However, to meet the demand of foldability, the louver has a small thickness, with poor heat insulation effects. Moreover, a fitting structure between the louver and the window air conditioner has a relatively poor sealing effect, and the window air conditioner is prone to cold air leakage, thereby affecting the cooling and heating efficiencies of the window air conditioner.

SUMMARY

The present application seeks to solve at least one of the technical problems existing in the related art to at least some extent. To this end, the present application provides a window air conditioner with the advantages of convenient operation and good sealing effect.

According to the window air conditioner in the embodiment of the present application, the window air conditioner is mounted at a window of a wall, and the window is provided with a movable window sash, the window air conditioner including: a housing, with an outdoor portion and an indoor portion which are spaced apart to form an accommodation groove, the window sash adapted to be placed into the accommodation groove; and a seal assembly, including a rotary mounting base, a fixation member and a seal mating member, wherein the rotary mounting base is fixed at the housing, the fixation member is rotatably fitted with the rotary mounting base, and the seal mating member is connected with the fixation member, the fixation member is rotatable to extend out of the accommodation groove, such that the seal mating member abuts against an inner wall of the window.

According to the window air conditioner in the embodiment of the present application, by providing the accommodation groove in the housing, at least a part of the window sash may extend into the accommodation groove, which easily improves the mounting reliability and stability of the window air conditioner; meanwhile, the window sash may be soundproof to some extent, which reduces noise transferred from the outdoor portion to the indoor portion. By providing the rotary mounting base, the fixation member is rotatably disposed at the rotary mounting base, such that the seal assembly is rotatably accommodated within the accommodation groove, which facilitates not only the installation of the fixation member, but also the rotation of the fixation member relative to the rotary mounting base, the storage of the seal assembly, and the reduction of the space occupied by the seal assembly.

According to some embodiments of the present application, the seal assembly further includes an angle positioning assembly, which is fitted with the rotary mounting base and the fixation member, so as to position the fixation member at the current angle when the fixation member is rotated to a set angle.

According to some embodiments of the present application, the angle positioning assembly includes a positioning projection and a plurality of positioning grooves, one of the rotary mounting base and the fixation member is provided with the positioning projection, the other of the rotary mounting base and the fixation member is provided with the plurality of positioning grooves which are arranged in a circular shape; when the fixation member is rotated, the positioning projection is fitted with the plurality of the positioning grooves in a manner of switching; when the fixation member is rotated to a set angle, the positioning projection is fitted with one of the positioning grooves to position the fixation member.

According to some embodiments of the present application, a plurality of positioning projections is provided and is arranged in a shape of ring, and fitted with the plurality of positioning grooves in a one-to-one correspondence.

According to some embodiments of the present application, the seal assembly includes: a first connection member with a variable length, the first connection member including the fixation member and a slide block, at least a portion of the fixation member being disposed in the accommodation groove, and the slide block being in a sliding fit with the fixation member.

According to some embodiments of the present application, the seal assembly further includes: a plurality of second connection members, at least one of which is detachably connected with the slide block, and any two of which are detachably connected with each other to adjust the length of the seal assembly.

According to some embodiments of the present application, the window air conditioner further includes a slide positioning assembly, disposed at the fixation member and fitted with the slide block to position the slide block at the current position.

According to some embodiments of the present application, a slide cavity is provided in the fixation member, and at least a portion of the slide block extends into the slide cavity.

According to some embodiments of the present application, the slide positioning assembly is configured as a rotation member which rotatably passes through the fixation member and is in a threaded fit with the fixation member, and the rotation member is rotated to adjust the length of the portion of the rotation member extending into the slide cavity, and may abut against the slide block to position the slide block.

According to some embodiments of the present application, the fixation member is provided with an escape hole communicating with the slide cavity, the slide positioning assembly includes an elastic buckle and a plurality of fitting buckles, wherein the plurality of fitting buckles are spaced apart on an outer peripheral wall of the slide block in a moving direction of the slide block, and the elastic buckle is deformably disposed at an inner peripheral wall of the escape hole to be in an inclined fit with or disengaged from at least one of the fitting buckles; the slide positioning assembly is configured to move a slider in a direction away from the fixation member when the elastic buckle is in an inclined fit with the fitting buckle, and move the slider in a direction toward the fixation member when the elastic buckle is disengaged from the fitting buckle.

According to some embodiments of the present application, the fixation member is formed therein with an escape hole and an elastic buckle, wherein the elastic buckle is disposed at the inner peripheral wall of the escape hole and includes: a deformation portion and a snap portion, the deformation portion is configured as a shape of flat plate; the snap portion is formed at a free end of the deformation portion; the slide block is provided with a plurality of fitting buckles which are spaced apart on the outer peripheral wall of the slide block along the moving direction of the slide block, the deformation portion is deformably disposed at the fixation member to be in an inclined fit with or disengaged from at least one of the fitting buckles; wherein the seal assembly is configured such that the fixation member is fixed positionally relative to the slide block when the snap portion is in an inclined fit with the fitting buckle, and the slide block is movable in a direction toward or away from the fixation member when the snap portion is disengaged from the fitting buckle.

According to some embodiments of the present application, the deformation portion is configured as a shape of flat plate extending parallel to a length direction of the fixation member.

According to some embodiments of the present application, the portion of the fixation member which is provided with the escape hole is configured as a mating portion, and the fixation member is provided with a protrusion which is disposed at an outer wall surface of the deformation portion at a position closer to a joint of the mating portion and the elastic buckle with respect to the snap portion.

According to some embodiments of the present application, the fixation member is provided therein with an escape hole communicating with the slide cavity, the slide positioning assembly includes an elastic latch member which is deformably disposed at the escape hole, the elastic latch member is provided with a lock buckle which is configured to engage with or disengage from at least one of the plurality of the fitting buckles; when the elastic latch member is pressed toward the inside of the slide cavity, the elastic latch member is deformed to disengage the lock buckle from the fitting buckle.

According to some embodiments of the present application, the slider may slide toward a direction of extending out of or retracting into the slide cavity when the first lock buckle is disengaged from the fitting buckle, and the slider may only slide toward a direction extending out of the slide cavity when the first lock buckle engages with the fitting buckle.

According to some embodiments of the present application, the slider has a mating cavity therein, and the plurality of the fitting buckles are formed on a peripheral wall of the mating cavity, and the first lock buckle extends into the mating cavity to engage with at least one of the fitting buckles.

According to some embodiments of the present application, the slider is formed therein with an opening which extends in a sliding direction of the slider and communicates with the mating cavity, and the plurality of the fitting buckles are formed at at least one side of the opening in a width direction; the elastic latch member includes: a first cantilever segment, one end of which is connected with an inner peripheral wall of the escape hole; a pressing portion and a latch portion, which are both disposed at the other end of the first cantilever segment; the first lock buckle is disposed at the latch portion, the first cantilever segment is slidably fitted in the opening, the pressing portion is located outside the mating cavity, and the latch portion extends into the mating cavity to enable the first lock buckle to engage with the fitting buckle.

According to some embodiments of the present application, the fixation member is formed therein with an escape hole communicating with the slide cavity, and the slide block is formed thereon with a plurality of fitting buckles arranged at intervals in the sliding direction of the slide block; a press button, which may be pressed and is disposed at the escape hole, the press button provided with a second lock buckle which is configured to engage with or disengage from at least one of the plurality of the fitting buckles.

According to some embodiments of the present application, the press button is switchable between a pressed state and a reset state, wherein the second lock buckle is disengaged from the fitting buckle when the press button is in the pressed state, and the second lock buckle engages with the fitting buckle to lock the slide block when the press button is in the reset state.

According to some embodiments of the present application, the press button includes: a second cantilever segment, one end of which is connected with an inner wall of the slide cavity, the second lock buckle is disposed at the second cantilever segment, spaced apart from the one end of the second cantilever segment; a press button body, connected with the second cantilever segment and spaced apart from the one end of the second cantilever segment, the press button body extending perpendicular to the second cantilever segment and at least a part of the press button body extending into the escape hole.

According to some embodiments of the present application, the second lock buckle and the press button body are both located at a free end of the second cantilever segment, and the second lock buckle is located at one side of the one end of the press button body away from the second cantilever segment.

According to some embodiments of the present application, each of the second connection members includes an insertion portion, each of the second connection members and the slide block are both provided with an insertion chamber, and each of the insertion portions may be inserted into and detached from the insertion chamber.

According to some embodiments of the present application, one of the inner walls of the insertion portion and the insertion chamber is provided with a first elastic projection, the other of the inner peripheral walls of the insertion portion and the insertion chamber is provided with a first groove, and the first elastic projection is extendable into the first groove.

According to some embodiments of the present application, the first elastic projection is provided in the insertion chamber; in the inserting and detaching direction of the second connection member, the first elastic projection has two opposite inclined guide surfaces, first ends of the two inclined guide surfaces are fixed at the inner wall of the insertion chamber, and second ends of the two inclined guide surfaces extend obliquely toward each other.

According to some embodiments of the present application, the housing includes: a chassis; a rear case, which is fixed at the chassis and has an outdoor heat exchanger accommodated inside; a front case, which is fixed at the chassis and is spaced apart from the rear case in the front and rear direction to form the accommodation groove.

According to some embodiments of the present application, the housing further includes a middle partition, which is fixed at the chassis and located within the accommodation groove, and front and rear ends of the middle partition are fitted with the rear case and the front case respectively.

According to some embodiments of the present application, the middle partition is provided with a top open placement space, the rotary mounting base is accommodated in the placement space, the fixation member is provided with an accommodation space, and when the seal assembly is rotated to extend out of the accommodation groove, an outer edge of the placement space extends into the accommodation space, such that the seal assembly is substantially flush with the middle partition.

According to some embodiments of the present application, the window air conditioner further includes: a positioning device having an unlocked state and a locked state, including a self-locking switch, a positioning member, and a first elastic member, wherein the self-locking switch is disposed at the housing and includes a self-locking cartridge and a self-locking member, the self-locking member is movably disposed at the self-locking cartridge between a first position and a second position, the self-locking member is provided with a first snap portion; by pressing the self-locking member, the self-locking member is switchable between the first and second positions; the positioning member is movable relative to the housing, a trigger member and a second snap portion are disposed at an end surface of the positioning member facing the housing, and the trigger member is brought into contact with the self-locking member by pressing the positioning member to press the self-locking member; two ends of the first elastic member are connected with the housing and the positioning member respectively to push the positioning member to move toward the locked state; in the unlocked state, the self-locking member is located at the first position, such that the first snap portion and the second snap portion are fitted to position the positioning member; in the locked state, the self-locking member is located at the second position, such that the first snap portion is disengaged from the second snap portion, and the first elastic member pushes the positioning member to move to the locked state, such that the positioning member abuts against the window sash.

According to some embodiments of the present application, one end of the positioning member is rotatably disposed at the housing, and in the locked state, the other end of the positioning member extends into the accommodation groove to abut against the window sash.

According to some embodiments of the present application, the window air conditioner further includes: a limiting structure disposed at the housing; a support bar fixed at the positioning member and movably passing through the limiting structure, and one end of the first elastic member abuts against the limiting structure.

Additional aspects and advantages of embodiments of present application will be given in part in the following descriptions, become apparent in part from the following descriptions, or be learned from the practice of the embodiments of the present application.

BRIEF DESCRIPTION OF THE DRAWINGS

These and other aspects and advantages of embodiments of the present application will become apparent and more readily appreciated from the following descriptions made with reference to the drawings, in which.

Figure 1:
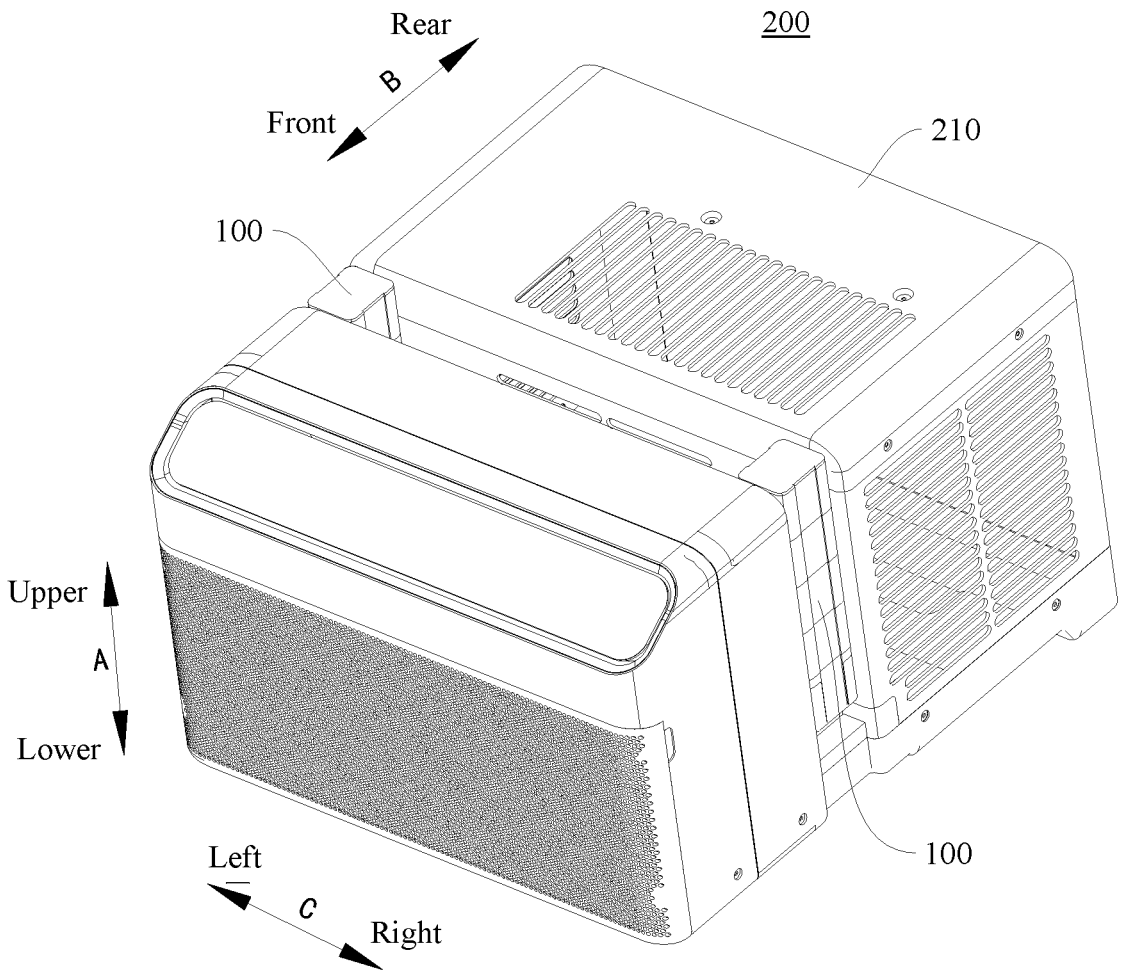
FIG. 1 is a schematic structural view of a window air conditioner according to an embodiment of the present application.

REFERENCE NUMERALS seal assembly 100 of a window air conditioner, first connection member 8, fixation member 1, escape hole 11, elastic buckle 12, slider 120, deformation portion 121, snap portion 122, mating portion 13, protrusion 14, grip space 15, fulcrum 16, slide cavity 17, mating projection 18, accommodation space 19, pivoting shaft 10, slide rib 113, guide groove 115, connection post 130 slide block 2, fitting buckle 21, mating cavity 22, opening 23, fitting notch 231; mating teeth 24, rotary mounting base 3, pivot hole 31, mating plate 32, projection 33, fixation hole 34, angle positioning assembly 4, positioning projection 41, positioning groove 42, second connection member 5, insertion portion 51, first groove 511, insertion chamber 52, first elastic projection 521, inclined guide surface 522, and a second groove 53, slide positioning assembly 500 seal end cap 6, elastic latch member 7, first lock buckle 71, first cantilever segment 72, pressing portion 73; latch portion 74; elastic groove 75;

seal mating member 700 press button 8, second lock buckle 81, second cantilever segment 82, connection hole 821, press button body 83, window air conditioner 200, outdoor portion 110, accommodation space 111; indoor portion 120, positioning device 9;

self-locking switch 911, self-locking cartridge 9111, self-locking member 9112, first snap portion 91121, positioning member 912, trigger member 9121, second snap portion 91211, first elastic member 913, limiting structure 30, mounting groove 301, support bar 40, stop 401, housing 210, accommodation groove 211, chassis 212, rear case 213, rear case seat 2131, rear case cover 2132, support plate 2133, support step surface 2134, support boss 2135, buckling hole 2136, snap extension portion 2137, front case 214, middle partition 215, placement space 2150, wall 300, window 310, window sash 400.

DETAILED DESCRIPTION

Reference will be made in detail to embodiments of the present application, and the examples of the embodiments are illustrated in the drawings, wherein the same or similar elements and the elements having same or similar functions are denoted by like reference numerals throughout the descriptions. The embodiments described herein with reference to drawings are illustrative, and merely used to explain the present application. The embodiments shall not be construed to limit the present application.

Figure 56:
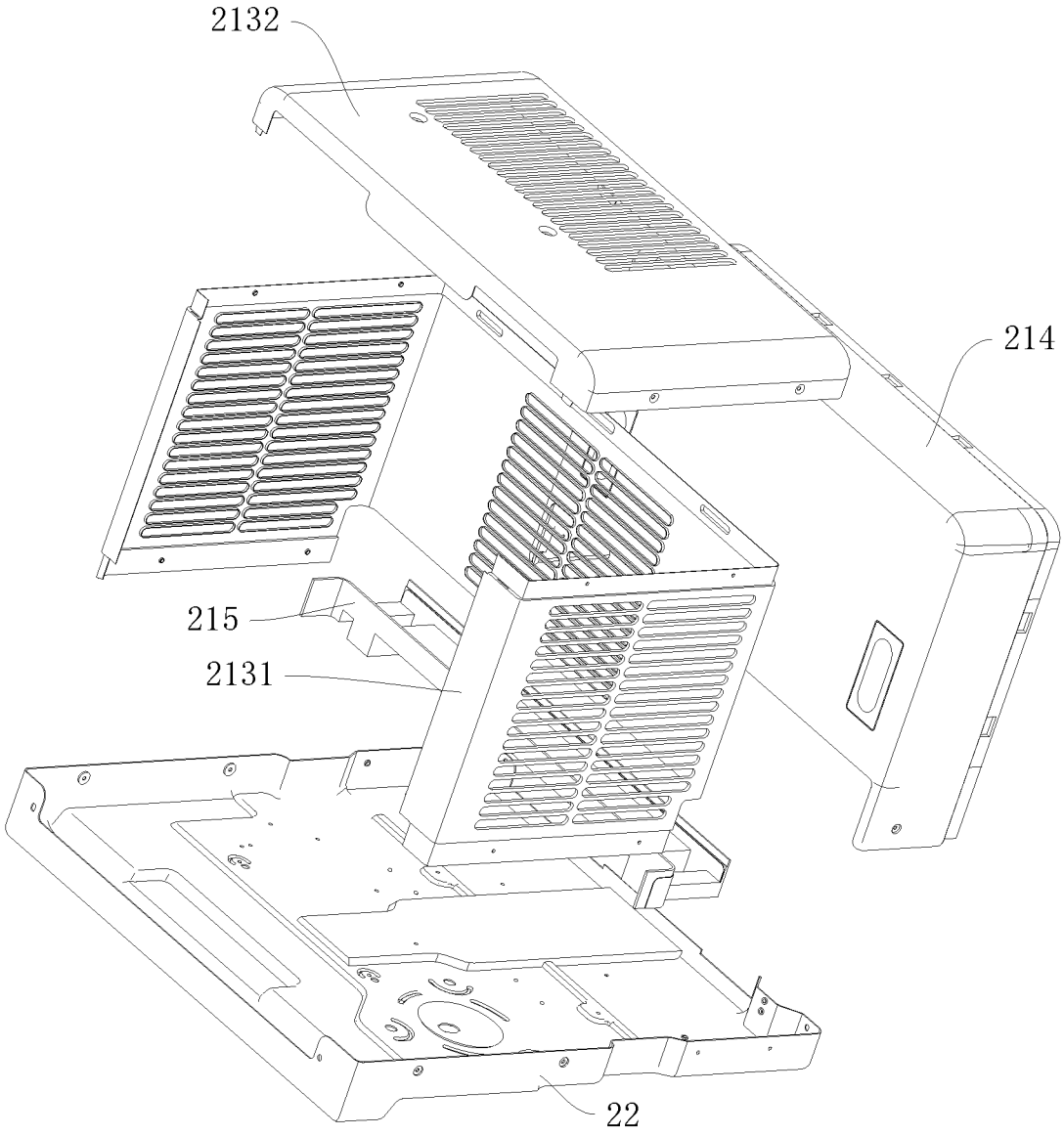
FIG. 56 is an exploded view of the housing of the window air conditioner according to an embodiment of the present application.

A window air conditioner 200 according to the embodiments of the present application will be described below with reference to FIGS. 1 to 56.

The window air conditioner 200*s* according to the embodiment of the present application can be provided at a window 310 of a wall 300, and the window 310 is provided with a movable window sash 400. The window air conditioner 200 includes: a housing 210 and a seal assembly 100, wherein the housing 210 includes an outdoor portion 110 and indoor portion 120 which are spaced apart to form an accommodation groove 211, into which, the window sash 400 is adapted to be placed.

The seal assembly 100 includes a rotary mounting base 3, a fixation member 1 and a seal mating member 700, wherein the rotary mounting base 3 is fixed at the housing 210, the fixation member 1 is rotatably fitted with the rotary mounting base 3, and the seal mating member 700 is connected with the fixation member 1, the fixation member 1 is rotatable to extend out of the accommodation groove 211, such that the seal mating member 700 abuts against an inner wall of the window 310.

Specifically, by providing the accommodation groove 211 which is recessed downwards at a top wall of the housing 210, at least a part of the window sash 400 is extendable into the accommodation groove 211, which not only enables the window air conditioner 200 to be mounted in the window 310 with ease, and easily improves the mounting reliability and stability of the window air conditioner 200, but also facilitates the cooperation of the window air conditioner 200 with the window sash 400, and realizes elegant appearance after the window air conditioner is mounted. Meanwhile, the window sash 400 may be soundproof to some extent, which reduces noise transferred from the outdoor portion 110 to the indoor portion 120.

According to the window air conditioner in the embodiment of the present application, by providing the accommodation groove 211 on the housing, at least a part of the window sash 400 may extend into the accommodation groove 211, which easily improves the mounting reliability and stability of the window air conditioner 200; meanwhile, the window sash 400 may be soundproof to some extent, which reduces noise transferred from the outdoor portion 110 to the indoor portion 120. By providing the rotary mounting base 3, the fixation member 1 is rotatably disposed at the rotary mounting base 3, such that the seal assembly 100 is rotatably accommodated within the accommodation groove 211, which facilitates not only the installation of the fixation member 1, but also the rotation of the fixation member 1 relative to the rotary mounting base 3, the storage of the seal assembly 100, and the reduction of the space occupied by the seal assembly 100.

Further, the accommodation groove 211 is recessed downwards from the top wall of the housing 210. Compared with the related art in which the accommodation groove is recessed upwards from a bottom wall of the housing, the window air conditioner 200 receives force more uniformly, the top wall of the window air conditioner 200 is prevented from being damaged due to a relatively large force, the setting reliability and working performance of the window air conditioner 200 are improved, and an air outlet of the window air conditioner 200 may be provided at a higher position, which facilitates the flow of airflow blown out of the air outlet in the indoor space, easily improves the temperature adjustment efficiency of the window air conditioner 200, and enhances the effect of adjusting indoor temperatures by the window air conditioner 200 with ease.

Figure 14:
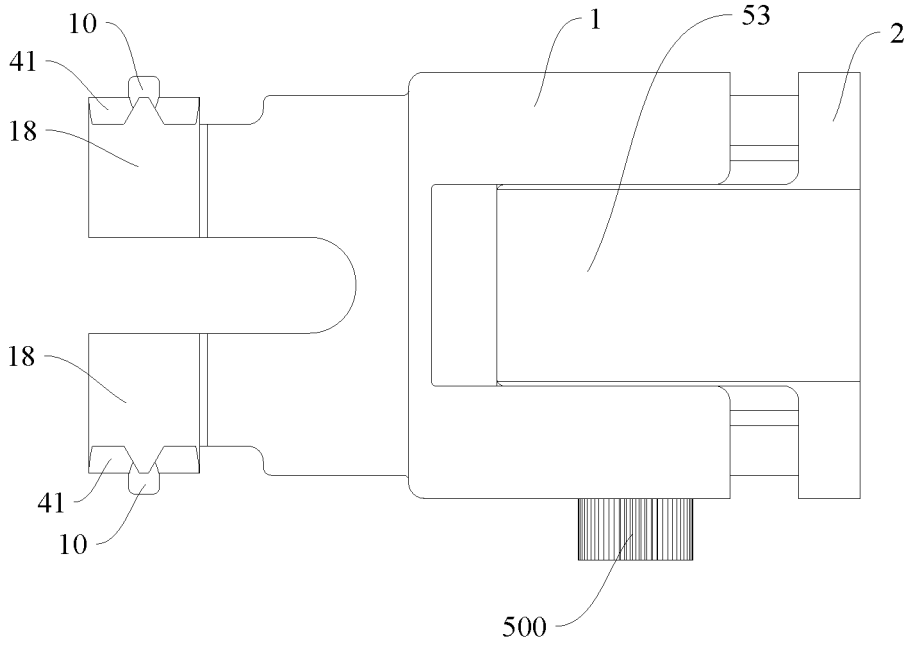
FIG. 14 is a schematic partial structural view of the seal assembly of the window air conditioner according to an embodiment of the present application.

Further, as shown in FIG. 14, the fixation member 1 is provided with a pivoting shaft 10, the rotary mounting base 3 is provided with a 31 pivot hole, and the pivoting shaft 10 is in a rotating fit with the pivot hole 31. In this way, the pivoting shaft 10 may cooperate with the pivot hole 31, which facilitates the smooth rotation of the fixation member 1 and improves the reliability of the rotating fixation member 1.

Figure 9:
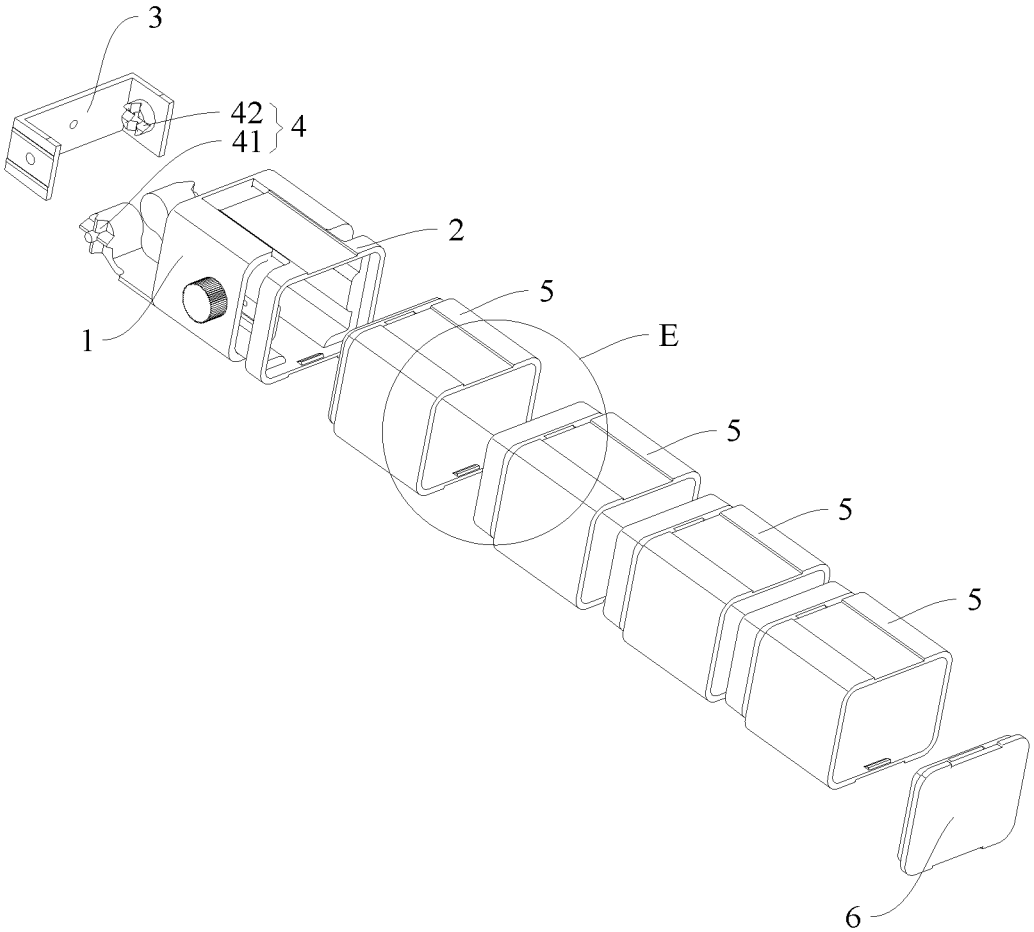
FIG. 9 is an exploded view of a seal assembly of the window air conditioner according to an embodiment of the present application.

Specifically, as shown in FIG. 9, the seal assembly 100 further includes an angle positioning assembly 4 which cooperates with the rotary mounting base 3 and the fixation member 1, so as to position the fixation member 1 at the current angle when the fixation member 1 is rotated to the set angle. In this way, the fixation member 1 may be positioned at a specific angle. For example, an included angle between the fixation member 1 and the horizontal direction is 90°, 45° or 30°, such that the user may position the rotation angle of the fixation member 1 as needed, thereby improving the performance of the seal assembly 100.

More specifically, the angle positioning assembly 4 includes a positioning projection 41 and a plurality of positioning grooves 42, one of the rotary mounting base 3 and the fixation member 1 is provided with the positioning projection 41, and the other of the rotary mounting base 3 and the fixation member 1 is provided with the plurality of positioning grooves 42.

Further, the positioning projection 41 is provided at the fixation member 1, and the plurality of positioning grooves 42 are arranged on the rotary mounting base 3. Specifically, the plurality of positioning grooves 42 are arranged in a circular shape; when the rotary mounting base 3 is rotated, the positioning projection 41 may be fitted with the plurality of the positioning grooves 42 in a manner of switching; the fixation member 1 may be positioned when the positioning projection 41 is fitted with one of the positioning grooves 42. In this way, the rotation angle of the fixation member 1 may be positioned by the positioning projection 41 and the positioning groove 42, such that the positioning reliability and stability of the fixation member 1 may be improved.

Further, a plurality of positioning projections 41 are provided and are arranged in a shape of ring, and fitted with the plurality of positioning grooves in a one-to-one correspondence, which balances the force received by the angle positioning assembly 4, easily improves the structural strength of the angle positioning assembly 4, and enhances the positioning reliability and accuracy of the angle positioning assembly 4.

Figure 11:
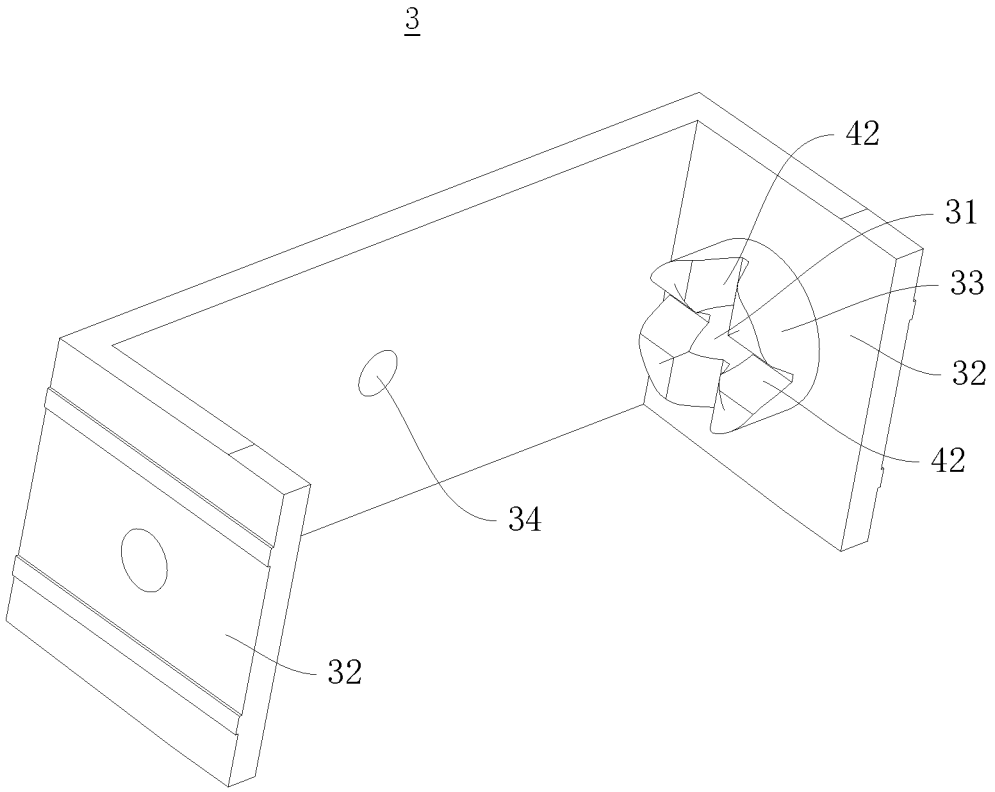
FIG. 11 is a schematic structural view of a rotary mounting base of the seal assembly of the window air conditioner according to an embodiment of the present application.
Figure 12:
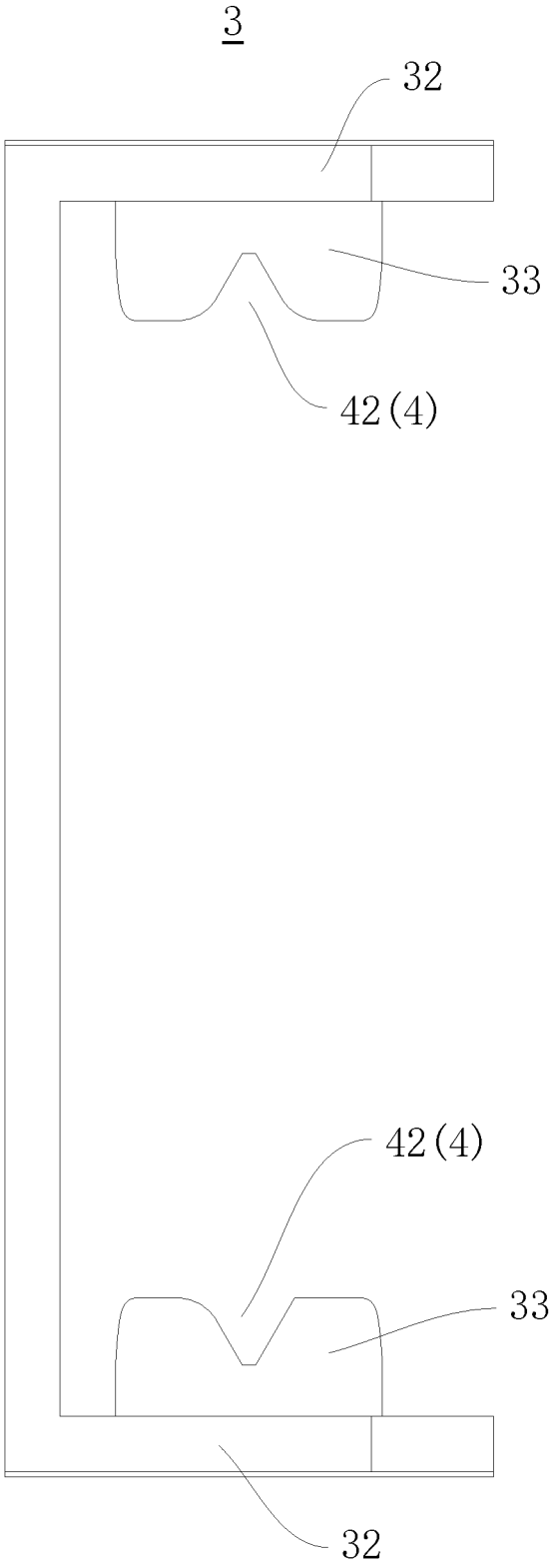
FIG. 12 is a schematic structural view of a rotary mounting base of the seal assembly of the window air conditioner according to an embodiment of the present application.

Specifically, as shown in FIG. 11, the rotary mounting base 3 includes mating plates 32 disposed opposite to each other, the two mating plates 32 are provided with projections 33 on opposite end surfaces, and each of the protrusions 33 is provided with the pivot hole 31 and a plurality of positioning grooves 42, which facilitates the processing of the pivot hole 31 and the positioning groove 42, and easily implements the rotating fit between the rotary mounting base 3 and the fixation member 1.

Figure 13:
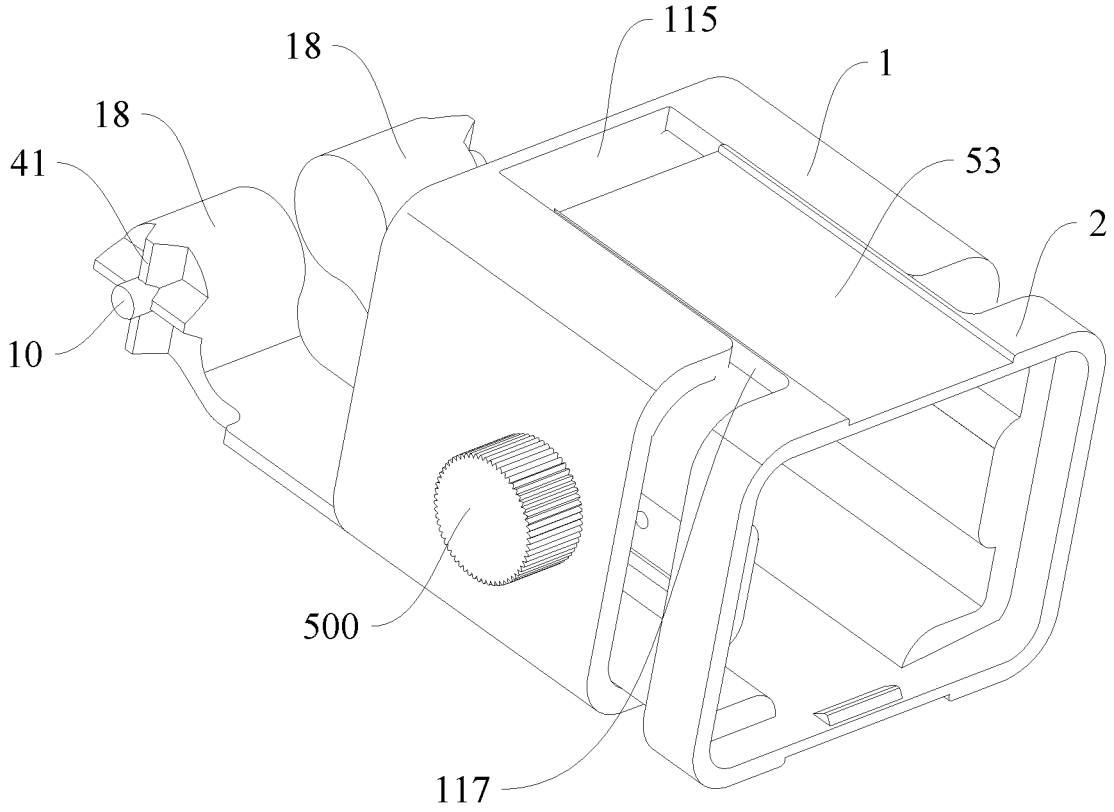
FIG. 13 is a schematic partial structural view of the seal assembly of the window air conditioner according to an embodiment of the present application.

Optionally, as shown in FIGS. 13-14, the fixation member 1 includes two mating projections 18 spaced apart from each other, each of which is in rotating fit with the rotary mounting base 3, which facilitates the arrangements of the pivoting shaft 10 and the positioning projection 41, the cooperation of the fixation member 1 with the rotary mounting base 3 and the rotation of the fixation member 1 relative to the rotary mounting base 3.

Figure 2:
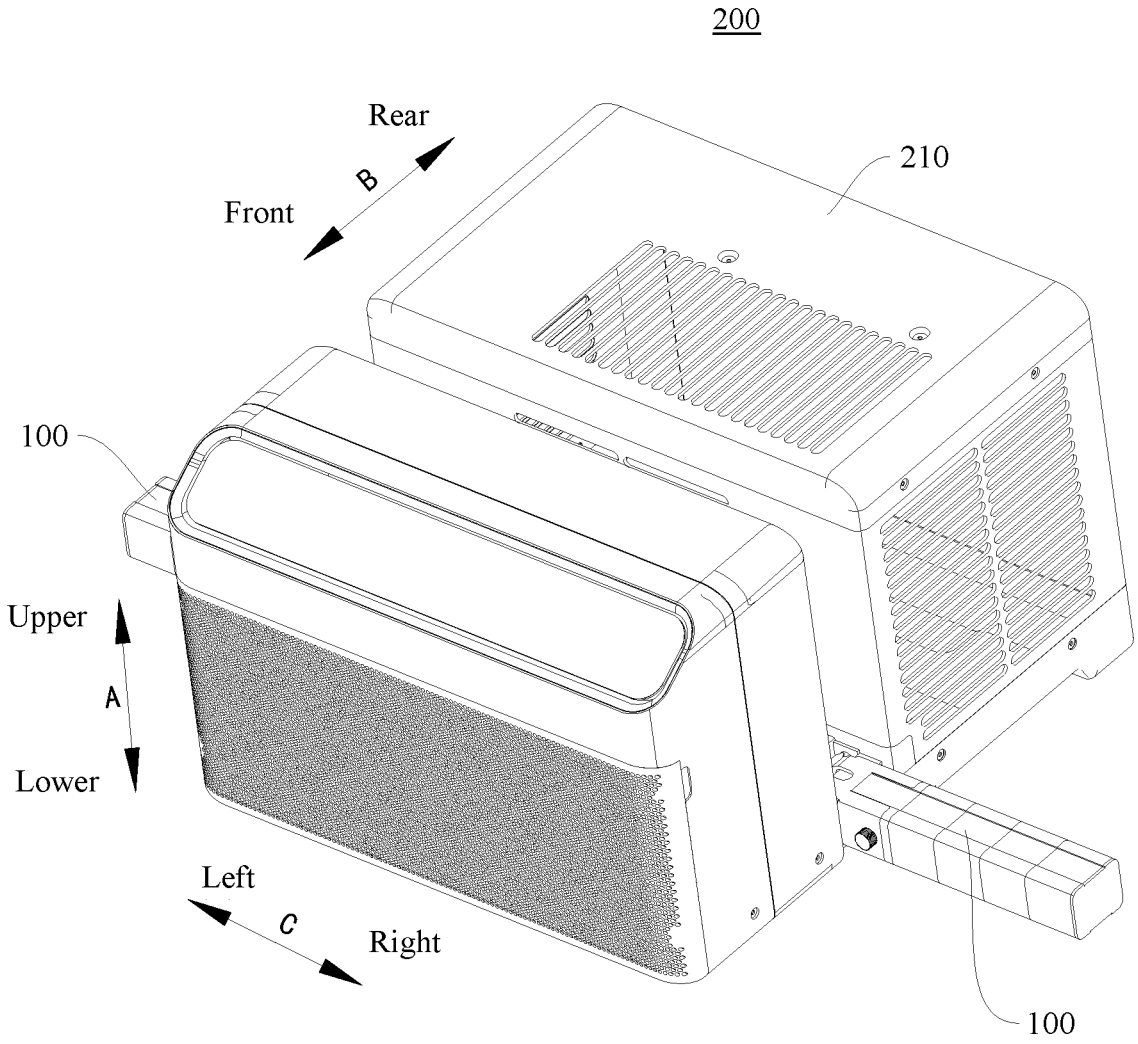
FIG. 2 is a schematic structural view of a window air conditioner according to an embodiment of the present application.
Figure 3:
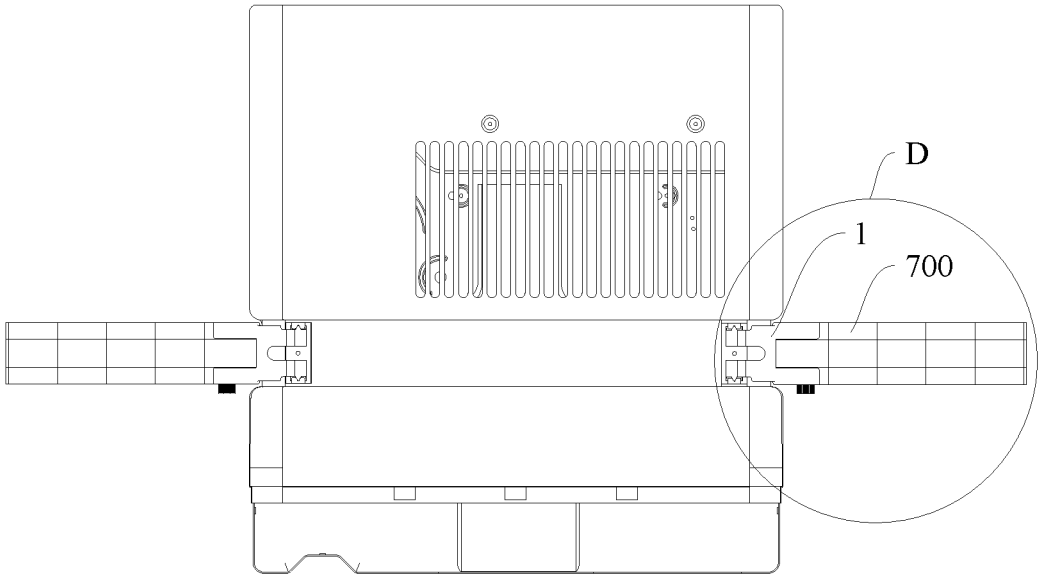
FIG. 3 is a schematic structural view of a window air conditioner according to an embodiment of the present application.
Figure 4:
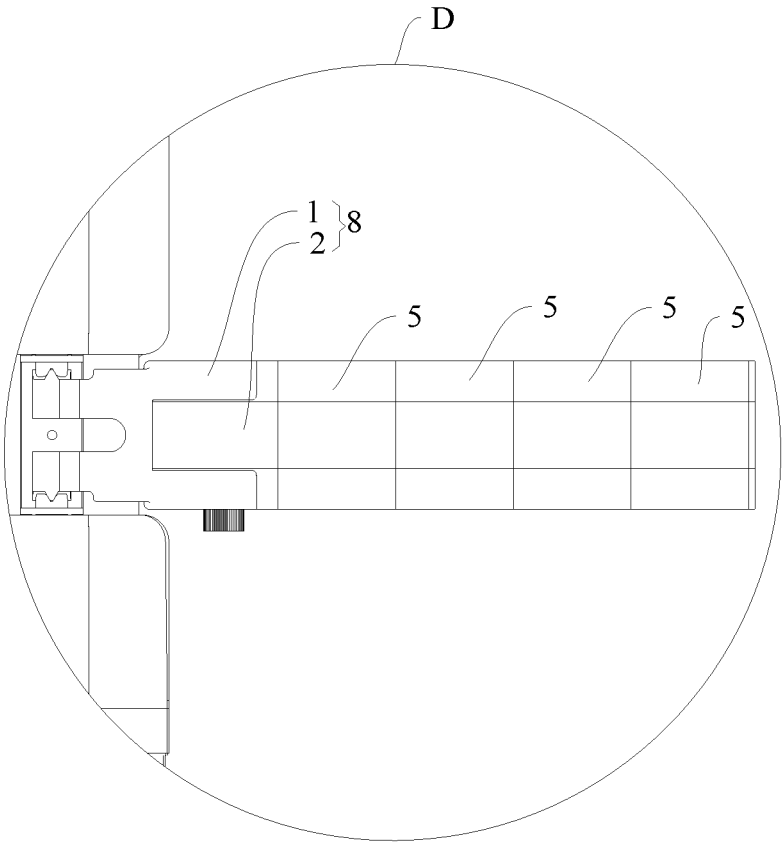
FIG. 4 is an enlarged view of the portion D in FIG. 3.

Further, as shown in FIG. 11, the rotary mounting base 3 is provided with a fixation hole 34 located between two mating projections 18, and the rotary mounting base 3 is fixed at the housing 210 by the fixation member passing through the fixation hole 34. Specifically, the width of the fixation hole 34 in the front and rear direction is greater than 10 mm (the front and rear direction is as indicated by an arrow B in FIGS. 1-2), which facilitates the fixed mounting of the rotary mounting base 3, and the mounting of the rotary mounting base 3, and improves the assembly efficiency of the seal assembly 100.

Specifically, as shown in FIGS. 53-56, the housing 210 includes: a chassis 212; a rear case 213, which is fixed at the chassis 212 and has an outdoor heat exchanger accommodated inside; and a front case 24, which is fixed at the chassis 212 and is spaced apart from the rear case 213 in the front and rear direction to form the accommodation groove 211, which not only facilitates the formation of the accommodation grooves 211, the cooperation of the window air conditioner 200 and the window sash 400, and the manufacturing of the housing 210, but also enhances the aesthetic appearance of the housing 210.

More specifically, as shown in FIGS. 53-56, the housing 210 further includes a middle partition 215, which is fixed at the chassis 212 and located within the accommodation groove 211, and front and rear ends of the middle partition 215 are fitted with the rear case 213 and the front case 214 respectively, which enables the lower surface of the window sash 400 to abut against the middle partition 215 easily, facilitates the wiring and drainage of the window air conditioner 200, and improves the operational reliability of the window air conditioner 200.

Figure 54:
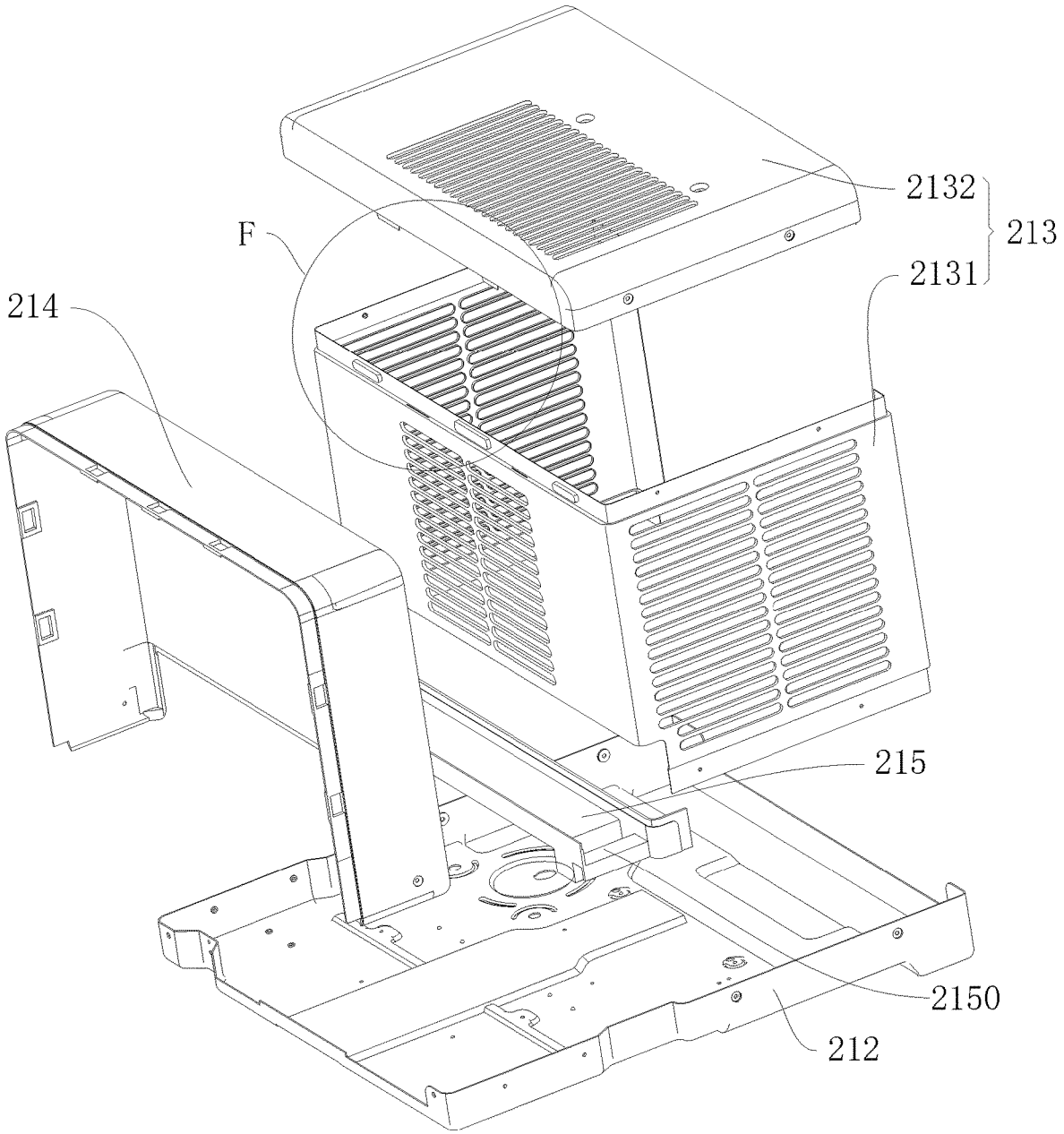
FIG. 54 is an exploded view of the housing of the window air conditioner according to an embodiment of the present application.

In some embodiments of the present application, as shown in FIG. 54, the seal assembly 100 includes a rotary mounting base 3, on which, the fixation member 1 is rotatably disposed, such that the seal assembly 100 is rotatably accommodated in the accommodation groove 211.

The middle partition 215 is provided with a top open placement space 2150, the rotary mounting base 3 is accommodated in the placement space 2150, the fixation member 1 is provided with an accommodation space 19, and when the seal assembly 100 is rotated to extend out of the accommodation groove 211, an outer edge of the placement space 2150 extends into the accommodation space 19, such that the seal assembly 100 is substantially flush with the middle partition 215. Therefore, the seal assembly 100 is located at a sealed window in parallel or substantially parallel to the chassis 212, which reduces the height of the seal assembly 100 relative to the window 310 when located at the sealed window 310.

In the specific example of the present application, the two mating projections 18 are located at the upper portion of the fixation member 1, and a part of each of the two mating projections 18 extends into the placement space 2150, and the space below the two mating projections 18 is the accommodation space 19. When the seal assembly 100 is rotated outside the accommodation groove 211, the portion of the fixation member 1 below the two mating projections 18 is located outside the chassis 212, and the inner peripheral wall of the portion of the fixation member 1 located below the two mating projections 18 may abut against the outer peripheral wall of the chassis 212. Therefore, the seal assembly 100 is located at the sealed window in parallel or substantially parallel to the chassis 212, ensuring the sealing effect.

Further, the rotary mounting base 3 is connected with the middle partition 215 by screws.

Optionally, as shown in FIGS. 53-56, the housing 213 includes a rear case seat 2131 and a rear case cover 2132, wherein the rear case seat 2131 is open at the top and fixed at the chassis 212, and the rear case cover 2132 is covered at the top of the rear case seat 2131, which easily improves the structural flexibility of the rear case 213 and facilitates the disassembly and assembly of the parts in the rear case 213.

Further, the front case 24 is made of sheet metal or plastic, the rear case 213 is made of sheet metal, and the middle partition 215 is made of plastic.

Figure 55:
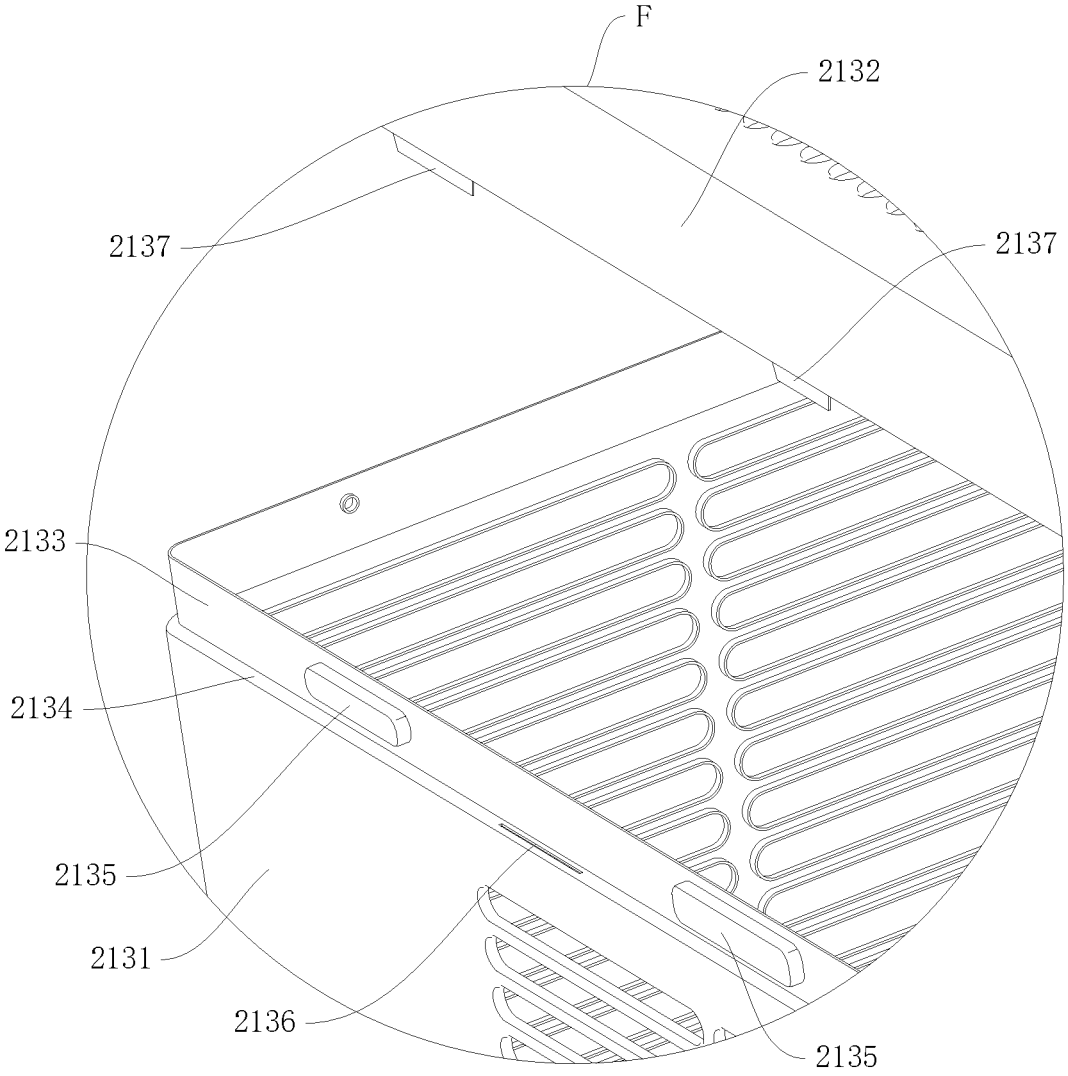
FIG. 55 is an enlarged view of the portion F in FIG. 54.

Specifically, as shown in FIG. 55, a part of the top wall of the rear case seat 2131 is provided with a support plate 2133, another part of the top wall of the rear case seat 2131 is configured as a support step surface 2134, the rear case cover 2132 is covered outside the support plate 2133 and the lower end of the rear case cover 2132 is supported on the support step surface 2134, which facilitates the assembly and connection of the rear case seat 2131 and the rear case cover 2132, improves the connection reliability of the rear case seat 2131 and the rear case cover 2132, and further enhances the structural stability of the housing 210.

More specifically, as shown in FIG. 55, the support plate 2133 is provided with a plurality of support bosses 2135 spaced apart from each other, each of which abuts against the inner peripheral wall of the rear case cover 24. Therefore, the inner peripheral wall of the rear case cover 24 may be supported by the support boss 2135, which enhances the connection strength between the case seat 24 and the rear case cover 2132.

Optionally, as shown in FIG. 55, the support step surface 2134 is provided with a buckling hole 2136, and the snap extension portion 2137 is arranged at a lower end of the rear case cover 2132, and extends into the buckling hole 2136, which easily positions, disassembles and assembles the rear case cover 2132, and further improves the connection reliability of the rear case seat 2131 and the rear case cover 2132.

Specifically, the chassis 212 is an integrally molded member, the position of the rear case 213 on the chassis 212 is fixed, and the position of the front case 214 on the chassis 212 is fixed. Compared with the related art in which the chassis is a split piece and the chassis is movable relative to the rear case or the front case, the structure of the chassis 212 may be simplified, the complicated structure of the window air conditioner 200 is avoided, the manufacturing of the chassis is facilitated, the structural strength of the chassis 212 may be enhanced, and the structural reliability and stability of the window air conditioner 200 may be improved.

In some embodiments of the present application, the seal assembly 100 includes a first connection member 8 with a variable length, the first connection member 8 including the fixation member 1 and a slide block 2, at least a portion of the fixation member 1 being disposed in the accommodation groove 211, and the slide block 2 being in a sliding fit with the fixation member 1, such that the length of the first connection member 8 is adjustable by the sliding fit between the slide block 2 and the fixation member 1, thereby adjusting a seal length of the seal assembly 100, such that the seal assembly 100 may be configured for sealing window sashes 400 of different sizes, which improves the sealing effect of the seal assembly 100, and extends the range of use of the seal assembly 100, thereby extending the range of application of the window air conditioner 200, and improving functionality and applicability of the window air conditioner 200.

Further, the seal assembly 100 further includes a plurality of second connection members 5, at least one of which is detachably connected with the slide block 2, and any two of which are detachably connected with each other to adjust the length of the seal assembly 100. Therefore, by arranging the plurality of second connection members 5, at least one of the second connection members 5 is detachably connected to the slide block 2, and any two of the second connection members 5 are detachably connected with each other, which facilitates the structural flexibility of the seal assembly 100. The length of the seal assembly 100 may be adjusted by connecting different numbers of second connection members 5, which extends the variation range of the seal length of the seal assembly 100, enables the seal assembly 100 to be fitted with window sashes 400 of different sizes, further improves the sealing reliability and stability of the seal assembly 100, and further extends the range of use of the seal assembly 100.

Figure 10:
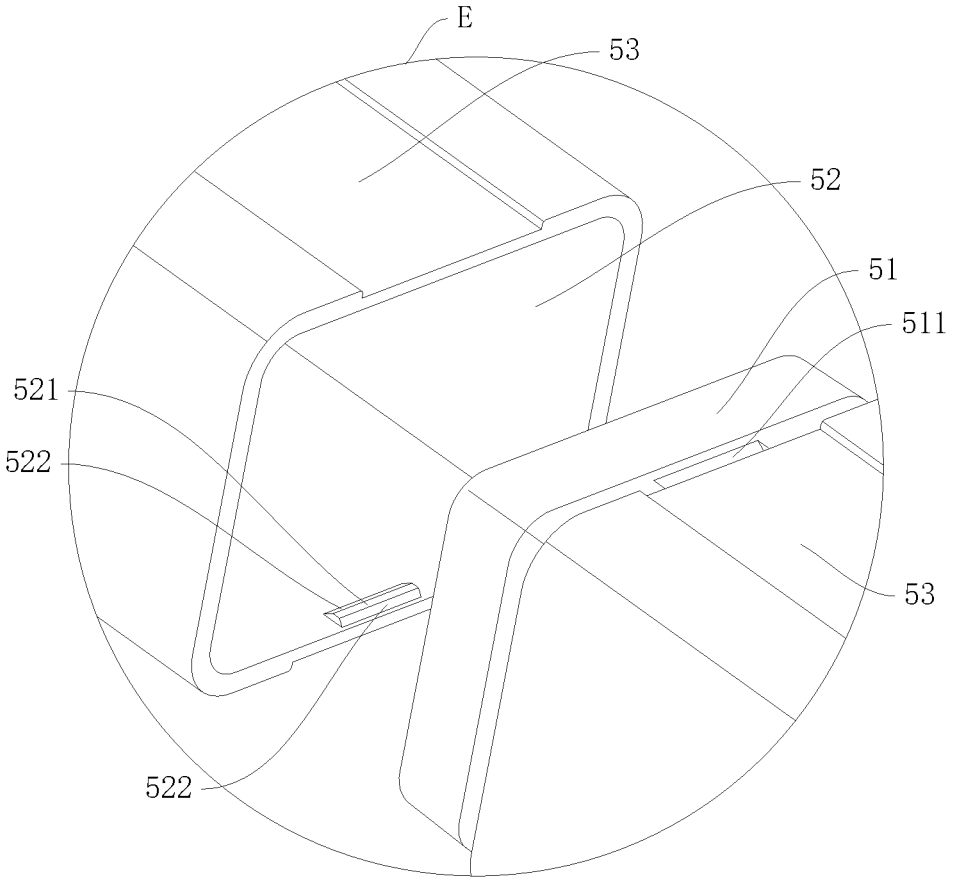
FIG. 10 is an enlarged view of the portion E in FIG. 9.

Specifically, as shown in FIG. 10, each of the second connection members 5 includes an insertion portion 51, each of the second connection members 5 and the slide block 2 are both provided with an insertion chamber 52, and each of the insertion portions 51 may be inserted into and detached from the insertion chamber 52, which facilitates the connection of the adjacent second connection members 5, and the assembly and molding of the plurality of second connection members 5, and further facilitates the change in the seal length of the seal assembly 100.

Optionally, in the inserting and detaching direction of the second connection member 5, the outer peripheral surface of the insertion portion 51 is obliquely disposed inwards from the rear to the front.

More specifically, as shown in FIG. 10, one of the inner walls of the insertion portion 51 and the insertion chamber 52 is provided with a first elastic projection 521, the other of the inner peripheral walls of the insertion portion 51 and the insertion chamber 52 is provided with a first groove 511, and the first elastic projection 521 is extendable into the first groove 511. In this way, the reliable connection of the adjacent second connection members 5 is realized by the first elastic protrusion 521 and the first groove 511, which enhances the connection strength of the plurality of second connection members 5, and further improves the structural stability of the seal assembly 100.

Figure 19:
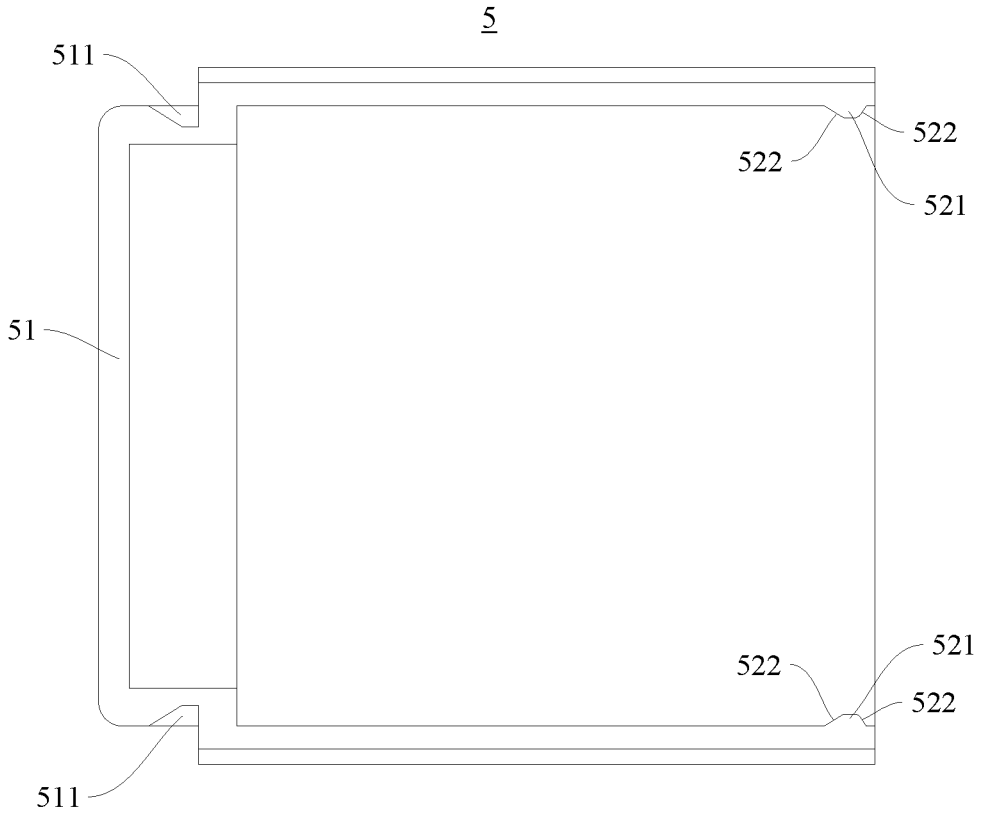
FIG. 19 is a cross-sectional view of a second connection member of the seal assembly of the window air conditioner according to one embodiment of the present application.
Figure 20:
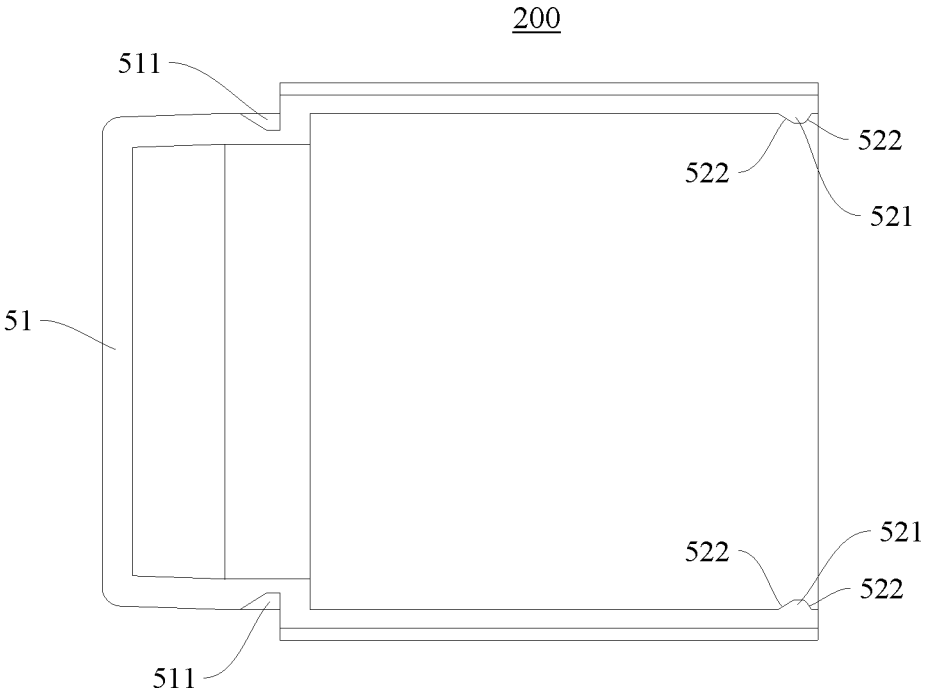
FIG. 20 is a cross-sectional view of a second connection member of the seal assembly of the window air conditioner according to another embodiment of the present application.
Figure 21:
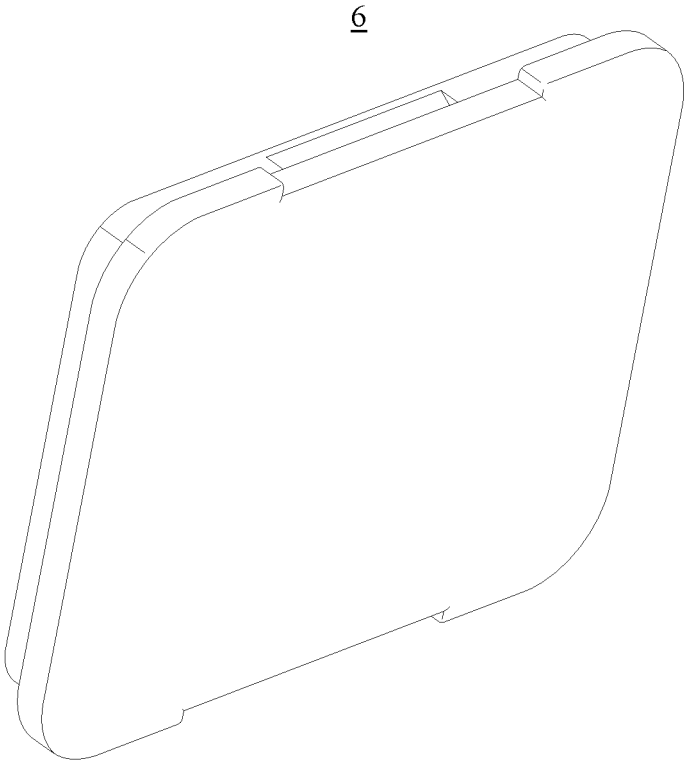
FIG. 21 is a schematic structure view of a seal end cap of the seal assembly of the window air conditioner according to an embodiment of the present application.

Further, as shown in FIGS. 19 and 20, the first elastic projection 521 is provided in the insertion chamber 52; in the inserting and detaching direction of the second connection member 5, the first elastic projection 521 has two opposite inclined guide surfaces 522, first ends of the two inclined guide surfaces 522 are fixed at the inner wall of the insertion chamber 52, and second ends of the two inclined guide surfaces 522 extend obliquely toward each other. In this way, the insertion and detachment of the insertion portion 51 may be guided by the two inclined guide surfaces 522, which not only enables the insertion portion 51 to be assembled with or disassembled from the insertion chamber 52 smoothly, but also improves the connection of the insertion portion 51 and the insertion chamber 52. At the same time, the uniform and elegant appearance of the second connection member 5 may be realized.

Specifically, the front wall surface of the first groove 511 has a guide surface which extends obliquely forwards from the bottom up.

Optionally, as shown in FIG. 9, the seal assembly 100 further includes a seal end cap 6 for sealing an opening end of the insertion chamber 52 farthest from the fixation member 1. In this way, the insertion chamber 52 farthest from the fixation member 1 is easily sealed, the tightness of the second connection member 5 is improved, the plurality of second connection members 5 have the same structure and are manufactured with ease, and the interchangeability of the second connection member 5 may be improved.

In some embodiments, the plurality of second connection members 5 may be marked, such that the plurality of the second connection members 5 is arranged in a certain order.

Specifically, the top wall of the seal assembly 100 is provided with a sealing sponge against the window sash 400, which not only avoids the direct contact of the window sash 400 with the seal assembly 100, reduces the wear due to the contact of the window sash 400 with the seal assembly 100, but also improves the sealing effect of the window sash 400 and the seal assembly 100.

More specifically, as shown in FIG. 13, the first connection member 8 and each of the second connection members 5 are provided with a second groove 53 for accommodating the sealing sponge, which facilitates the arrangement of the sealing sponge, and improves the sealing performance of the sealing sponge.

Optionally, as shown in FIG. 13, the top end of the fixation member 1 is provided with a guide groove 115, and the top end of the slide block 2 is provided with a guide boss 122 which is fitted with the guide groove 115, which may position and guide the sliding of the slide block 2 by the guide groove 115 and the guide boss 122, further facilitates the smooth sliding of the slide block 2, and further improves the sliding accuracy and reliability of the slide block 2.

Specifically, the seal assembly 100 may be made of plastic, sheet metal, rubber, silicone, or the like.

Specifically, as shown in FIGS. 13 and 14, the seal assembly 100 further includes a slide positioning assembly 500, disposed at the fixation member 1 and engaging with the slide block 2 to position the slide block 2 at the current position, which may position the slide block 2 by the slide positioning assembly 500, enables the seal assembly 100 to keep the specific seal length, improves the structural stability of the seal assembly 100 and reliably seals the seal assembly 100.

Figure 16:
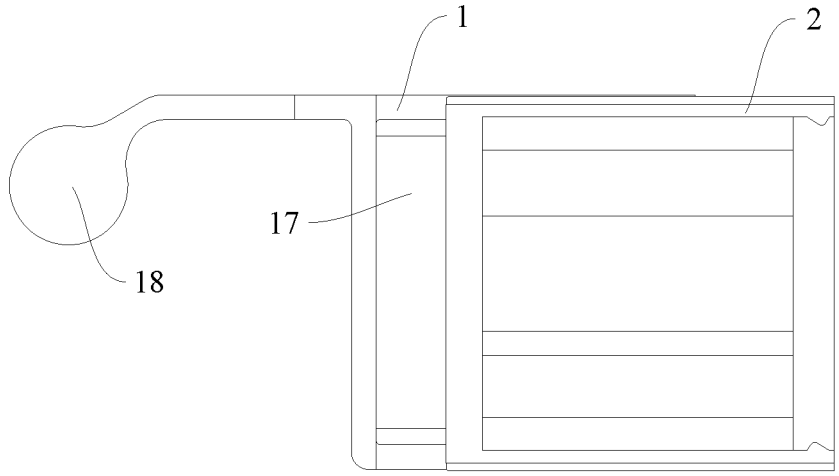
FIG. 16 is a partial cross-sectional view of the seal assembly of the window air conditioner according to an embodiment of the present application.

More specifically, as shown in FIG. 16, a slide cavity 17 is provided in the fixation member 1, and at least a portion of the slide block 2 extends into the slide cavity 17, which facilitates the cooperation of the fixation member 1 and the slide block 2, and enables the slide block 2 to slide relative to the fixation member 1.

The window air conditioner 200 according to a first embodiment of the present application will be described below with reference to FIGS. 1 to 24 and FIGS. 53 to 56.

As shown in FIGS. 1 to 24, the seal assembly 100 of the window air conditioner according to the embodiment of the present application includes a first connection member 8 and a second connection member 5.

Specifically, the slide block 2 and the second connection member 5 constitute a seal mating member 700 which is connected to the fixation member 1, and the seal mating member 700 is rotatable to extend out of the accommodation groove 211 to abut against the inner wall of the window 310. Thus, the seal length of the seal assembly 100 may be adjusted by adjusting the length of the seal mating member 700.

Figure 15:
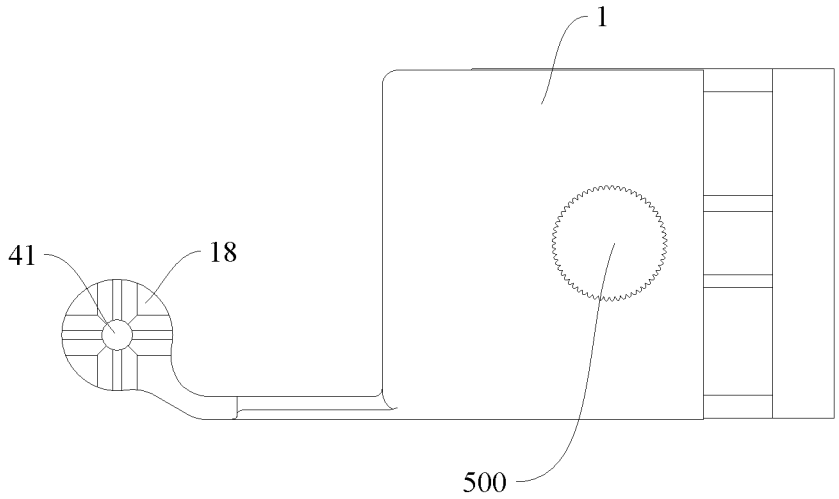
FIG. 15 is a schematic partial structural view of the seal assembly of the window air conditioner according to an embodiment of the present application.

In some embodiments of the present application, as shown in FIGS. 13-15, the slide positioning assembly 500 is configured as a rotation member which rotatably passes through the fixation member 1 and is in a threaded fit with the fixation member 1, and the rotation member is rotated to adjust the length of the portion of the rotation member extending into the slide cavity 17, and may abut against the slide block 2 to position the slide block 2. In this way, the user may control the slide block 2 to slide or not by rotating the rotation member, which further facilitates the user to adjust the length of the slide block 2 as needed.

Figure 22:
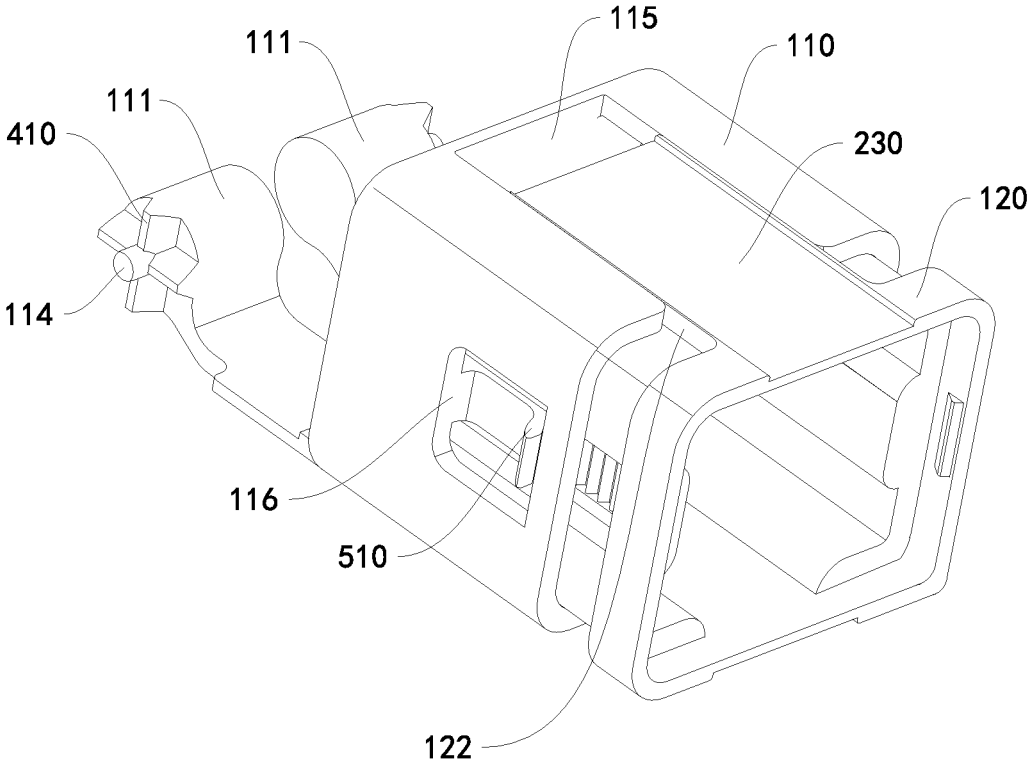
FIG. 22 is a schematic partial structural view of the seal assembly of the window air conditioner according to some other embodiments of the present application.
Figure 23:
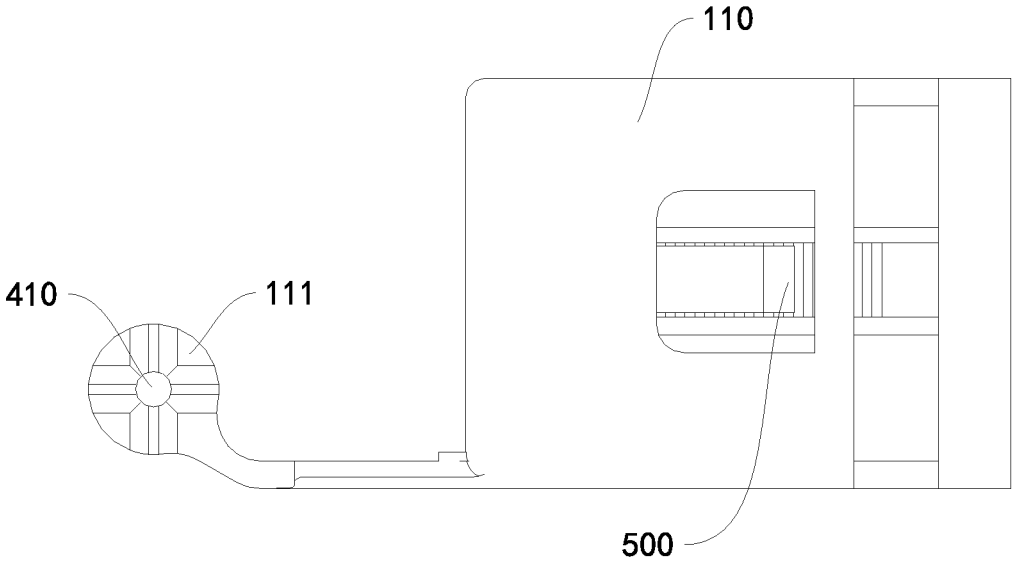
FIG. 23 is a schematic partial structural view of the seal assembly of the window air conditioner according to some other embodiments of the present application.
Figure 24:
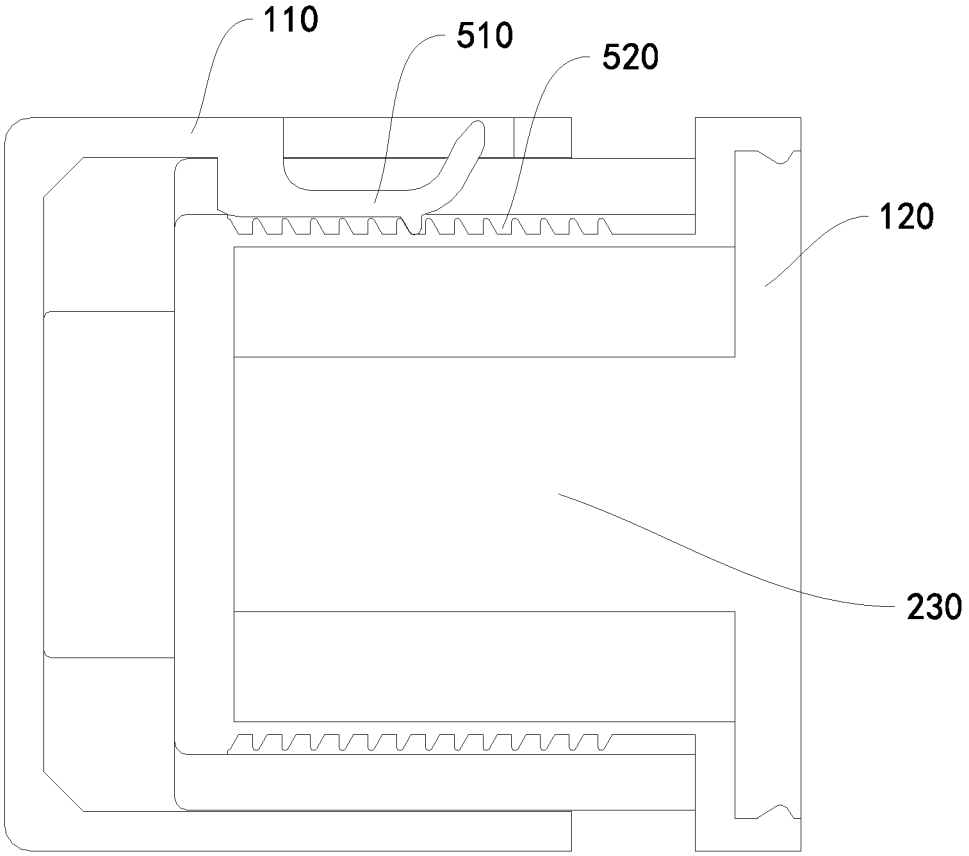
FIG. 24 is a schematic partial structural view of the seal assembly of the window air conditioner according to some other embodiments of the present application.

In some other embodiments of the present application, as shown in FIGS. 22-24, the fixation member 1 is provided with an escape hole 11 communicating with the slide cavity 17, the slide positioning assembly 500 includes an elastic buckle 12 and a plurality of fitting buckles 21, wherein the plurality of fitting buckles 21 are spaced apart on an outer peripheral wall of the slide block 2 in a moving direction of the slide block 2, and the elastic buckle 12 is deformably disposed at an inner peripheral wall of the escape hole 11 to be in an inclined fit with or disengaged from at least one of the fitting buckles 21; the slide positioning assembly 500 is configured to move the slider 120 in a direction away from the fixation member 1 when the elastic buckle 12 is in an inclined fit with the fitting buckle 21, and move the slider 120 in a direction toward the fixation member 1 when the elastic buckle 12 is disengaged from the fitting buckle 21. In this way, the user may control the sliding direction of the slide block 2 by the elastic buckles 12, to prevent the slide block 2 from moving in the direction close to the fixation member 1 due to unintentional touch of the slide block 2, which improves the positioning reliability and accuracy of the slide positioning assembly 500, and further facilitates the user to adjust the length of the slide block 2 as needed.

Figure 17:
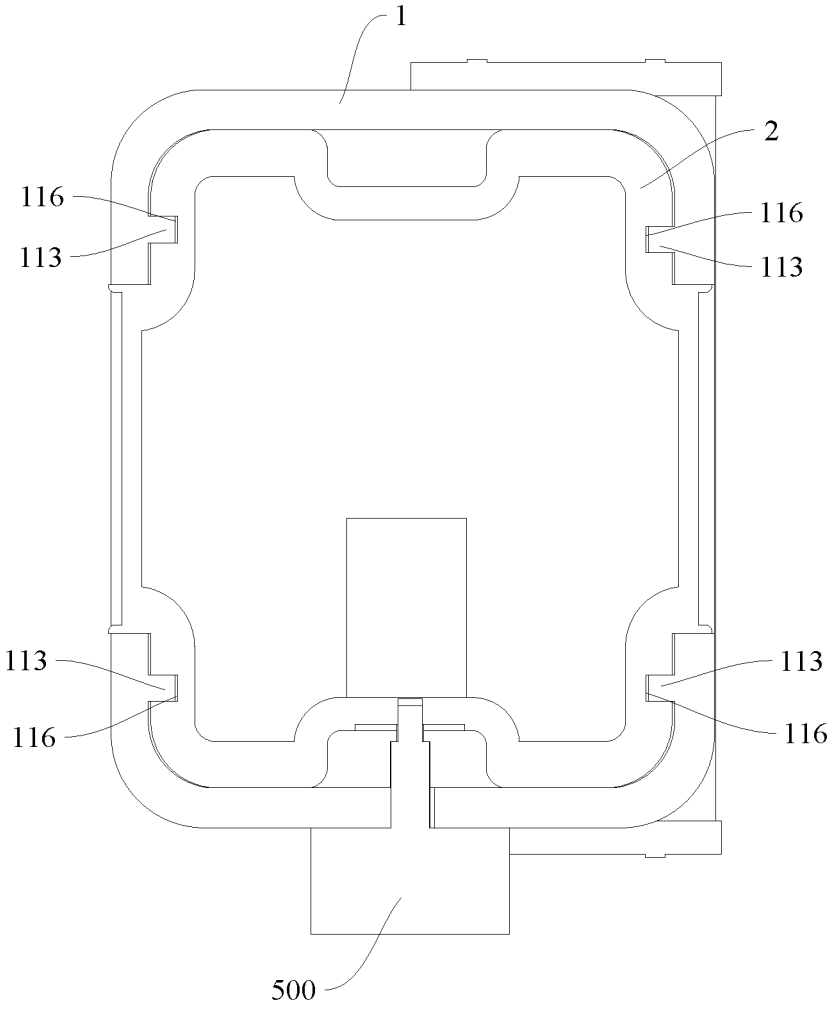
FIG. 17 is a partial cross-sectional view of the seal assembly of the window air conditioner according to an embodiment of the present application.
Figure 18:
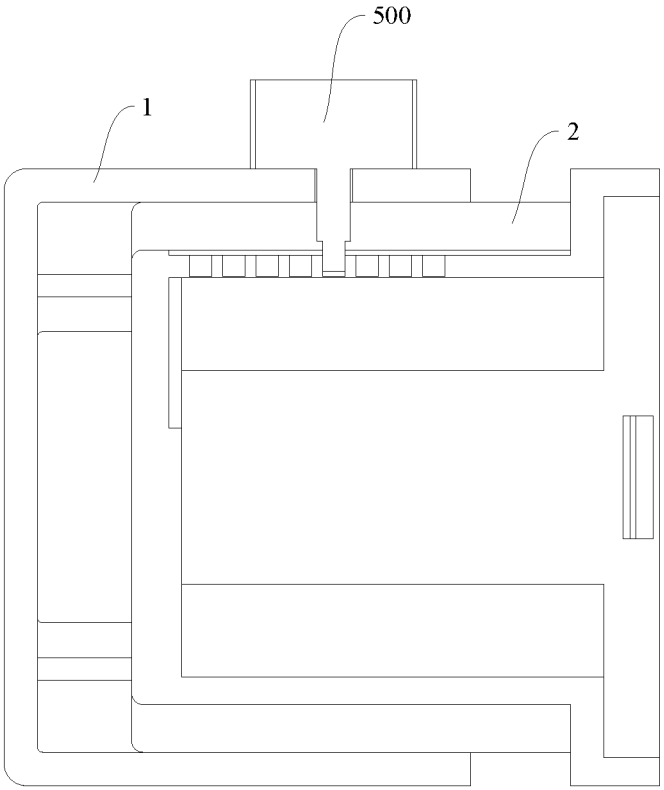
FIG. 18 is a partial cross-sectional view of the seal assembly of the window air conditioner according to an embodiment of the present application.

Optionally, as shown in FIG. 17, the inner wall of the slide cavity 17 is provided with a slide rib 113, and the outer wall of the slide block 2 is provided with a sliding groove 16 fitted with the slide rib 113, which may position and guide the sliding of the slide block 2 by the slide rib 113 and the sliding groove 116, further facilitates the smooth sliding of the slide block 2, improves the structural strength of the seal assembly 100, and further improves the sliding accuracy and reliability of the seal assembly 100.

The window air conditioner 200 according to a second embodiment of the present application will be described below with reference to FIGS. 25 to 29.

The seal assembly 100 of the window air conditioner according to the embodiment of the present application includes the fixation member 1 and the slide block 2.

The window air conditioner 200 is supported on the window 310 of the wall 300, and the window 310 is provided with the movable window sash 400. For example, in some embodiments of the present application, the window sash 400 may be movably disposed at the window 310 up and down. The window air conditioner 200 includes the housing 210 which is provided with the accommodation groove 211, the accommodation groove 211 opening at the top, at least a part of the window sash 400 is extendable into the accommodation groove 211, the seal assembly 100 is in contact with the inner walls of the window sash 400 and the window 310 respectively, and the seal length of the seal assembly 100 is adjustable.

Figure 25:
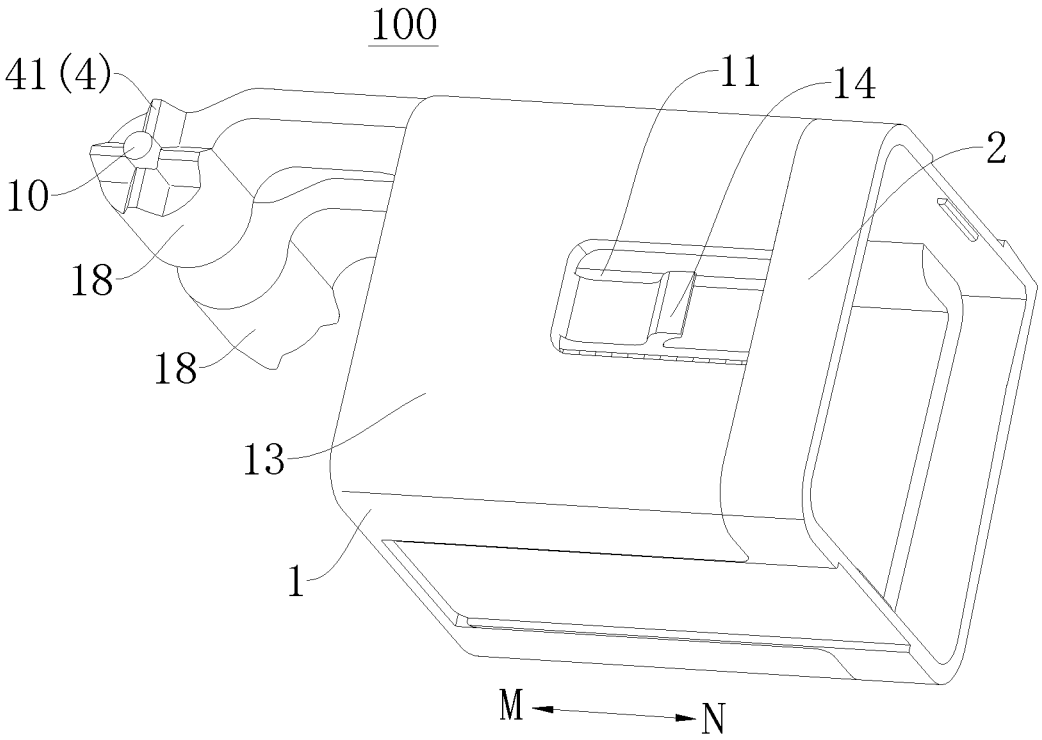
FIG. 25 is perspective view of the seal assembly of the window air conditioner according to an embodiment of the present application.
Figure 26:
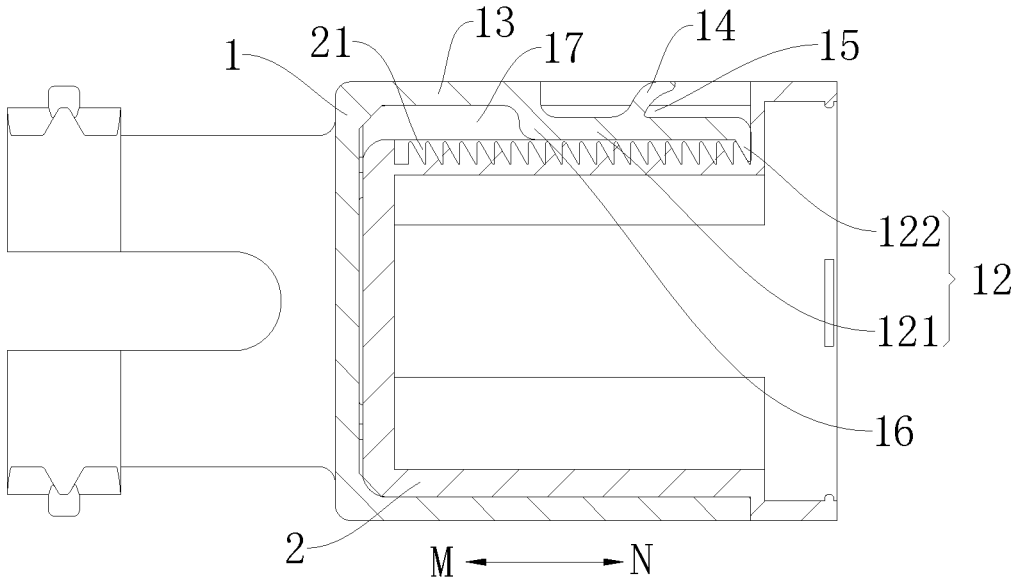
FIG. 26 is a cross-sectional view of the seal assembly of the window air conditioner according to an embodiment of the present application.

Specifically, referring to FIGS. 25 and 26, at least a portion of the fixation member 1 is disposed in the accommodation groove 211, and the fixation member 1 is formed thereon with the escape hole 11 and the elastic buckle 12, the elastic buckle 12 is disposed at the inner peripheral wall of the escape hole 11 and may include a deformation portion 121 and a snap portion 122, and the deformation portion 121 may be configured as tabulate; the snap portion 122 may be formed at a free end of the deformation portion 121. For example, in FIG. 26, the snap portion 122 may be provided at an N end of the deforming portion 121.

Figure 28:
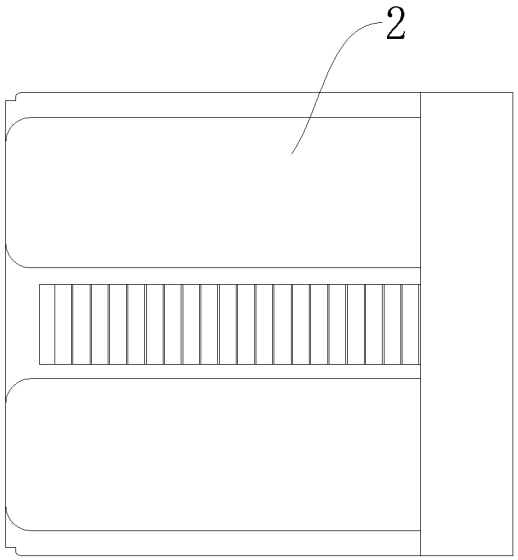
FIG. 28 is a schematic view of a slide block in the seal assembly of the window air conditioner according to an embodiment of the present application.
Figure 29:
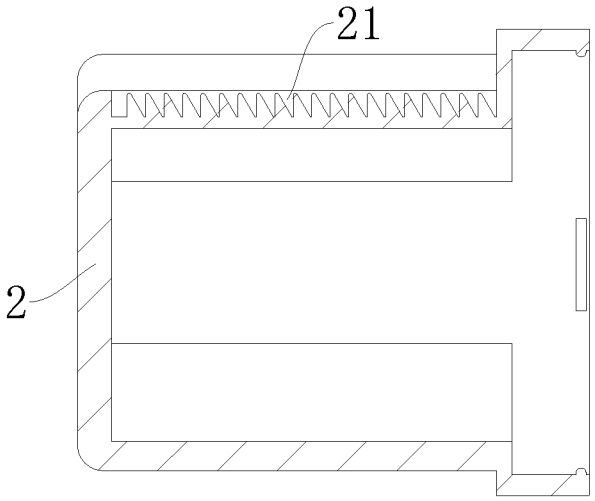
FIG. 29 is a cross-sectional view of a slide block in the seal assembly of the window air conditioner according to an embodiment of the present application.
Figure 30:
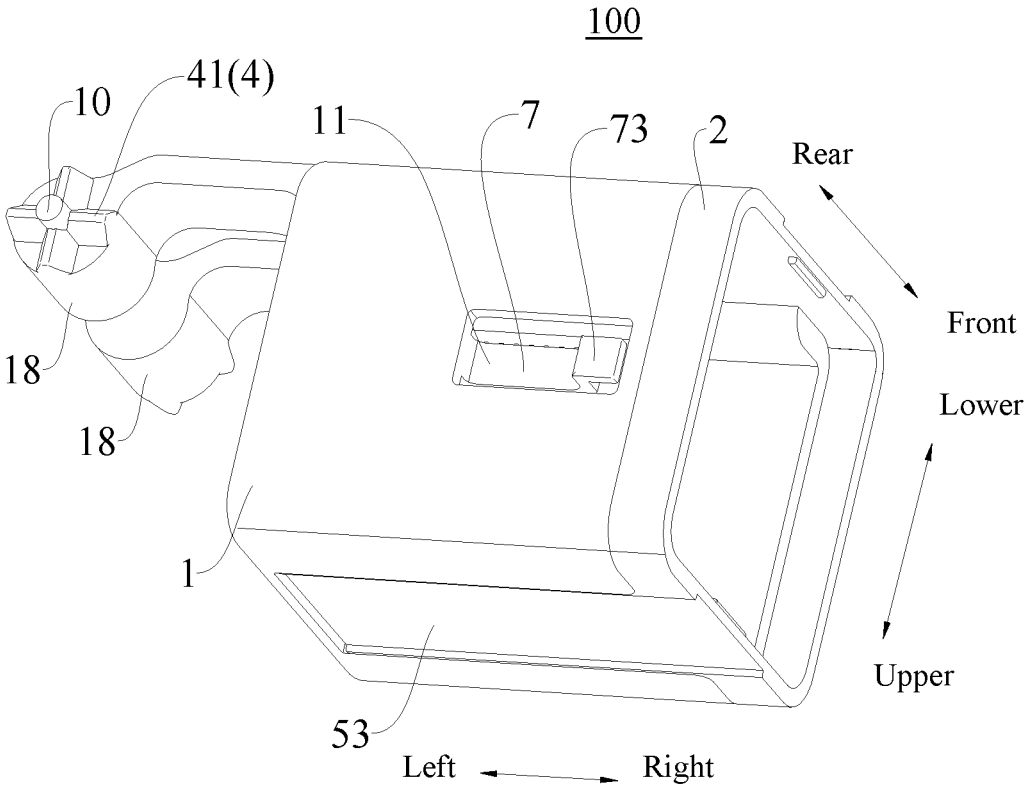
FIG. 30 is a schematic view of the seal assembly for the window air conditioner according to an embodiment of the present application.
Figure 31:
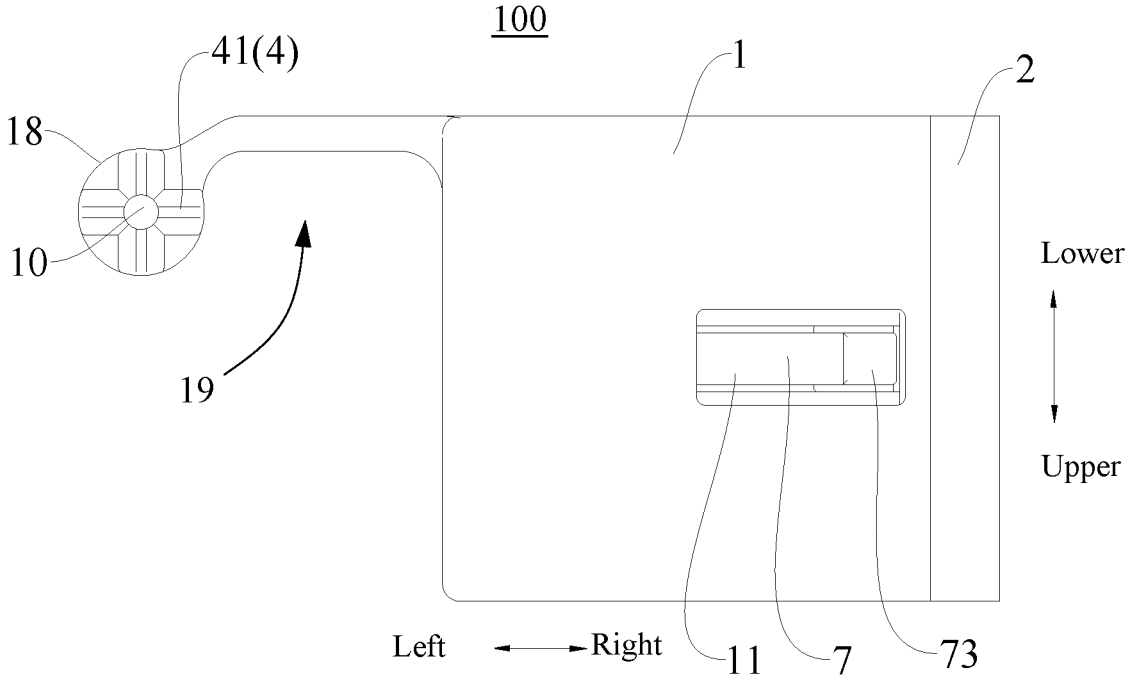
FIG. 31 is a schematic view of the seal assembly shown in FIG. 30 from another angle.

Referring to FIGS. 28 and 29, the slide block 2 is in a sliding fit with the fixation member 1. The slide block 2 is provided with a plurality of fitting buckles 21, and the plurality of fitting buckles 21 are spaced apart on the outer peripheral wall of the slide block 2 in the moving direction of the slide block 2. The deformation portion 121 is deformably arranged on the fixation member 1, such that the snap portion 122 is in an inclined fit with or disengaged from at least one of the fitting buckles 21.

For example, referring to FIG. 26, the snap portion 122 may be in an inclined fit with or disengaged from at least one of the fitting buckles 21. In some optional embodiments of the present application, the snap portion 122 may also be in an inclined fit with or disengaged from the plurality of fitting buckles 21. In the description of the present application, "plurality" refers to two or more.

The seal assembly 100 is configured such that the fixation member 1 is fixed relative to the slide block 2 in terms of position when the snap portion 122 is in an inclined fit with the fitting buckle 21, and the slide block 2 is movable in a direction toward or away from the fixation member 1 when the snap portion 122 is disengaged from the fitting buckle 21. For example, when the snap portion 122 is in an inclined fit with the fitting buckle 21, the fixation member 1 is fixed relative to the slide block 2 in terms of position, which may ensure the sealing reliability. When the snap portion 122 is disengaged from the fitting buckle 21, the slide block 2 is movable in a direction toward or away from the fixation member 1, thereby facilitating the adjustment of the seal length of the seal assembly 100 as needed. Therefore, not only the positioning reliability of the seal assembly 100 is ensured, but also the user is facilitated to adjust the position of the slide block 2 relative to the fixation member 1 as needed, thereby adjusting the seal length.

In the window air conditioner 200 according to the embodiment of the present application, at least a part of the window sash 400 is extendable into the accommodation groove 211 by providing the accommodation groove 211 which is recessed downwards in the top wall of the housing 210, which not only facilitates the installation of the window air conditioner 200 into the window 310, and improves the mounting reliability and stability of the window air conditioner 200, but also facilitates the cooperation of the window air conditioner 200 with the window sash 400, and enables the mounted window air conditioner 200 to have more elegant appearance.

Further, the accommodation groove 211 is recessed downwards from the top wall of the housing 210. Compared with the related art in which the accommodation groove is recessed upwards from a bottom wall of the housing, the window air conditioner 200 receives force more uniformly, the top wall of the window air conditioner 200 is prevented from being damaged due to a relatively large force, the setting reliability and working performance of the window air conditioner 200 are improved, and an air outlet of the window air conditioner 200 may be provided at a higher position, which facilitates the flow of airflow blown out of the air outlet in the indoor space, easily improves the temperature adjustment efficiency of the window air conditioner 200, and enhances the effect of adjusting indoor temperatures by the window air conditioner 200 with ease.

Moreover, by the seal assembly 100 of the window air conditioner including the fixation member 1 and the slide block 2, the slide block 2 is in a sliding fit with the fixation member 1, and is provided with the plurality of fitting buckles 21 which are spaced apart on the outer peripheral wall of the slide block 2 in the moving direction of the slide block 2, and the deformation portion 121 is deformably disposed at the fixation member 1 to be in an inclined fit with or disengaged from at least one of the fitting buckles 21, which not only mounts the seal assembly 100 on the window air conditioner 200 by the fixation member 1, facilitates the arrangement of the seal assembly 100, and avoids the loss of the seal assembly 100, but also adjusts the length of the seal assembly 100 by the sliding fit between the slide block 2 and the fixation member 1, thereby adjusting the seal length of the seal assembly 100, sealing window sashes 400 of different sizes by the seal assembly 100, improving the sealing effect of the seal assembly 100, extending the range of use of the seal assembly 100 and the range of application of the window air conditioner 200, and improving the functionality and applicability of the window air conditioner 200.

Figure 27:
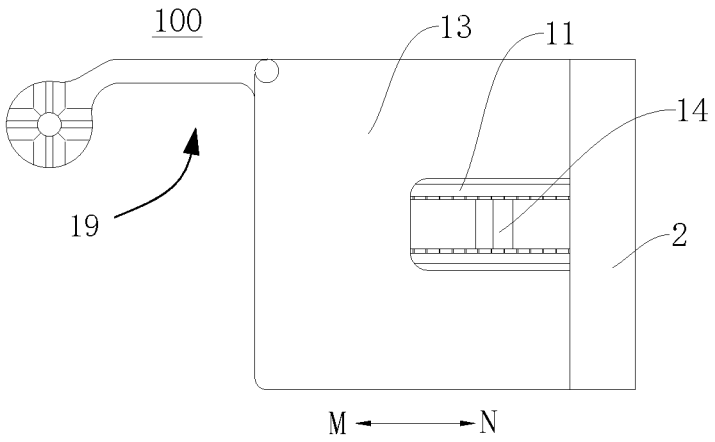
FIG. 27 is a schematic view of the seal assembly of the window air conditioner according to an embodiment of the present application.

According to some embodiments of the present application, referring to FIGS. 26 and 27, the deformation portion is configured as a shape of flat plate extending parallel to a length direction of the fixation member 1. For example, the deformation portion 121 may be configured as tabulate, and the tabulate deformation portion 121 may extend in the direction parallel to the longitudinal direction of the fixation member 1, and the longitudinal direction of the fixation member 1 may refer to the MN direction shown in FIG. 26 or 27. Therefore, not only the structure of the elastic buckle 12 may be simplified, but also the processing of the elastic buckle 12 may be facilitated.

The present application is not limited thereto. In some embodiments of the present application, the deformation portion 121 may also be configured to be of other shapes, such as a shape of curved plate, or the like. The specific structure of the deformation portion 121 may be adaptively disposed as needed.

According to some embodiments of the present application, as shown in FIGS. 25 and 26, the portion of the fixation member 1 which is provided with the escape hole 11 is configured as a mating portion 13. For example, the fixation member 1 may include the mating portion 13, the escape hole 11 may be formed on the mating portion 13, and the escape hole 11 may be configured as a through hole which passes through the mating portion 13 in the thickness direction. The fixation member 1 is provided with a protrusion 14 which is disposed at an outer wall surface of the deformation portion 121 at a position closer to a joint of the mating portion 13 and the elastic buckle 12 with respect to the snap portion 122. Therefore, with the protrusion 14, it is easy to realize that the snap portion 122 is in an inclined fit with or disengaged from at least one of the fitting buckles 21, thereby facilitates the adjustment of the seal length of the seal assembly 100.

Further, in combination with FIG. 26, a grip space 15 may be formed between the protrusion 14 and the deformation portion 121. Therefore, when the seal length of the seal assembly 100 is required to be adjusted, the user may put his or her hand into the grip space 15, and by pulling the protrusion 14 toward the M side, the snap portion 122 may be disengaged from the at least one of fitting buckles 21. When the seal length of the seal assembly 100 is adjusted to meet the requirement, the snap portion 122 is in an inclined fit with at least one of the fitting buckles 21, and optionally, a certain pressure may be applied to the deformation portion 121, such that it is advantageous to ensure that the relative positions of the fixation member 1 and the slide block 2 are fixed, thereby ensuring the sealing reliability of the seal assembly 100.

In some embodiments of the present application, when the snap portion 122 is in an inclined fit with the at least one of the fitting buckles 21, no pressure is applied to the deformation portion 121.

Optionally, referring to FIGS. 25 and 26, in the direction from inside to outside, the protrusion 14 may be configured to be curved toward the snap portion 122. Thus, with the protrusion 14, the snap portion 122 is facilitated to be disengaged from the at least one of fitting buckles 21, thereby facilitating the adjustment of the seal length of the seal assembly 100.

In some optional embodiments of the present application, the protrusion 14 may also have other shapes, such as a shape of flat plate. The protrusion 14 may be inclined outwards with respect to the horizontal plane where the deformation portion 121 is located, and the inclination angle may be set adaptively as needed.

Optionally, the elastic buckle 12 is pivotably connected with the mating portion 13. Therefore, by the elastic buckle 12 being pivotally connected with the mating portion 13, the snap portion 122 is easily in an inclined fit with or disengaged from the at least one of the fitting buckles 21, which is convenient in operation and labor-saving.

For example, in some embodiments of the present application, one of the elastic buckle 12 and the mating portion 13 may be provided with a rotating shaft portion, and the other of the elastic buckle 12 and the mating portion 13 may be provided with a rotating shaft hole. The rotating shaft hole is matched with the rotating shaft portion, such that the pivotal connection between the elastic buckle 12 and the mating portion 13 is easily realized.

Further, in combination with FIG. 26, a fulcrum 16 is formed at the joint of the mating portion 13 and the elastic buckle 12, and the elastic buckle 12 is pivotable around the fulcrum 16 to enable the snap portion 122 to be in an inclined fit with or disengaged from the fitting buckle 21. Therefore, the snap portion 122 is easily in an inclined fit with or disengaged from the fitting buckle 21, facilitating the operation of the user.

Further, as shown in FIG. 26, in the longitudinal direction of the fixation member 1, the protrusion 14 is provided at a midpoint position between the fulcrum 16 and the snap portion 122. For example, the longitudinal direction of the fixation member 1 may refer to the MN direction shown in FIG. 26, and the protrusion 14 may be provided at a midpoint position between the fulcrum 16 and the snap portion 122. Thus, for the seal assembly 100 of the same length, by providing the protrusion 14 at the midpoint position between the fulcrum 16 and the snap portion 122, the free movement stroke of the seal assembly 100 is increased, and the range of application is expanded.

In some embodiments of the present application, the protrusion 14 may also be disposed at other locations between the fulcrum 16 and the snap portion 122.

In some embodiments of the present application, the snap portion 122 may be configured as a toothed portion, and the slide block 2 may be formed thereon with a rack engaged with the toothed portion, and the fitting buckle 21 may be configured to be a toothed groove matched with the toothed portion.

For the seal assembly 100 of the window air conditioner according to the embodiment of the present application, the mold is easily open. The fulcrum 16 is provided at the leftmost side of the deformation portion 121 (for example, the M end of the deformation portion 121 shown in FIG. 26), and the snap portion 122 is provided at the rightmost side of the deformation portion 121 (for example, the N end of the deformation portion 121 shown in FIG. 26), and the protrusion 14 is provided in the middle of the deformation portion 121, such that the length of the rack may be taken full advantage.

Referring to FIGS. 25 and 26, according to some embodiments of the present application, the fixation member 1 is provided therein with a slide cavity 17, and at least a portion of the slide block 2 extends into the slide cavity 17, which facilitates the cooperation of the fixation member 1 and the slide block 2, and enables the slide block 2 to slide relative to the fixation member 1, thereby facilitating the adjustment of the seal length of the seal assembly 100.

The seal assembly 100 of the window air conditioner according to the embodiment of the present application has simple installation and is easy for the user to operate; with a one-way clutch, when the snap portion 122 is fitted with the fitting buckle 21, the structure remains fixed, to ensure the reliability of the seal assembly 100; the seal assembly 100 has a large stroke and is provided with the protrusion 14 (the grip space 15 is formed between the protrusion 14 and the deformation portion 121), and is easy to operate.

The window air conditioner 200 according to a third embodiment of the present application will be described briefly below with reference to FIGS. 30 to 38.

The window air conditioner 200 according to the embodiment of the present application is supported on the window 310 of the wall 300, and the window 310 is provided therein with the movable window sash 400. The window air conditioner 200 includes the housing 210 which is provided with the accommodation groove 211, at least a part of the window sash 400 is extendable into the accommodation groove 211, and the seal assembly 100 is in contact with the inner walls of the window sash 400 and the window 310 respectively.

As shown in FIGS. 30-34, the seal assembly 100 of the window air conditioner 200 according to the embodiment of the present application includes: the fixation member 1, the slide block 2 and the elastic latch member 7.

Specifically, as shown in FIGS. 30-34, the fixation member 1 is formed therein with the slide cavity 17, and is formed thereon with the escape hole 11 communicating with the slide cavity 17; at least a part of the slider 2 extends into the slide chamber 17, and the slider 2 is in a sliding fit with the fixation member 1, which facilitates the cooperation of the fixation member 1 and the slider 2, and enables the slider 2 to slide relative to the fixation member 1.

Figure 32:
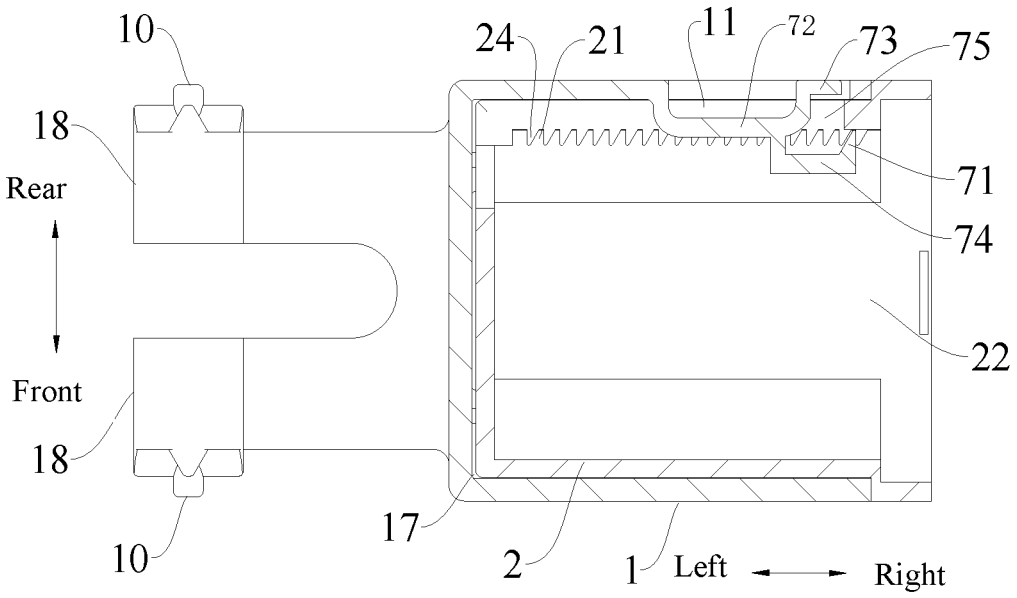
FIG. 32 is a cross-sectional view of the seal assembly shown in FIG. 30.

The slider 2 is formed thereon with a plurality of fitting buckles 21 arranged at intervals in the sliding direction of the slider 2 (for example, the left-right direction shown in FIG. 32). The elastic latch member 7 is deformably disposed at the escape hole 11, and is provided with a first lock buckle 71 which is configured to engage with or disengage from at least one of the plurality of fitting buckles 21. When the elastic latch member 7 is pressed toward the slide cavity 17, the elastic latch member 7 is deformed to disengage the first lock buckle 71 from the fitting buckle 21. Specifically, when the elastic latch member 7 does not move (the elastic latch member 7 is not pressed), the first lock buckle 71 cooperates with the fitting buckle 21 to lock the slider 2, and at this point, the slider 2 is fixed relative to the fixation member 1, and the slider 2 fails to slide relative to the fixation member 1; when the elastic latch member 7 is pressed toward the slide cavity 17, the elastic latch member 7 is deformed to drive the first lock buckle 71 to move, such that the first lock buckle 71 is disengaged from the fitting buckle 21, and at this point, the slider 2 may slide relative to the fixation member 1, thereby adjusting the length of the seal assembly 100.

It should be noted that the elastic latch member 7 is characterized by elastic deformation, which may be made of an elastic material, for example, plastic, rubber, or the like. The elastic latch member 7 may also be made of a non-elastic material and manufactured by a specific process to be elastically deformed.

Further, the accommodation groove 211 is open at the top. That is, the accommodation groove 211 is recessed downwards from the top wall of the housing 210. Compared with the related art in which the accommodation groove is recessed upwards from a bottom wall of the housing, the window air conditioner 200 receives force more uniformly, the top wall of the window air conditioner 200 is prevented from being damaged due to a relatively large force, the setting reliability and working performance of the window air conditioner 200 are improved, and an air outlet of the window air conditioner 200 may be provided at a higher position, which facilitates the flow of airflow blown out of the air outlet in the indoor space, easily improves the temperature adjustment efficiency of the window air conditioner 200, and enhances the effect of adjusting indoor temperatures by the window air conditioner 200 with ease.

In the seal assembly 100 for the window air conditioner 200 according to the embodiment of the present application, the fixation member 1 and the slider 2 which are movable relative to each other are provided, which not only mounts the seal assembly 100 on the window air conditioner 200 by the fixation member 1, facilitates the arrangement of the seal assembly 100, and avoids the loss of the seal assembly 100, but also adjusts the length of the seal assembly 100 by the sliding fit between the slider 2 and the fixation member 1, thereby sealing window sashes 400 of different sizes by the seal assembly 100, improving the sealing effect of the seal assembly 100, extending the range of use of the seal assembly 100 and the range of application of the window air conditioner 200, and improving the functionality and applicability of the window air conditioner 200.

Meanwhile, in the seal assembly 100 for the window air conditioner 200 according to the embodiment of the present application, by providing the elastic latch member 7 and providing the first lock buckle 71 for locking the slider 2 on the elastic latch member 7, the slider 2 may be switched between the unlocked state and the locked state by pressing the elastic latch member 7 toward the interior of the slide cavity 17, thereby facilitating the adjustment of the relative position between the slider 2 and the fixation member 1. The length of the seal assembly 100 is adjusted with ease and conveniently. In addition, the arrangement of the elastic latch member 7 may also enable more elegant appearance of the seal assembly 100.

Therefore, the seal assembly 100 of the window air conditioner 200 according to the embodiment of the present application has the advantages of the variable seal length, simple operations, convenient use, element appearance, or the like.

In one embodiment of the present application, as shown in FIG. 32, the slider 2 may slide toward a direction of extending out of or retracting into the slide cavity 17 when the first lock buckle 71 is disengaged from the fitting buckle 21, and the slider 2 may only slide toward a direction extending out of the slide cavity 17 when the first lock buckle 71 engages with the fitting buckle 21. In this way, when the elastic latch member 7 is not pressed, the slider 2 may only slide in a direction extending out of the slide cavity 17. That is, when the elastic latch member 7 is not pressed, the overall length of the fixation member 1 and the slider 2 may only be increased, instead of being shortened, thereby ensuring the sealing performance of the seal assembly 100.

Figure 33:
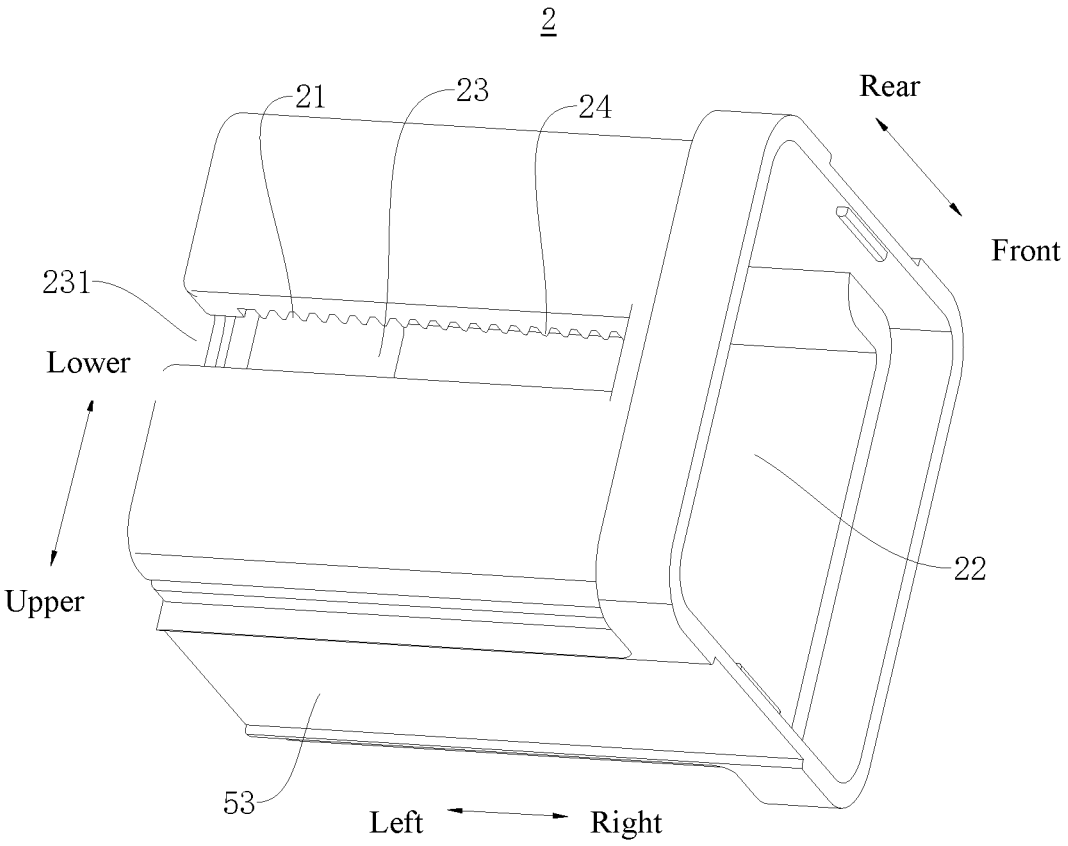
FIG. 33 is a schematic view of a slider shown in FIG. 30.
Figure 34:
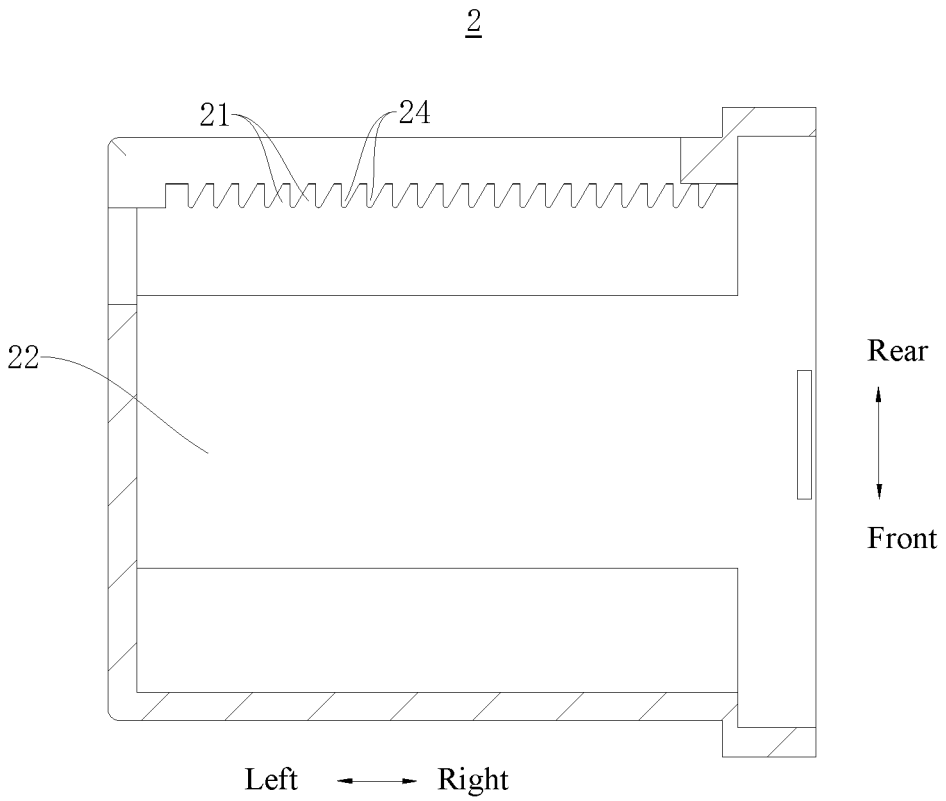
FIG. 34 is a cross-sectional view of the slider shown in FIG. 33.
Figure 35:
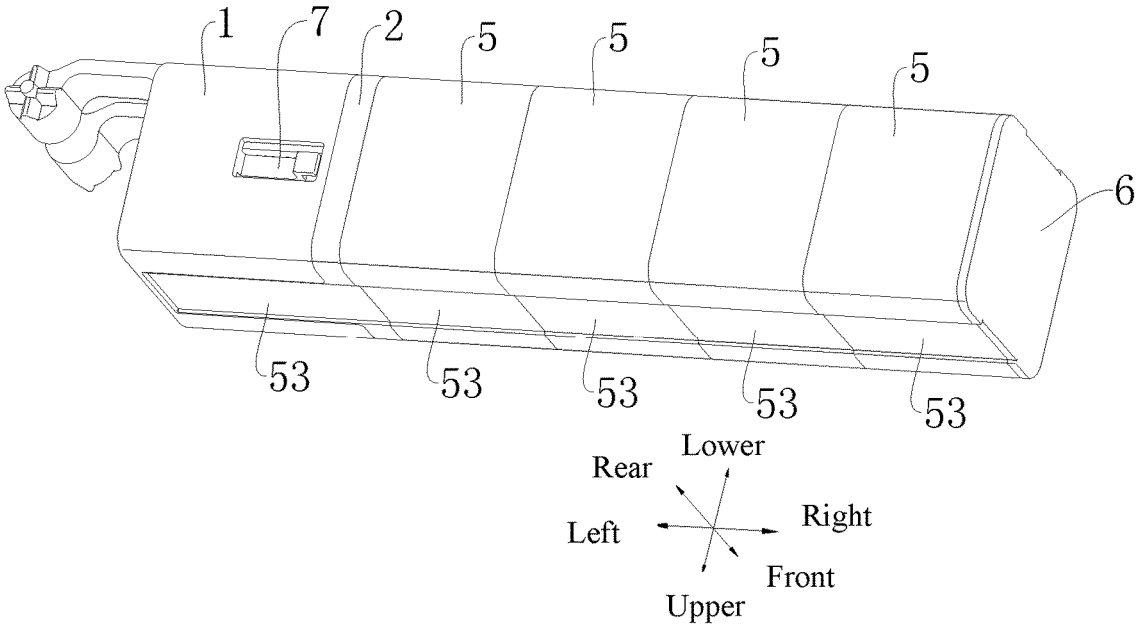
FIG. 35 is a perspective view of the seal assembly for the window air conditioner according to an embodiment of the present application.
Figure 36:
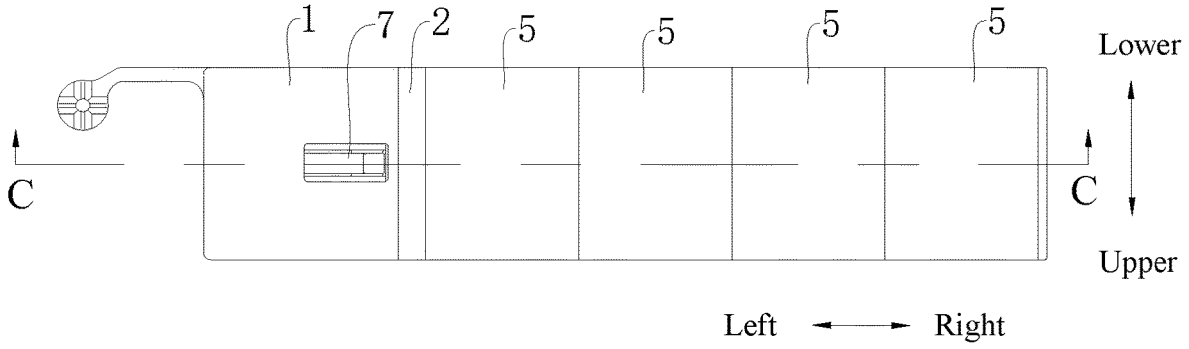
FIG. 36 is a schematic view of the seal assembly shown in FIG. 35 from another angle.
Figure 37:
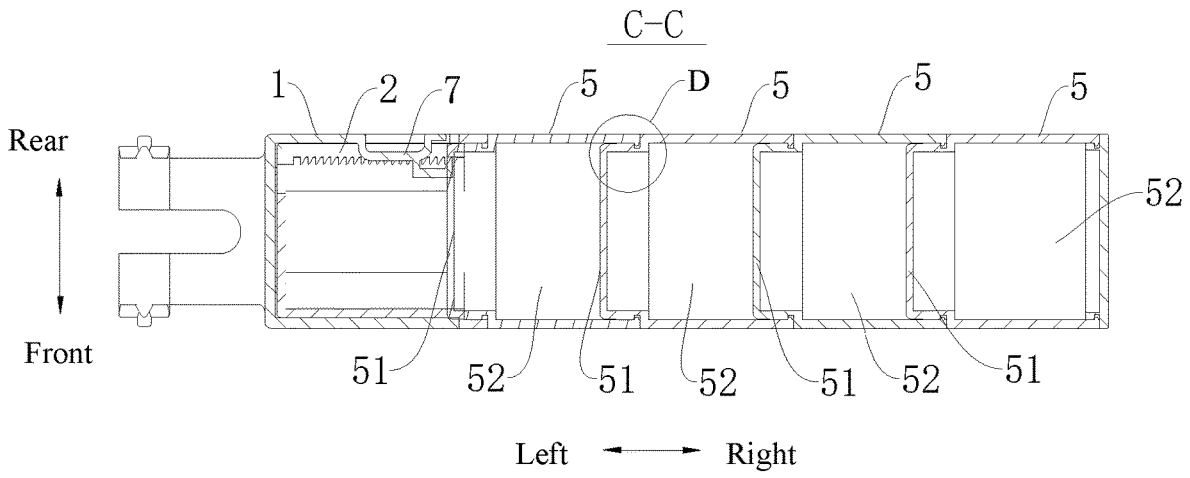
FIG. 37 is a cross-sectional view of the seal assembly shown in FIG. 36 taken along line C-C.
Figure 38:
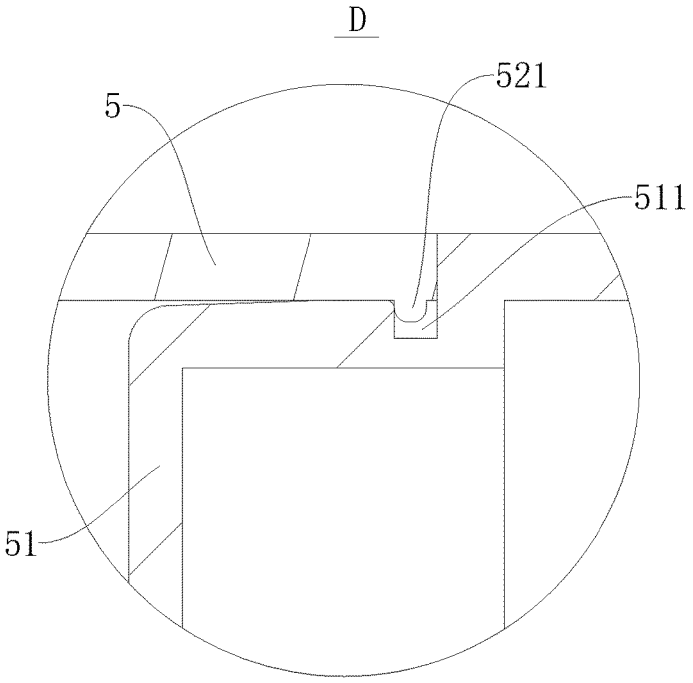
FIG. 38 is an enlarged view of a circled structure at the portion Din FIG. 37.

In some embodiments of the present application, as shown in FIGS. 32-34, the slider 2 has a mating cavity 22 therein, and the plurality of the fitting buckles 21 are formed on a peripheral wall of the mating cavity 22, and the first lock buckle 71 extends into the mating cavity 22 to engage with at least one of the fitting buckles 21. By providing the mating cavity 22, the first lock buckle 71 may not only engage with the fitting buckle 21 in the mating cavity 22, but also when the first lock buckle 71 disengages from the fitting buckle 21, the first lock buckle 71 may be moved toward the interior of the mating cavity 22 to be disengaged from the fitting buckle 21, such that the first lock buckle 71 does not interfere with the fitting buckle 21 or other parts of the slider 2, ensuring the smooth sliding of the slider 2.

In some examples, as shown in FIG. 33, the slider 2 may be formed with an opening 23 communicating with the mating cavity 22, the opening 23 extends along the sliding direction of the slider 2 (e.g., the left-right direction shown in FIG. 33), the plurality of fitting buckles 21 are formed on at least one side of the opening 23 in the width direction (for example, the vertical direction shown in FIG. 33). That is, the fitting buckle 21 may be formed on one side of the opening 23 in the width direction (for example, the upper side or the lower side of the opening 23 shown in FIG. 33), or the fitting buckle 21 is formed on both the upper and lower sides of the opening 23. By providing the opening 23, the first lock buckle 71 is easily extendable into the mating cavity 22, thereby ensuring that the first lock buckle 71 may smoothly cooperate with the fitting buckle 21, without affecting the normal sliding of the slider 2 when the first lock buckle 71 is disengaged from the fitting buckle 21.

Further, the elastic latch member 7 includes a first cantilever segment 72, a pressing portion 73 and a latch portion 74. One end of the first cantilever segment 72 is connected to the inner peripheral wall of the escape hole 11, and the pressing portion 73 and the latch portion 74 are both provided at the other end of the first cantilever segment. As shown in FIG. 32, the first cantilever segment 72 has a shape of cantilever extending in the left-right direction, the left end of the first cantilever segment 72 is connected with the left wall of the escape hole 11, and the pressing portion 73 and the latch portion 74 are both disposed at the right end of the first cantilever segment 72. The first lock buckle 71 is disposed at the latch portion 74, the first cantilever segment 72 is in a sliding fit in the opening 23, the pressing portion 73 is located outside the mating cavity 22, and the latch portion 74 extends into the mating cavity 22, such that the first lock buckle 71 may cooperate with the fitting buckle 21. The overall elasticity of the elastic latch member 7 may be improved by providing the first cantilever segment 72. The pressing portion 73 is configured for the user to control. That is, the user presses the pressing portion 73 toward the interior of the slide cavity 17, which may elastically deform the elastic latch member 7, such that the first lock buckle 71 is disengaged from the fitting buckle 21, and it is convenient for the user to press the pressing portion 73 by locating the pressing portion 73 outside the mating cavity 22.

Further, as shown in FIG. 33, a fitting notch 231 is arranged at the periphery of the opening 23. Specifically, as shown in FIG. 33, the fitting notch 231 is provided at the left end of the opening 23, and the first cantilever segment 72 is fitted into the opening 23 from the fitting notch 231. By providing the fitting notch 231, the elastic latch member 7 may be easily fitted with the opening 23.

Further, at least a part of an orthographic projection of the first lock buckle 71 in a reference plane is located outside the orthographic projection of the opening 23 in the reference plane, and the reference plane is a plane perpendicular to the axis of the opening 23, thereby ensuring the cooperation between the first lock buckle 71 and the fitting buckle 21 provided at the inner peripheral wall of the mating cavity 22. Optionally, the width of the first lock buckle 71 is greater than the width of the opening 23.

Further, as shown in FIG. 32, an elastic groove 75 is formed between the pressing portion 73 and the latch portion 74, and by forming the elastic groove 75 between the pressing portion 73 and latch portion 74, the overall elasticity of the elastic latch member 7 may be enhanced.

In some embodiments of the present application, as shown in FIGS. 32-34, the slider 2 is provided with a plurality of mating teeth 24 which are spaced apart in the sliding direction (e.g., the left-right direction shown in FIGS. 32-34), the fitting buckle 21 is configured as a mating groove formed between two adjacent mating teeth 24, and the first lock buckle 71 is adapted to be snapped into the mating groove to realize the cooperation between the first lock buckle 71 and the fitting buckle 21. When the first lock buckle 71 is disengaged from the mating groove, the first lock buckle 71 is disengaged from the fitting buckle 21, realizing simple structures and convenient locking.

In one embodiment of the present application, the elastic latch member 7 and the fixation member 1 are integrally formed. That is, the elastic latch member 7 and the fixation member 1 are integrally manufactured, which not only improves the connection strength between the elastic latch member 7 and the fixation member 1, but also eliminates the assembly process between the elastic latch member 7 and the fixation member 1.

Optionally, the inner wall of the slide cavity 17 is provided with a slide rib, and the outer wall of the slider 2 is provided with a sliding groove fitted with the slide rib, which may position and guide the sliding of the slider 2 by the slide rib and the sliding groove, further facilitates the smooth sliding of the slider 2, improves the structural strength of the seal assembly 100, and further improves the structural reliability and stability of the seal assembly 100.

The window air conditioner 200 according to a fourth embodiment of the present application will be described briefly below with reference to FIGS. 39 to 41.

Figure 39:
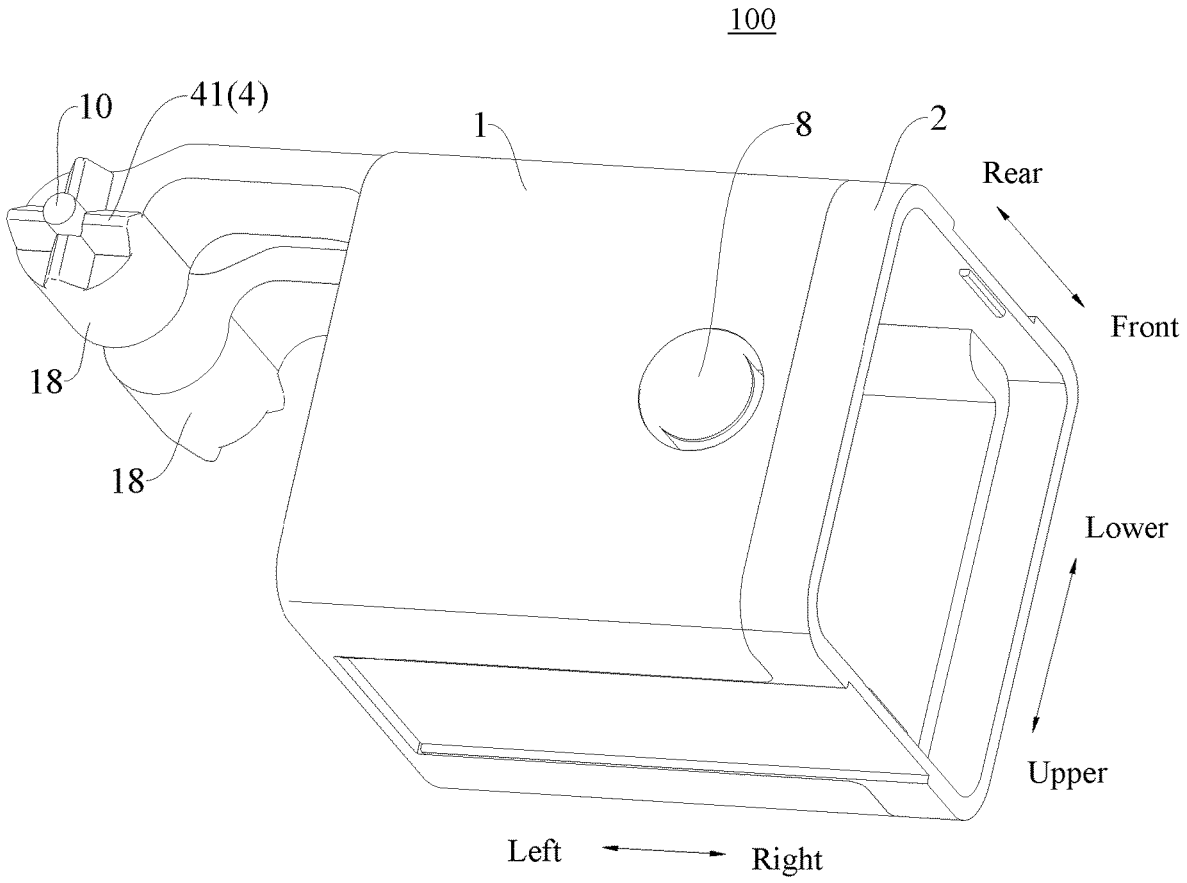
FIG. 39 is a schematic view of the seal assembly for the window air conditioner according to an embodiment of the present application.
Figure 41:
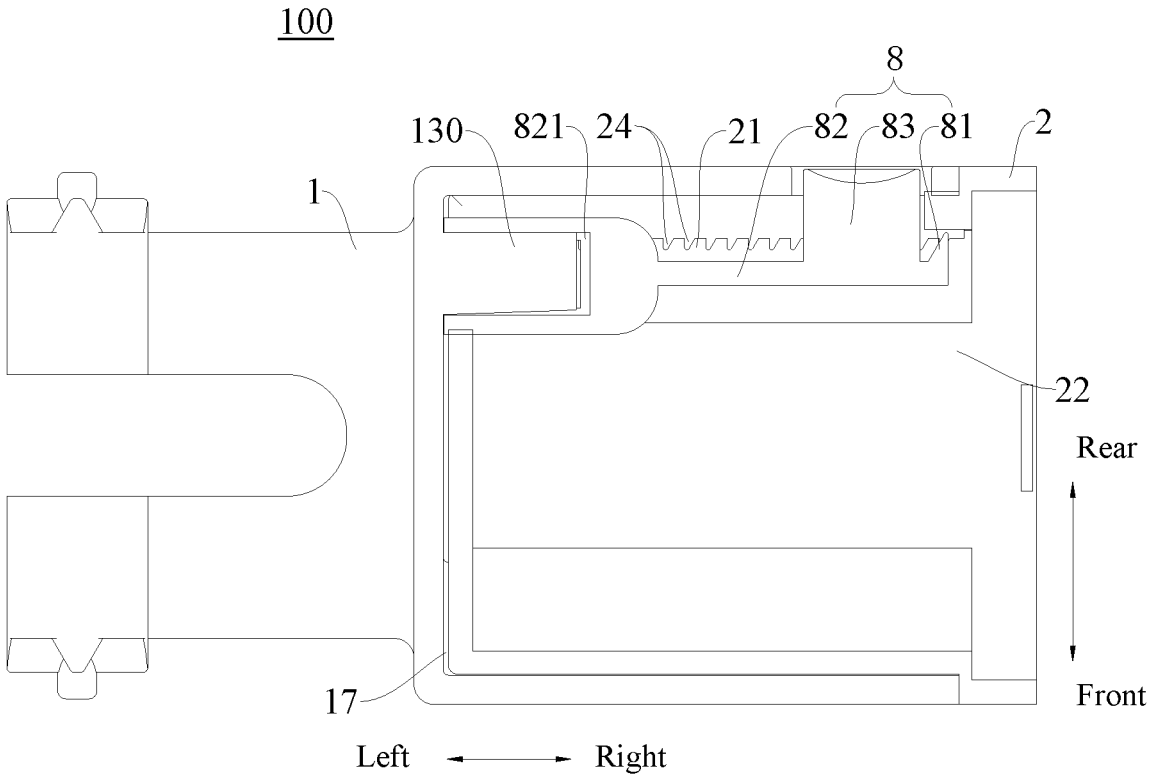
FIG. 41 is a cross-sectional view of the seal assembly shown in FIG. 39.

As shown in FIGS. 39 and 41, the seal assembly 100 for the window air conditioner 200 according to the embodiment of the present application includes the fixation member 1, the slide block 2 and the press button 8.

Specifically, as shown in FIG. 41, the fixation member 1 is formed therein with the slide cavity 17, and is formed thereon with the escape hole 11 communicating with the slide cavity 17; at least a part of the slider 2 extends into the slide chamber 17, and the slider 2 is in a sliding fit with the fixation member 1, which facilitates the cooperation of the fixation member 1 and the slider 2, and enables the slider 2 to slide relative to the fixation member 1.

The slider 2 is formed thereon with a plurality of fitting buckles 21 arranged at intervals in the sliding direction of the slider 2 (for example, the left-right direction shown in FIG. 41). The press button 8 is pressably disposed at the escape hole 11, and is provided with the second lock buckle 81 which is configured to engage with or disengage from at least one of the plurality of fitting buckles 21. That is, when the press button 8 is pressed, the press button 8 may drive the second lock buckle 81 to move, such that the second lock buckle 81 engages with or disengages from the fitting buckle 21. For example, when the press button 8 does not move (the press button 8 is not pressed), the second lock buckle 81 cooperates with the fitting buckle 21 to lock the slider 2, and at this point, the slider 2 is fixed relative to the fixation member 1, and the slider 2 fails to slide relative to the fixation member 1; when the press button 8 is pressed by the user, the second lock buckle 81 is disengaged from the fitting buckle 21. At this point, the slider 2 may slide relative to the fixation member 1, thereby adjusting the length of the seal assembly 100. Certainly, the present application is not limited thereto. The press button 8 may further be configured such that the second lock buckle 81 engages with the fitting buckle 21 to performing locking when the press button 8 is pressed for the first time, the second lock buckle 81 is disengaged from the fitting buckle 21 when the press button 8 is pressed for the second time, the locking is realized again when the press button 8 is pressed for the third time, the disengagement is realized again when the press button 8 is pressed for the fourth time, and so on.

In the seal assembly 100 for the window air conditioner 200 according to the embodiment of the present application, the fixation member 1 and the slider 2 which are movable relative to each other are provided, which not only mounts the seal assembly 100 on the window air conditioner 200 by the fixation member 1, facilitates the arrangement of the seal assembly 100, and avoids the loss of the seal assembly 100, but also adjusts the length of the seal assembly 100 by the sliding fit between the slider 2 and the fixation member 1, thereby sealing the window sash 400 of different sizes by the seal assembly 100, improving the sealing effect of the seal assembly 100, extending the range of use of the seal assembly 100 and the range of application of the window air conditioner 200, and improving the functionality and applicability of the window air conditioner 200.

Meanwhile, in the seal assembly 100 for the window air conditioner 200 according to the embodiment of the present application, by providing the press button 8 and providing the second lock buckle 81 for locking the slide block 2 on the press button 8, the slide block 2 may be switched between the unlocked state and the locked state by pressing the press button 8, thereby facilitating the adjustment of the relative position between the slide block 2 and the fixation member 1. The length of the seal assembly 100 is adjusted with ease and conveniently. In addition, the arrangement of the press button 8 may also enable more elegant appearance of the seal assembly 100.

Therefore, the seal assembly 100 of the window air conditioner 200 according to the embodiment of the present application has the advantages of the variable seal length, simple operations, convenient use, element appearance, or the like.

In one embodiment of the present application, referring to FIG. 41, the press button 8 is switchable between the pressed state and the reset state, and when the press button 8 is in the pressed state, the second lock buckle 81 is disengaged from the fitting buckle 21, and when the press button 8 is in the reset state, the second lock buckle 81 engages with the fitting buckle 21 to lock the slide block 2. Herein, it should be noted that the pressed state of the press button 8 may be realized by the user pressing the press button 8; the reset state of the press button 8 may be realized by pressing the press button 8 again, or by a driving mechanism for resetting, or by the press button 8 with the function of automatic reset. For example, when the user releases the press button 8, the press button 8 may be reset automatically.

In some embodiments of the present application, as shown in FIGS. 41 and 33, the slide block 2 has a mating cavity 22 therein, and the plurality of the fitting buckles 21 are formed on a peripheral wall of the mating cavity 22, and the second lock buckle 81 extends into the mating cavity 22 to engage with at least one of the fitting buckles 21. By providing the mating cavity 22, the second lock buckle 81 may not only engage with the fitting buckle 21 in the mating cavity 22, but also when the second lock buckle 81 is disengaged from the fitting buckle 21, the second lock buckle 81 may be moved toward the interior of the mating cavity 22 to be disengaged from the fitting buckle 21, such that the second lock buckle 81 does not interfere with the fitting buckle 21 or other parts of the slider 2, ensuring the smooth sliding of the slider block 2.

In some examples, as shown in FIG. 33, the slide block 2 may be formed with an opening 23 communicating with the mating cavity 22, the opening 23 extends along the sliding direction of the slide block 2 (e.g., the left-right direction shown in FIG. 33), the plurality of fitting buckles 21 are formed on at least one side of the opening 23 in the width direction (for example, the vertical direction shown in FIG. 33). That is, the fitting buckle 21 may be formed on one side of the opening 23 in the width direction (for example, the upper side or the lower side of the opening 23 shown in FIG. 33), or the fitting buckle 21 is formed on both the upper and lower sides of the opening 23. By providing the opening 23, the second lock buckle 81 is easily extendable into the mating cavity 22, or the press button body 83 connected with the second lock buckle 81 is easily extendable out of the mating cavity 22, thereby ensuring that the second lock buckle 81 may smoothly cooperate with the fitting buckle 21, without affecting the normal sliding of the slide block 2 when the second lock buckle 81 is disengaged from the fitting buckle 21.

Figure 40:
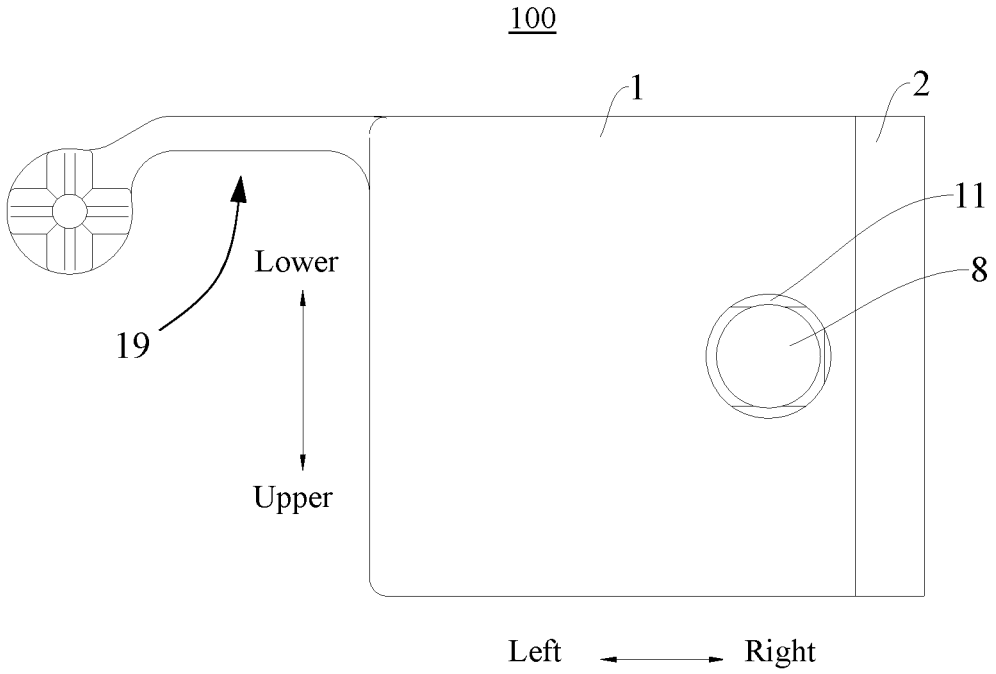
FIG. 40 is a schematic view of the seal assembly shown in FIG. 39 from another angle.

Further, referring to FIG. 33 in combination with FIG. 40, in the width direction of the opening 23 (for example, the vertical direction shown in FIG. 33), the size of the second lock buckle 81 is greater than the size of the opening 23. Therefore, it is possible to ensure that the second lock buckle 81 engages with the fitting buckles 21 on both sides of the opening 23 in the width direction to normally lock the slide block 2.

In some embodiments of the present application, as shown in FIG. 41, the press button 8 may include: a second cantilever segment 82 and a press button body 83, wherein the second cantilever segment 82 has a shape of cantilever extending in the left-right direction, one end of the second cantilever segment 82 (for example, the left end of the second cantilever segment 82 shown in FIG. 41) is connected with the inner wall of the slide cavity 17 (e.g., the left wall of the slide cavity 17 shown in FIG. 41), the second lock buckle 81 is provided at the second cantilever segment 82 and the second locking lock position 81 is spaced apart from the one end of the second cantilever segment 82 (e.g., the left end of the second cantilever segment 82 shown in FIG. 41).

The press button body 83 is connected with the second cantilever segment 82 and spaced apart from the one end of the second cantilever segment 82 (e.g., the left end of the second cantilever segment 82 shown in FIG. 41), the press button body 83 extends perpendicular to the second cantilever segment 82, and at least a portion of the press button body 83 extends into the escape hole 11. For example, as shown in FIG. 41, the press button body 83 extends in the rearward direction into the escape hole 11 and, in some embodiments, when the press button 8 is in the reset state, an end face at the free end of the press button body 83 is substantially flush with the outer surface of the fixation member 1.

Optionally, the press button body 83 may have a circular cross section, and the gap between the press button and the escape hole 11 may be reduced to further beautify the appearance.

Further, as shown in FIG. 41, the second lock buckle 81 and the press button body 83 are both located at a free end of the second cantilever segment 82, and the second lock buckle 81 is located at one side of the one end of the press button body 83 away from the second cantilever segment 82 (for example, the right side of the press button body 83 shown in FIG. 41). In combination with FIG. 41, since the second cantilever segment 82 has a shape of cantilever with the left end fixed the extending rightwards, the press button body 83 is provided at the free end of the second cantilever segment 82 (right end). When the press button body 83 is pressed, the second cantilever segment 82 is elastically deformed, such that the press button body 83 may move forwards, thereby driving the second lock buckle 81 to move forwards to disengage from the fitting buckle 21; when the press button body 83 is released, the second cantilever segment 82 recovers from the elastic deformation to drive the press button body 83 to return to the position before the press button is pressed, i.e., the press button 8 is switched to the reset state. Therefore, the structure is simple, and it is convenient to implement the pressing and automatic reset function of the press button body 83.

In some examples, the press button 8 may be integrally formed with the fixation member 1. In some embodiments, the press button 8 and the fixation member 1 may also be separately arranged. For example, the press button 8 may be detachably connected with the fixation member 1. Specifically, the second cantilever segment 82 of the press button 8 is detachably connected with the fixation member 1. as shown in FIG. 41, one of the second cantilever segment 82 and the fixation member 1 is provided with a connection hole 821, and the other of the second cantilever segment 82 and the fixation member 1 is formed thereon with a connection post 130 adapted to be inserted into the connection hole 821. That is, one of the second cantilever segment 82 and the fixation member 1 has the connection hole 821, and the other has the connection post 130. The second cantilever segment 82 is fixedly connected with the fixation member 1 by inserting the connection post 130 into the connection hole 821, thereby realizing fixed connection between the press button 8 and the fixation member 1. Therefore, the assembly between the press button 8 and the fixation member 1 may be realized conveniently, the assembly efficiency is improved, and the press button 8 is conveniently exchanged when damaged.

Figure 5:
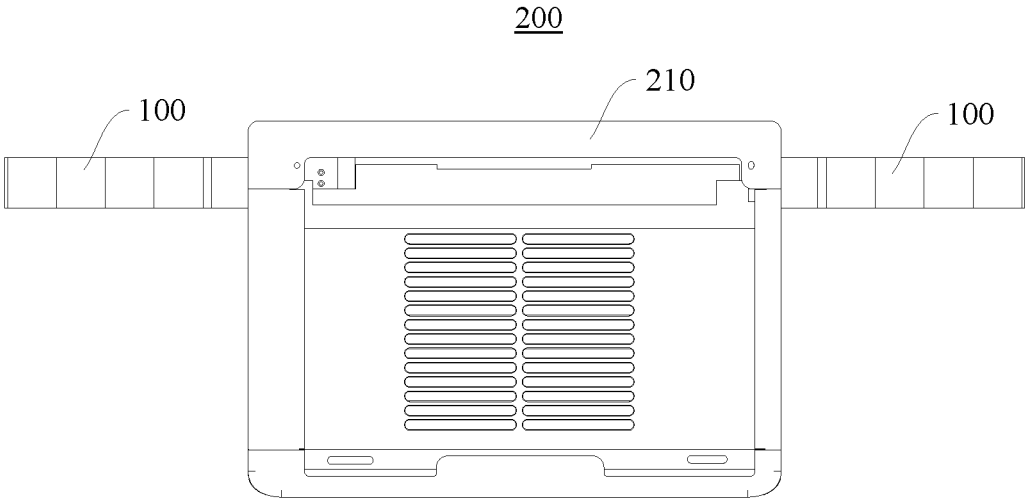
FIG. 5 is a schematic structural view of a window air conditioner according to an embodiment of the present application.
Figure 6:
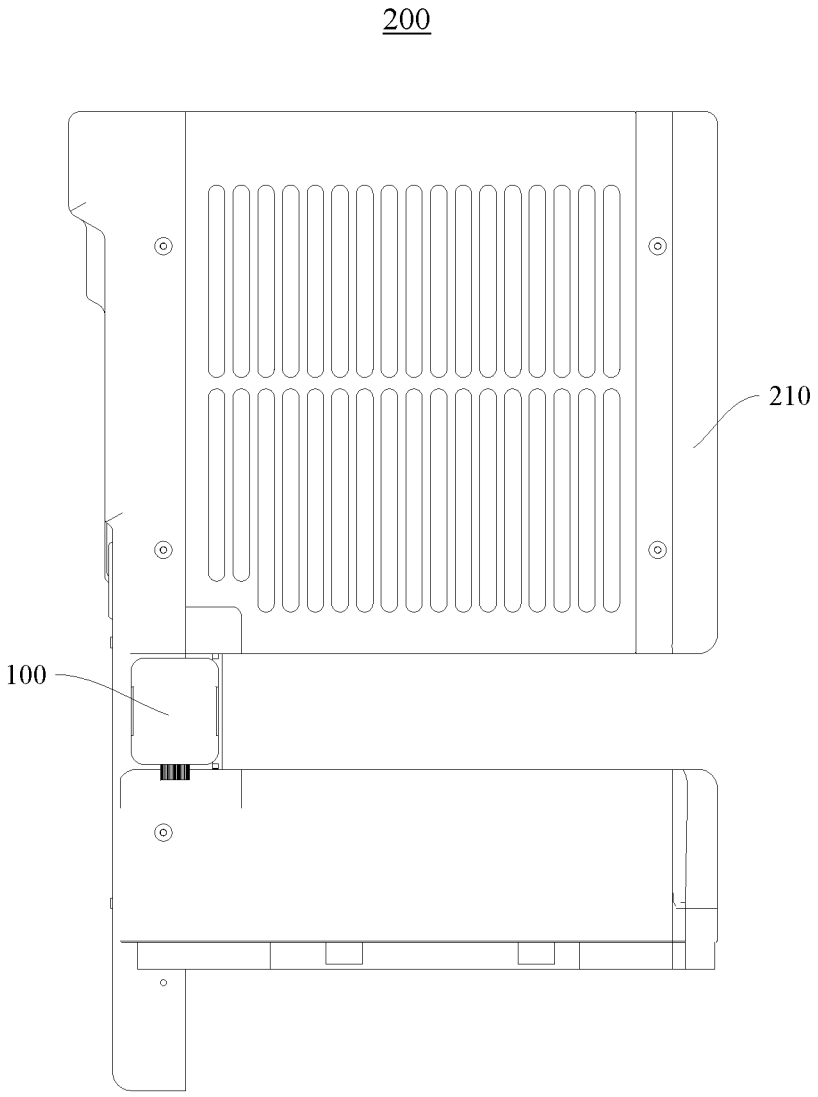
FIG. 6 is a schematic structural view of a window air conditioner according to an embodiment of the present application.
Figure 7:
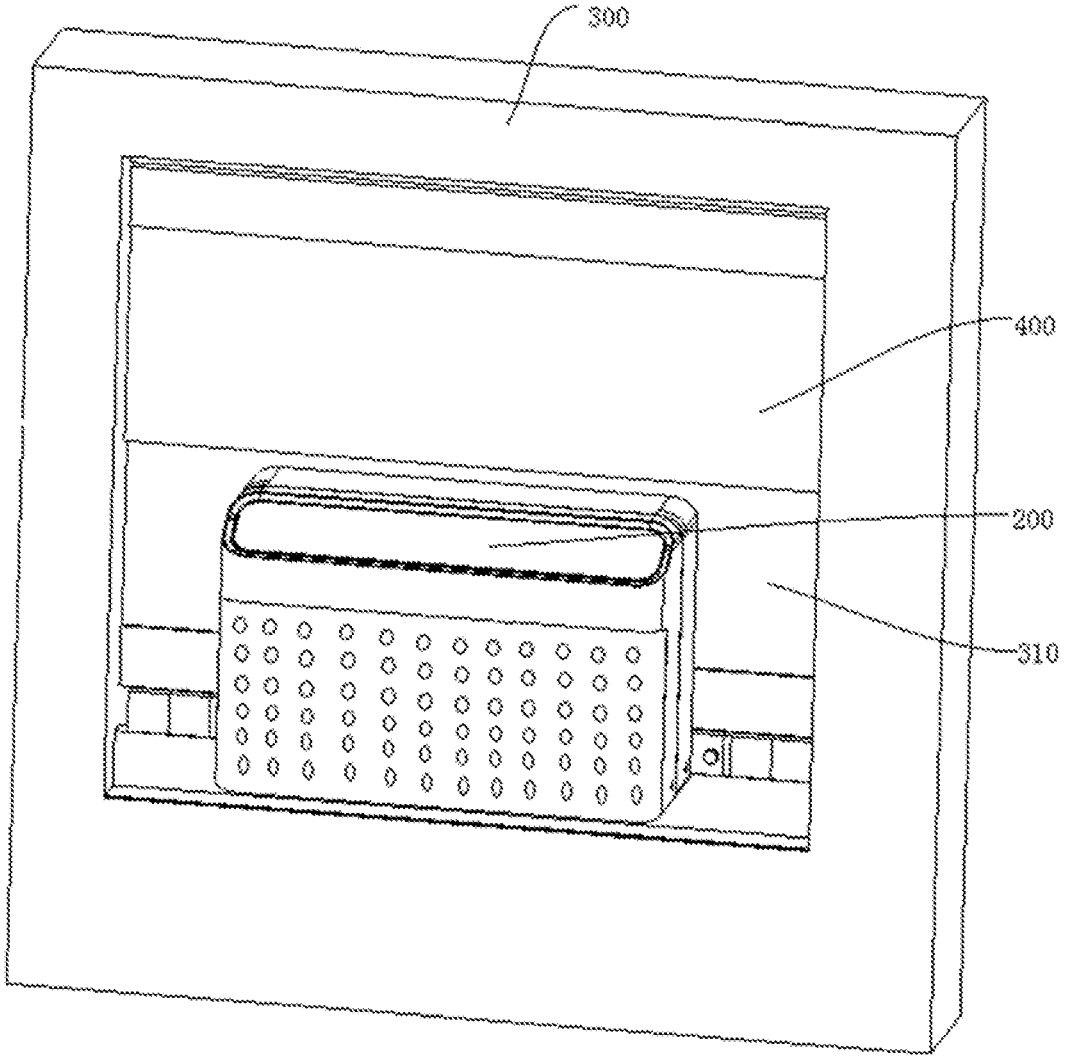
FIG. 7 is a schematic structural view of a window air conditioner according to an embodiment of the present application.
Figure 8:
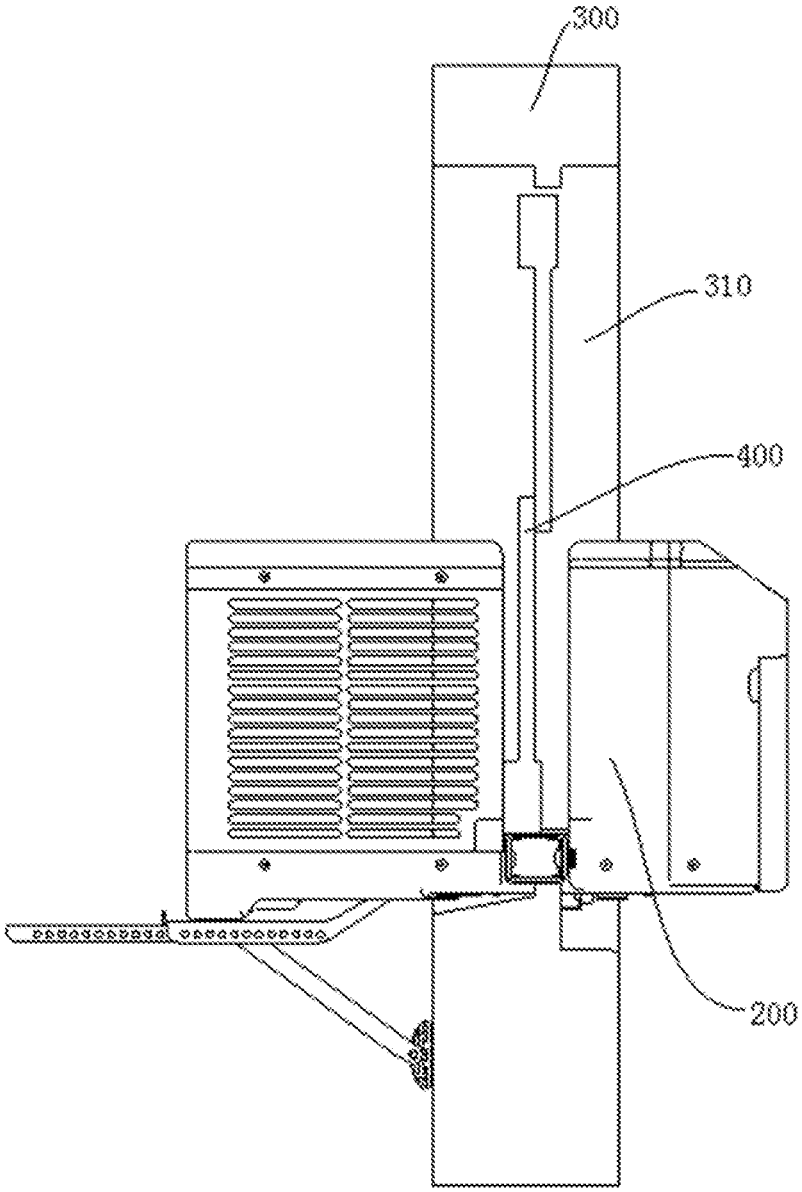
FIG. 8 is a schematic structural view of a window air conditioner according to an embodiment of the present application.

In some embodiments of the present application, as shown in FIGS. 41 and 5, the slide block 2 is provided with a plurality of mating teeth 24 which are spaced apart in the sliding direction (e.g., the left-right direction shown in FIG. 34), the fitting buckle 21 is configured as a mating groove formed between two adjacent mating teeth 24, and the second lock buckle 81 is adapted to be snapped into the mating groove to realize the cooperation between the second lock buckle 81 and the fitting buckle 21. When the second lock buckle 81 is disengaged from the mating groove, the second lock buckle 81 is disengaged from the fitting buckle 21, realizing simple structures and convenient locking.

Optionally, the inner wall of the slide cavity 17 is provided with a slide rib, and the outer wall of the slide block 2 is provided with a sliding groove fitted with the slide rib, which may position and guide the sliding of the slide block 2 by the slide rib and the sliding groove, further facilitates the smooth sliding of the slide block 2, improves the structural strength of the seal assembly 100, and further improves the sliding accuracy and reliability of the seal assembly 100.

The window air conditioner 200 according to the embodiment of the present application will be described below with reference to FIGS. 42 to 52.

Figure 42:
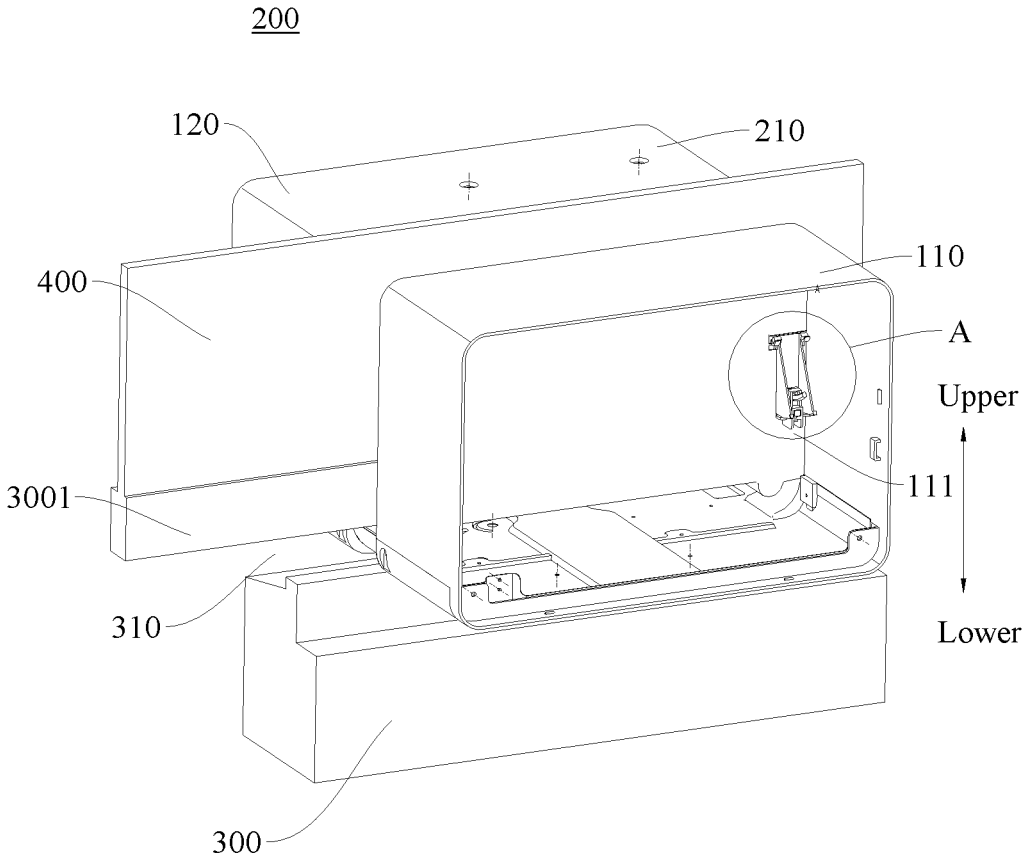
FIG. 42 is a schematic structural diagram of the window air conditioner according to some embodiments of the present application, in which a positioning device is in an unlocked state.

As shown in FIG. 42, the window air conditioner 200 according to the embodiment of the present application may include a housing 210 and a positioning device 9, wherein the housing 210 includes an outdoor portion 110 and indoor portion 120 which are spaced apart to form the accommodation groove 211, and the window sash 400 is adapted to be placed into the accommodation groove 211.

It is understood that when the window air conditioner 200 is mounted to the window 310, indoor portion 120 and the outdoor portion 110 are spaced apart by the window sash 400. After the window sash 400 is placed into the accommodation groove 211, the window sash 400 fixes the window air conditioner 200 to some extent, thereby improving the stability of the window air conditioner 200 at the window 310. At the same time, in the width direction of the window 310, the window sash 400 extends from the accommodation groove 211 to the side wall of the window 310, thereby effectively increasing the light transmissive area of the window air conditioner 200, such that the lighting effect of the window sash 400 is good, and at the same time, the window sash 400 may be beautified to a certain extent to enhance the user experience.

Figure 45:
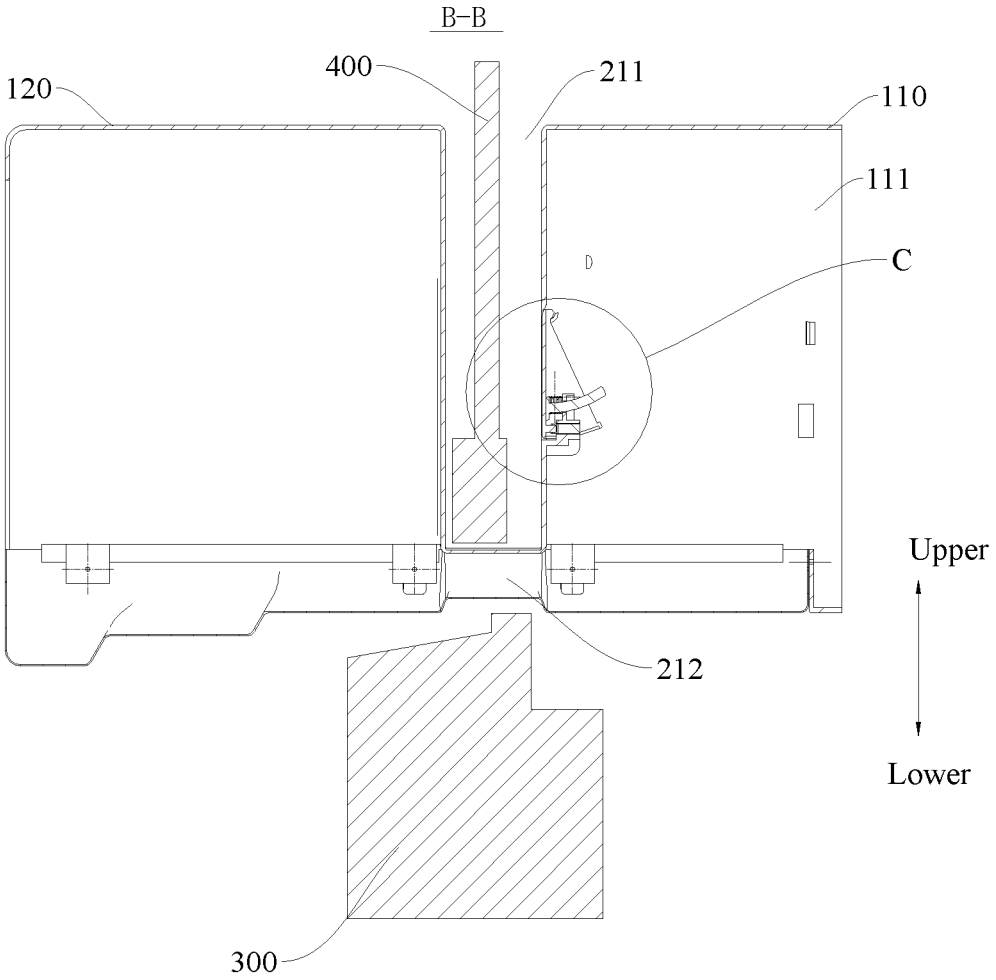
FIG. 45 is a schematic cross-sectional view of the portion B-B in FIG. 44.

For example, referring to FIG. 45, the housing 210 further includes a chassis 212, the outdoor portion 110 includes an outdoor heat exchanger, the indoor portion 120 has an indoor heat exchanger, and the chassis 212 is adapted to be supported on the window 310 and is connected with the outdoor portion 110 and the indoor portion 120 respectively to ensure that the indoor portion 120 is communicated with the outdoor portion 110, thereby the outdoor portion 110 and the indoor portion 120 acting together to implement cooling and heating.

Figure 43:
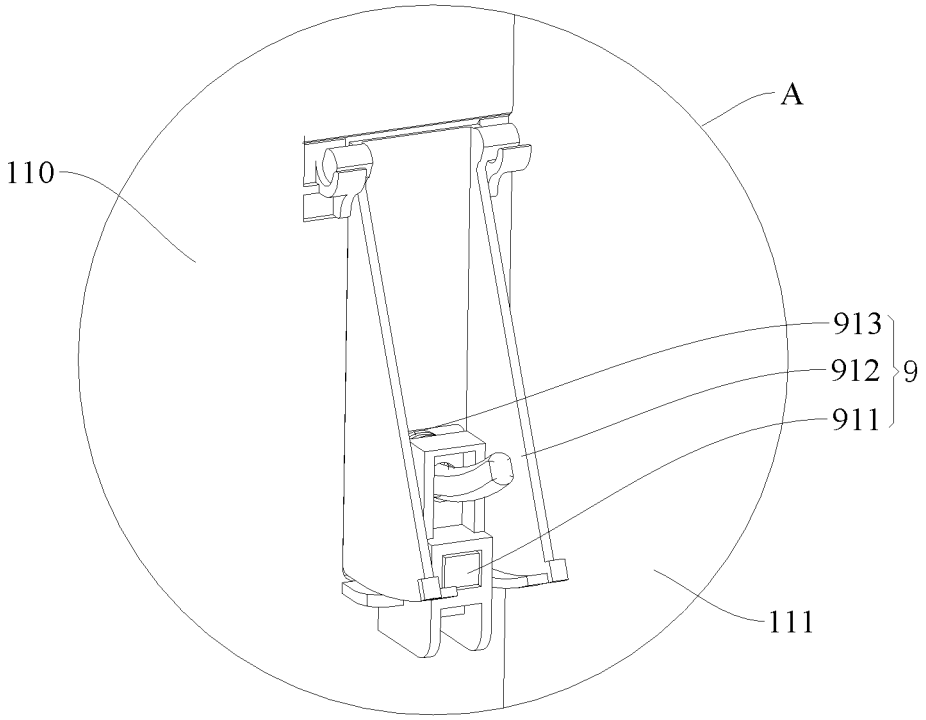
FIG. 43 is a schematic local enlarged view of the portion A in FIG. 42.
Figure 44:
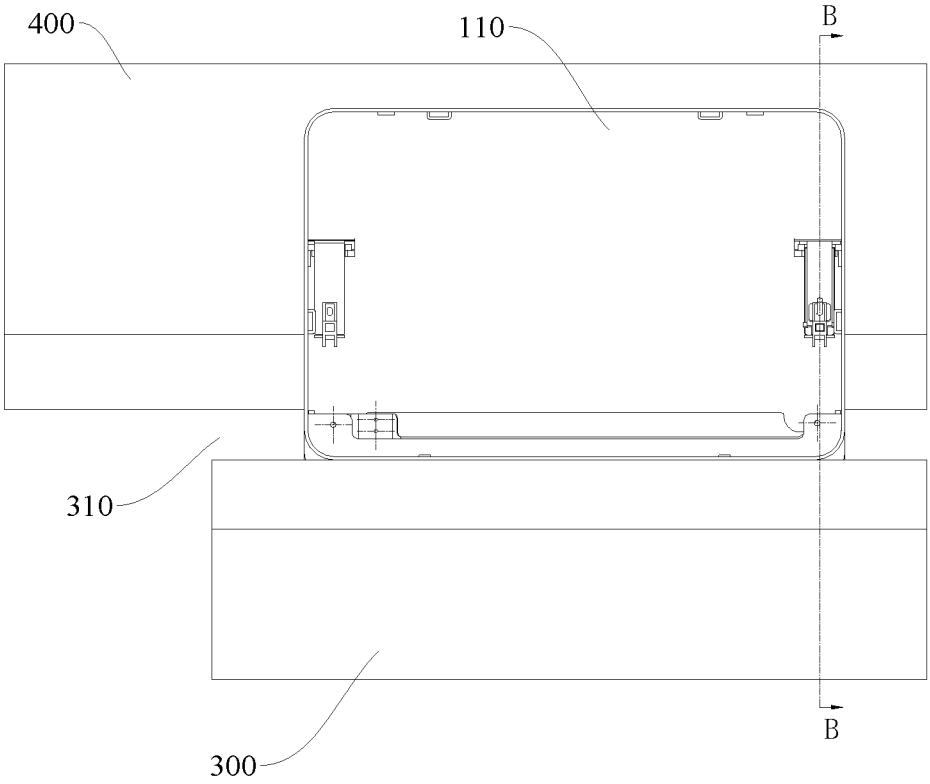
FIG. 44 is a schematic plane structural diagram of the window air conditioner according to some embodiments of the present application, in which the positioning device is in an unlocked state.
Figure 48:
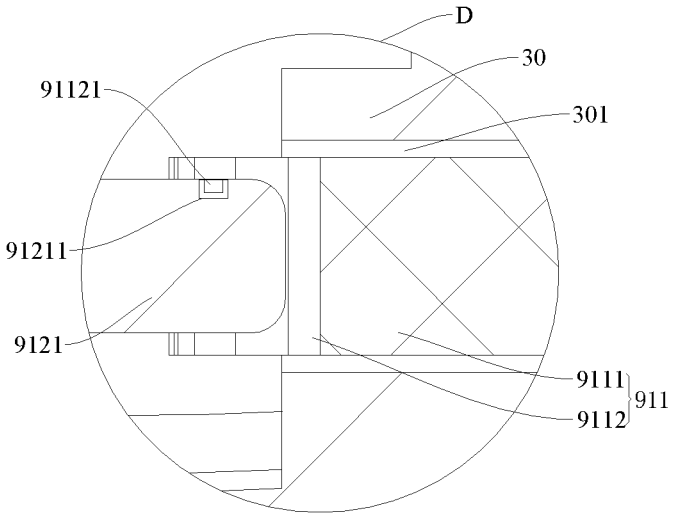
FIG. 48 is a schematic local enlarged view of the portion D in FIG. 47.

Referring to FIGS. 42-43, the positioning device 9 has a locked state and an unlocked state, including a self-locking switch 911, a positioning member 912 and a first elastic member 913, wherein the self-locking switch 911 is provided at the housing 210, the self-locking switch 911 includes a self-locking cartridge 9111 and a self-locking member 9112, the self-locking member 9112 movably arranged on the self-locking cartridge 9111 between a first position (e.g., the self-locking member 9112 as shown in FIG. 48 is at the first position) and a second position (e.g., the self-locking member 9112 as shown in FIG. 421 is at the second position). Detailed description of the self-locking switch 911 is omitted here.

Referring to FIG. 48, the self-locking member 9112 is provided with a first snap portion 91121. By pressing the self-locking member 9112, the self-locking member 9112 may be switched between the first and second positions.

In combination with FIGS. 45 and 420, the positioning member 912 is movable relative to the housing 210. Referring to FIG. 48, the end surface of the positioning member 912 toward the housing 210 is provided with a trigger member 9121 and the second snap portion 91211. By pressing the positioning member 912, the trigger member 9121 is brought into contact with the self-locking member 9112 to press the self-locking member 9112.

Figure 47:
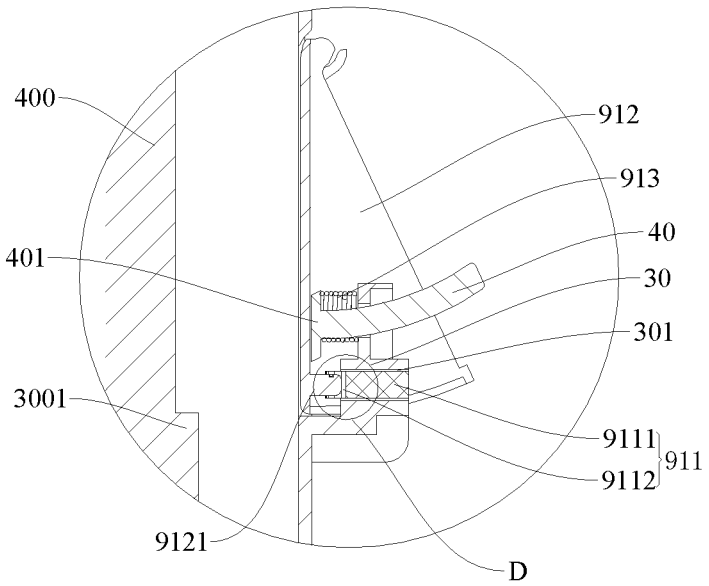
FIG. 47 is a schematic structural diagram of the positioning device according to some embodiments of the present application.

As shown in FIG. 43, the two ends of the first elastic member 913 are connected with the housing 210 and the positioning member 912 respectively to push the positioning member 912 to move toward the locked state. Referring to FIGS. 45 and 47, in the unlocked state, the self-locking member 9112 is at the first position, such that the first and second snap portions 91121 and 91211 are fitted to position the positioning member 912. Referring to FIGS. 420 and 421, in the locked state, the self-locking member 9112 is at the second position, such that the first and second snap portions 91121 and 91211 are disengaged from each other, and the first elastic member 913 pushes the positioning member 912 to the locked state, such that the positioning member 912 abuts against the window sash 400.

Specifically, in the process of mounting the window air conditioner 200 to the window 310, firstly, the housing 210 of the window air conditioner 200 is connected to the window 310. At this point, the self-locking member 9112 is at the first position, and the positioning device 9 is the unlocked state. After the window sash 400 is placed into the accommodation groove 211, the user presses the positioning member 912, such that the trigger member 9121 is brought into contact with the self-locking member 9112 to press the self-locking member 9112 to enable the self-locking member 9112 to move to the second position, the first snap portion 91121 is disengaged from the second snap portion 91211 to release the positioning of the positioning member 912, and the first elastic member 913 pushes the positioning member 912 to move to the locked state, so that the positioning member 912 abuts against the window sash 400. At this point, the window sash 400 fails to move, thereby positioning the window sash 400.

When the window air conditioner 200 is detached, the user presses the positioning member 912 and disengages the positioning member 912 from the window sash 400, and then keeps pressing the positioning member 912, such that the self-locking member 9112 moves to the first position. At this point, the first and second snap portions 91121 and 91211 are fitted to position the positioning member 912, and then the user may take the window sash 400 out of the accommodation groove 211.

Thus, by pressing the positioning member 912, the positioning device 9 positions the window sash 400 or is disengaged from the window sash 400, without other auxiliary parts, such as screws, or the like, which simplifies the installation and detachment of the window air conditioner 200, thereby facilitating the installation and detachment of the window air conditioner 200 by the user, and improving the user experience. The positioning device 9 has a simple structure, is not driven by electricity, and has low costs and high reliability.

Further, in some embodiments of the present application, as shown in FIG. 421, the window sash 400 is provided with a projection 3001. In the locked state, the positioning member 912 is provided with a part which is fitted with the projection 3001 to prevent the projection 3001 from moving upwards.

In the window air conditioner 200 according to the embodiment of the present application, by pressing the positioning member 912, the positioning device 9 positions the window sash 400 or is disengaged from the window sash 400, without other auxiliary parts, such as screws, or the like, which simplifies the installation and detachment of the window air conditioner 200, thereby facilitating the installation and detachment of the window air conditioner 200 by the user, and improving the user experience. The positioning device 9 has a simple structure, is not driven by electricity, and has low costs and high reliability.

Figure 49:
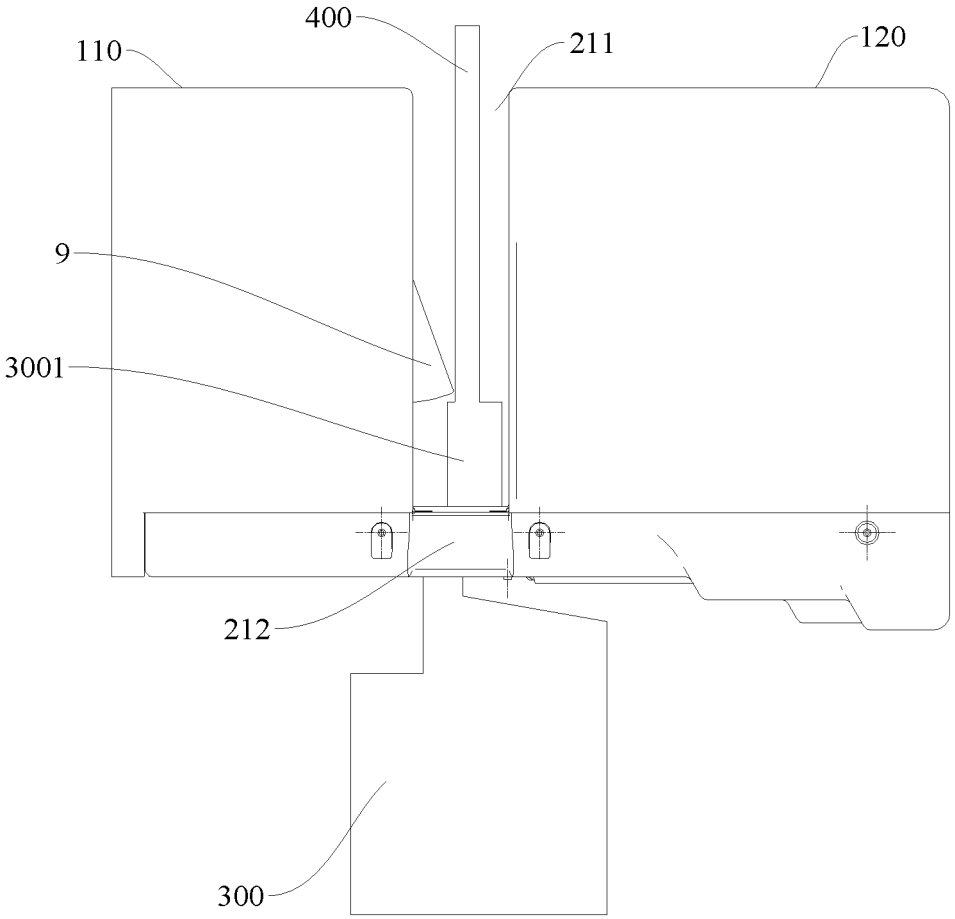
FIG. 49 is a schematic structural diagram of the window air conditioner according to some embodiments of the present application, in which the positioning device is in a locked state.
Figure 50:
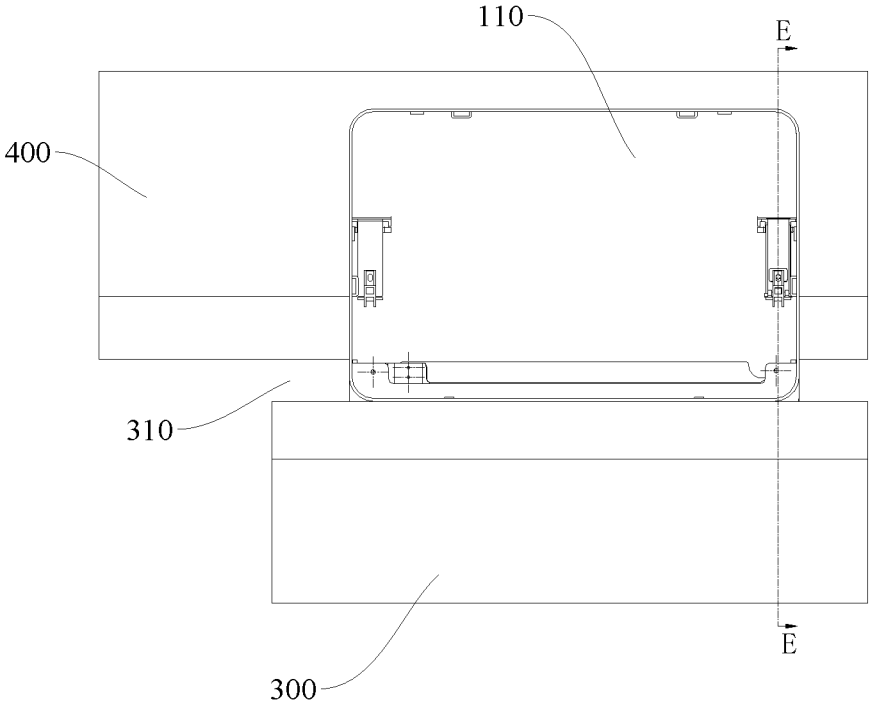
FIG. 50 is a schematic side view according to FIG. 49.
Figure 51:
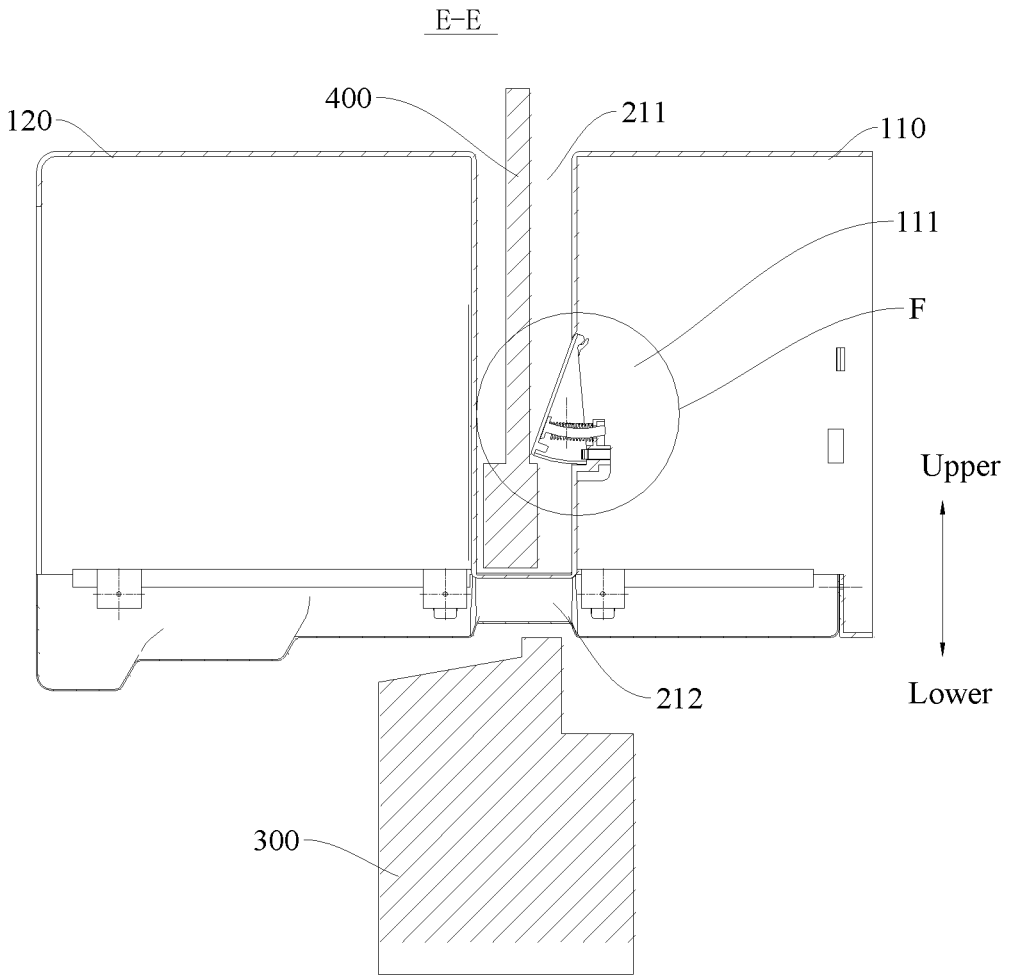
FIG. 51 is a schematic cross-sectional view of the portion E-E of FIG. 50.
Figure 52:
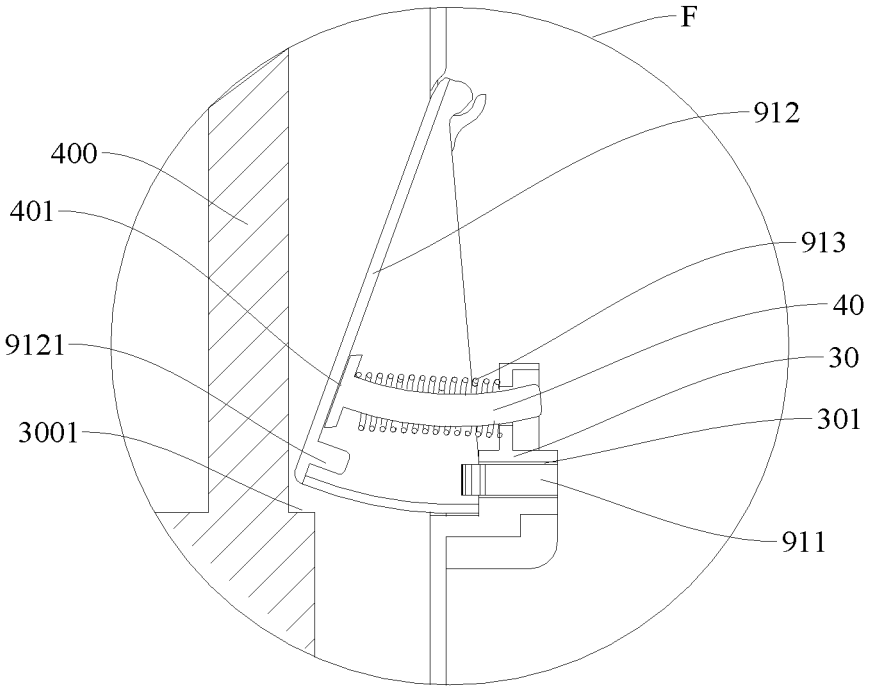
FIG. 52 is a schematic local enlarged view of the portion F in FIG. 51.
Figure 53:
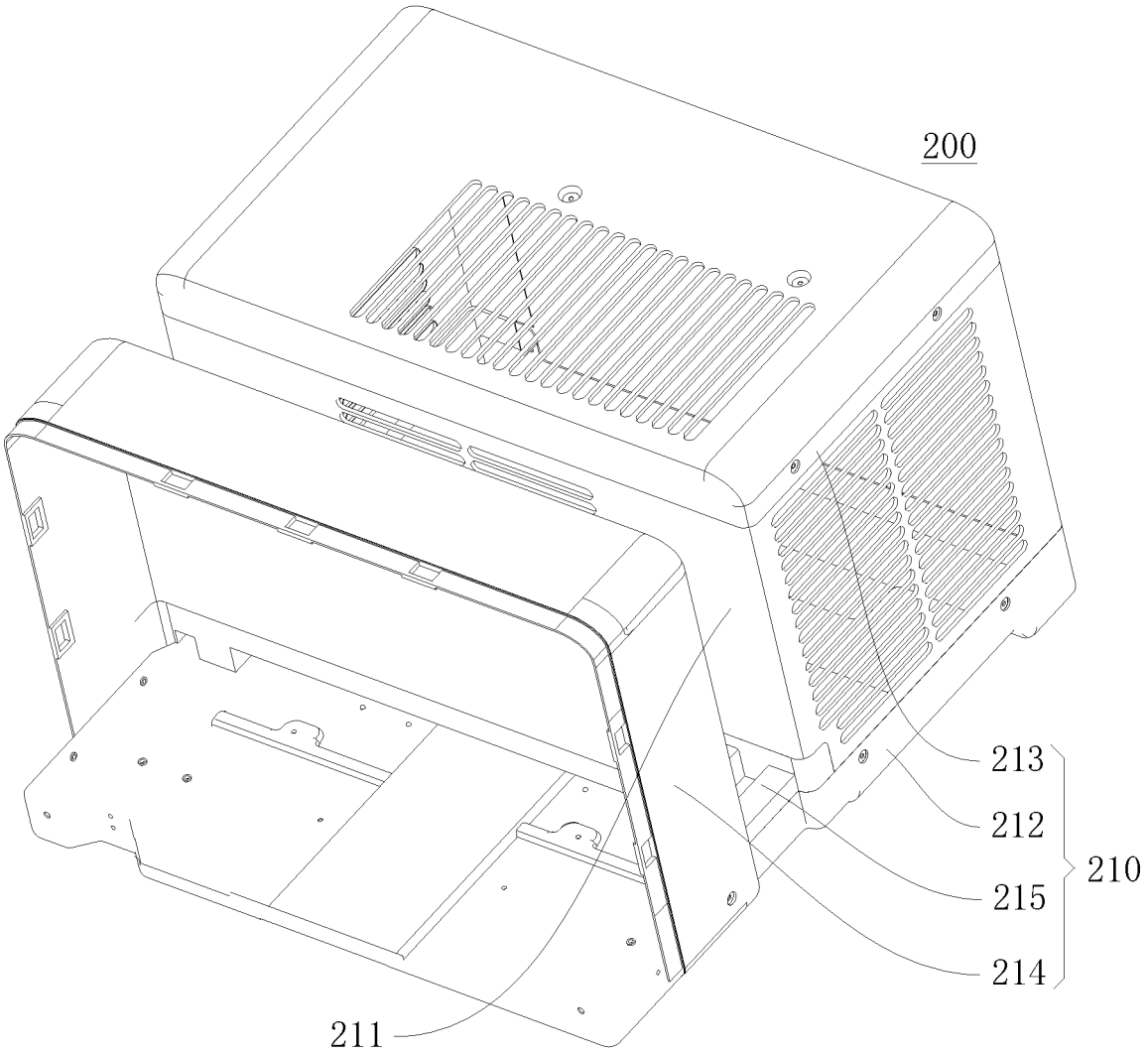
FIG. 53 is schematic structure view of a housing of the window air conditioner according to an embodiment of the present application.

In some embodiments of the present application, as shown in FIG. 43, one end of the positioning member 912 is rotatably disposed at the housing 210. As shown in FIG. 49, in the locked state, the other end of the positioning member 912 extends into the accommodation groove 211 to abut against the window sash 400. Therefore, in the locked state, the user may observe whether the positioning member 912 abuts against the window sash 400, which is advantageous for improving the mounting reliability. In addition, after the installation is completed, since the positioning member 912 is located in the accommodation groove 211, it is advantageous for improving the aesthetic degree of the appearance of the window air conditioner 200 as a whole. For example, as shown in FIGS. 43 and 49, one end of the positioning member 912 is articulated to the housing 210. In the locked state, the other end of the positioning member 912 extends into the accommodation groove 211 to abut against the window sash 400; in the unlocked state, the other end of the positioning member 912 is not contacted with the window sash 400.

In some embodiments of the present application, as shown in FIG. 42, the housing 210 is provided with the accommodation space 111. In the unlocked state, the positioning member 912 is accommodated into the accommodation space 111. Thus, in the process of placing the window sash 400 into the accommodation groove 211, firstly, the positioning member 912 is pressed, such that the positioning device 9 is in the unlocked state. At this point, the positioning member 912 is accommodated into the accommodation space 111, which may avoid the interference between the window sash 400 and the positioning member 912, and facilitate the user to place the window sash 400 into the accommodation groove 211. For example, as show in FIG. 42, the indoor portion 120 of the housing 210 may be formed with the accommodation space 111, and the positioning member 912 is accommodated into the accommodation space 111.

Optionally, as shown in FIG. 45, in the unlocked state, the positioning member 912 is fitted with the inner circumferential wall of the accommodation space 111 to close the accommodation space 111. Thus, in the unlocked state, the positioning member 912 may be fitted with the accommodation space 111 reliably, which may avoid the interference between the window sash 400 and the positioning member 912, and facilitate the user to distinguish the unlocked state from the locked state of the window air conditioner 200 for conveniently mounting the window air conditioner 200.

In some embodiments of the present application, referring to FIGS. 47 and 48, the first snap portion 91121 is configured as a hook, and the second snap portion 91211 is configured as a slot fitted with the hook. In the unlocked state, the first snap portion 91121 is snapped with the second snap portion 91211 to position the positioning member 912; when the user presses the positioning member 912, the positioning device 9 is switched from the unlocked state to the locked state. As shown in FIG. 421, in the locked state, the second snap portion 91211 is disengaged from the second snap portion 91211 to contact and position the positioning members 912, the first elastic member 913 pushes the positioning member 912 to move to the locked state, such that the positioning member 912 abuts against the window sash 400. Thus, the first snap portion 91121 is fitted with and disengaged from the second snap portions 91211 easily, thereby facilitating the switch of the positioning device 9 between the unlocked state and the locked state, and lowering the production costs. Certainly, the present application is not limited thereto. The first snap portion 91121 may be configured as the slot, and the second snap portion 91211 is configured as the hook fitted with the slot.

Figure 46:
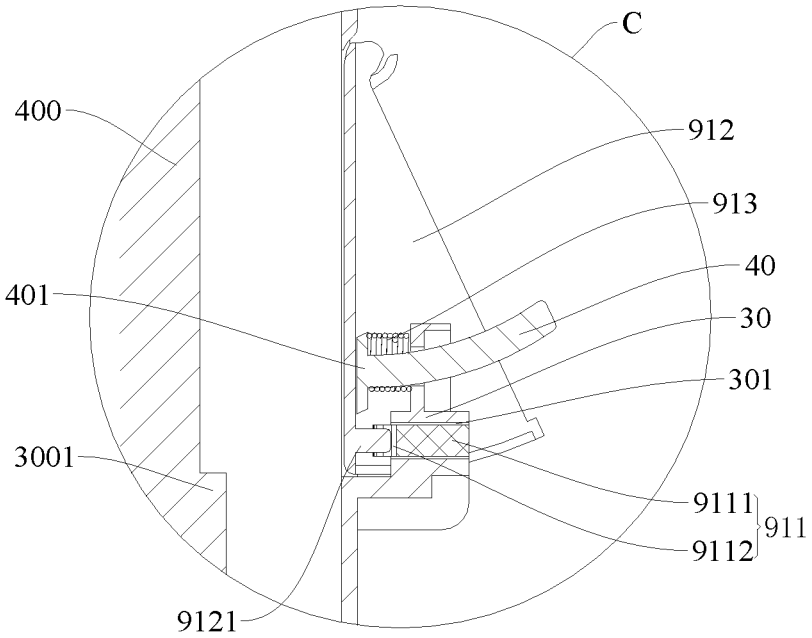
FIG. 46 is a schematic local enlarged view of the portion C in FIG. 45.

Optionally, as shown in FIGS. 46 and 421, the window air conditioner 200 further includes: a limiting structure 30, disposed at the housing 210; and a support bar 40, fixed at the positioning member 912, and movably passing through the limiting structure 30, one end of the first elastic member 913 abutting against the limiting structure 30, and the other end of the first elastic member 913 abutting against the positioning member 912. In the unlocked state, the self-locking member 9112 is at the first position, such that the first and second snap portions 91121 and 91211 are fitted to position the positioning member 912; in the locked state, the first elastic member 913 pushes the support bar 40 to move, such that the positioning member 912 moves to the locked state, and the positioning member 912 abuts against the window sash 400, thereby facilitating the positioning device 9 to switch between the unlocked state and the locked state. The positioning device 9 has a simple structure, is not driven by electricity, and reduces production costs.

For example, as shown in FIG. 43, the positioning member 912 is formed as a box shape with an open end, the escape hole is provided at the limiting structure 30, the support bar 40 is formed into an elongated shape and movably passes through the escape hole, one end of the support bar 40 is provided with a stop 401 which is connected with a closed end of the positioning member 912, the other end of the support bar 40 is suspended and located at the open end of the positioning member 912, one end of the first elastic member 913 abuts against the limiting structure 30, and the other end of the first elastic member 913 abuts against the stop 401 of the support bar 40.

In some optional embodiments of the present application, as shown in FIG. 46, the support bar 40 is sleeved with the first elastic member 913, and two ends of the first elastic member 913 abut against the support bar 40 and the limiting structure 30 respectively. For example, as shown in FIG. 46, the limiting structure 30 is provided at the indoor portion 120, the support bar 40 is fixed at the positioning member 912, the support bar 40 movably passes through the limiting structure 30, the support bar 40 is sleeved with the first elastic member 913 which is configured as a spring, and two ends of the first elastic member 913 abut against the support bar 40 and the limiting structure 30. As such, the support bar 40 is provided at the inner side of the positioning member 912. The arrangements of the support bar 40 and the limiting structure 30 not only ensures an urging force of the first elastic member 913 to the positioning member 912, but also helps limit the rotation path of the positioning member 912, and avoids the influence on the reliability of the positioning device 9 due to an offset from the rotation path of the positioning member 912 caused by the long-term rotation to some extent, thereby improving the reliability of the positioning device 9 and the window air conditioner 200.

Optionally, as shown in FIG. 46, the self-locking switch 911 is fixed at the limiting structure 30. Thus, the connection between the self-locking switch 911 and the limiting structure 30 is reliable, which is advantageous for improving the reliability of the operation of the positioning device 9. For example, the self-locking cartridge 9111 may be detachably connected with the limiting structure 30.

In some embodiments of the present application, referring to FIGS. 47 and 48, the limiting structure 30 is provided with a mounting groove 301 for accommodating the self-locking switch 911. For example, as shown in FIGS. 47 and 48, the limiting structure 30 is formed in a shape of plate and vertically disposed in the housing 210, the limiting structure 30 is provided with the mounting groove 301 at the bottom, the mounting groove 301 penetrates through the limiting structure 30 in the horizontal direction of the limiting structure 30, and the self-locking cartridge 9111 of the self-locking switch 911 is accommodated in the mounting groove 301. Thus, the self-locking switch 911 may be mounted into the mounting groove 301 reliably, and the connection of the self-locking switch 911 and the limiting structure 30 is reliable.

In some embodiments of the present application, the positioning device 9 is provided at the side wall of the indoor portion 120 close to the outdoor portion 110. It will be appreciated that, after the window air conditioner 200 is mounted, the indoor portion 120 and the outdoor portion 110 are spaced apart by the window sash 400. Since the positioning device 9 is provided at the side wall of the indoor portion 120 close to the outdoor portion 110, the user presses the positioning member 912 indoors conveniently, such that the positioning device 9 positions the window sash 400 or is disengaged from the window sash 400, which simplifies the installation and detachment of the window air conditioner 200, facilitates the user to mount and detach the window air conditioner 200, and improves the user experience. The positioning device 9 has a simple structure, is not driven by electricity, and has low costs and high reliability.

In some embodiments of the present application, as shown in FIG. 422, the window air conditioner 200 includes two seal assemblies 100 which are brought into contact with the window sash 400 and the inner wall of the window respectively. The seal assembly 100 includes: the first connection member with a variable length and the plurality of second connection members, wherein the first connection member includes the fixation member and the slide block, wherein the fixation member is disposed in the accommodation space 111, the slide block is in a sliding fit with the fixation member, any one of the second connection members is detachably connected with the slide block, and any two of the second connection members are detachably connected with each other.

Thus, the seal assembly 100 includes the first connection member which includes the fixation member and the slide block, which not only mounts the seal assembly 100 onto the window air conditioner 200 by the fixation member, facilitates the arrangement of the seal assembly 100, and avoids the loss of the seal assembly 100, but also adjusts the length of the seal assembly by the sliding fit between the slide block and the fixation member, thereby adjusting the seal length of the seal assembly 100, sealing the window sash 400 of different sizes by the seal assembly 100, improving the sealing effect of the seal assembly 100, extending the range of use of the seal assembly 100 and the range of application of the window air conditioner 200, and improving the functionality and applicability of the window air conditioner 200.

Other configurations and operations of the window air conditioner according to the embodiment of the present application are known to those skilled in the art and will not be described in detail here.

In the description of the present application, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise," "axial," "radial" and "circumferential" should be construed to refer to the orientation as then described or as shown in the drawings under discussion. These relative terms are for convenience of description and do not require that the present application be constructed or operated in a particular orientation, thus cannot be construed to limit the present application. In addition, the feature associated with "first" and "second" may comprise one or more of this feature explicitly or implicitly. In the description of the present application, "a plurality of" means two or more than two, unless specified otherwise. In the description of the present disclosure, a first feature "on" or "below" a second feature may include an embodiment in which the first feature is in direct contact with the second feature, and may also include an embodiment in which the first feature and the second feature are not in direct contact with each other, but are contacted via an additional feature formed therebetween.

In the description of the present application, a first feature "on," "above," or "on top of" a second feature may include an embodiment in which the first feature is right or obliquely "on," "above," or "on top of" the second feature, or just means that the first feature is at a height higher than that of the second feature.

In the description of the present disclosure, it should be noted that unless specified or limited otherwise, the terms "mounted," "connected," "coupled" and the like are used broadly, and may be, for example, fixed connections, detachable connections, or integral connections; may also be mechanical or electrical connections; may also be direct connections or indirect connections via intervening structures; may also be inner communications of two elements. The above terms can be understood by those skilled in the art according to specific situations.

In the description of the present specification, reference throughout this specification to "an embodiment," "some embodiments," "an illustrative embodiment" "an example," "a specific example," or "some examples," means that a particular feature, structure, material, or characteristic described in connection with the embodiment or example is included in at least one embodiment or example of the present application. In the specification, the schematic expressions to the above-mentioned terms are not necessarily referring to the same embodiment or example. Furthermore, the described particular features, structures, materials, or characteristics may be combined in any suitable manner in one or more embodiments or examples.

Although embodiments of the present application have been shown and illustrated, it shall be understood by those skilled in the art that various changes, modifications, alternatives and variants without departing from the principle and idea of the present disclosure are acceptable. The scope of the invention is defined by the claims and its equivalents.

What is claimed is:

1. A window air conditioner comprising:

a housing including an outdoor portion and an indoor portion spaced apart from each other to form an accommodation groove; and a seal assembly including:

a rotary mounting base fixed at the housing;

a fixation member rotatably connected with the rotary mounting base and configured to rotate out of the accommodation groove;

a seal mating member coupled to the fixation member and configured to rotate out of the accommodation groove when the fixation member rotates out of the accommodation groove; and an angle positioning assembly connecting the rotary mounting base with the fixation member.

2. The window air conditioner according to claim 1, wherein the angle positioning assembly is configured to position the fixation member at an angle with respect to the rotary mounting base.

3. The window air conditioner according to claim 2, wherein the angle positioning assembly includes:

a plurality of positioning grooves provided at one of the rotary mounting base and the fixation member and arranged in a circular shape; and a positioning projection provided at another one of the rotary mounting base and the fixation member, the positioning projection being configured to be fitted with one of the plurality of the positioning grooves to position the fixation member at the angle with respect to the rotary mounting base.

4. The window air conditioner according to claim 3, wherein the position projection is one of a plurality of positioning projections of the angle positioning assembly that are arranged in a ring shape, and configured to be fitted with the plurality of positioning grooves in a one-to-one correspondence.

5. The window air conditioner according to claim 1, wherein:

at least a portion of the fixation member is disposed in the accommodation groove;

the seal assembly further includes a slide block in a sliding fit with the fixation member and configured to slide relative to the fixation member.

6. The window air conditioner according to claim 5, wherein the seal assembly further includes a plurality of connection members configured to adjust a length of the seal assembly, at least one of the connection members being detachably coupled with the slide block, and any two neighboring ones of the connection members being detachably coupled with each other.

7. The window air conditioner according to claim 6, wherein:

each of the connection members includes an insertion portion;

each of the connection members and the slide block includes an insertion chamber; and the insertion portion of each of the connection members is configured to be inserted into and detached from the insertion chamber of the slide block or another one of the connection members.

8. The window air conditioner according to claim 7, wherein an inner wall of one of the insertion portion and the insertion chamber includes an elastic projection, an inner wall of another one of the insertion portion and the insertion chamber includes a groove, and the elastic projection is extendable into the groove.

9. The window air conditioner according to claim 8, wherein:

the elastic projection is provided in the insertion chamber;

in an inserting and detaching direction of the connection member, the elastic projection has two inclined guide surfaces opposite to each other, first ends of the two inclined guide surfaces being fixed at the inner wall of the insertion chamber, and second ends of the two inclined guide surfaces extending obliquely toward each other.

10. The window air conditioner according to claim 5, wherein the seal assembly further includes a slide positioning assembly disposed at the fixation member and configured to be fitted with the slide block to position the slide block at a position with respect to the fixation member.

11. The window air conditioner according to claim 10, wherein at least a portion of the slide block extends into a slide cavity in the fixation member.

12. The window air conditioner according to claim 11, wherein the slide positioning assembly includes a rotation member configured to be in a threaded fit with the fixation member and to pass through the fixation member, the rotation member is configured to be rotated to adjust a length of a portion of the rotation member extending into the slide cavity, and is configured to abut against the slide block to position the slide block.

13. The window air conditioner according to claim 11, wherein:

the fixation member includes an escape hole communicating with the slide cavity;

the slide positioning assembly includes:

a plurality of fitting buckles at an outer peripheral wall of the slide block and arranged spaced apart from each other along a moving direction of the slide block; and an elastic buckle deformably disposed at an inner peripheral wall of the escape hole and configured to be in an inclined fit with or disengaged from one of the fitting buckles; and the slide positioning assembly is configured to allow the slide block to move:

only in a direction away from the fixation member when the elastic buckle engages with the one of the fitting buckles; and in both the direction away from the fixation member and a direction approaching the fixation member when the elastic buckle disengages from the one of the fitting buckles.

14. The window air conditioner according to claim 13, wherein the elastic buckle includes:

a deformation portion having a flat-plate shape and deformably disposed at the fixation member; and a snap portion formed at a free end of the deformation portion and configured to position the slide block when fitting with one of the fitting buckles.

15. The window air conditioner according to claim 11, wherein:

the fixation member includes an escape hole communicating with the slide cavity; and the slide positioning assembly includes:

a plurality of fitting buckles at the slide block and arranged spaced apart from each other along a moving direction of the slide block; and an elastic latch member deformably disposed at the escape hole and including a lock buckle configured to engage with or disengage from one of the plurality of the fitting buckles, the elastic latch member being configured to deform to disengage the lock buckle from the one of the plurality of fitting buckles.

16. The window air conditioner according to claim 15, wherein:

the slide block has a mating cavity, and the plurality of fitting buckles are formed at a peripheral wall of the mating cavity; and the lock buckle extends into the mating cavity to engage with the at least one of the fitting buckles.

17. The window air conditioner according to claim 16, wherein:

the slide block includes an opening extending in a sliding direction of the slide block and communicating with the mating cavity, and the plurality of the fitting buckles are formed at a side of the opening in a width direction; and the elastic latch member further includes:

a cantilever segment having one end coupled with an inner peripheral wall of the escape hole and being in a sliding fit in the opening;

a pressing portion disposed at another end of the cantilever segment and located outside the mating cavity; and a latch portion disposed at the another end of the cantilever segment, the lock buckle being disposed at the latch portion, and the latch portion extending into the mating cavity to enable the lock buckle to engage with the one of the fitting buckles.

18. The window air conditioner according to claim 11, wherein:

the slide block includes a plurality of fitting buckles arranged at intervals in a sliding direction of the slide block; and the fixation member includes:

an escape hole communicating with the slide cavity; and a press button disposed at the escape hole and configured to be pressable, the press button including a lock buckle configured to engage with at least one of the plurality of the fitting buckles when the press button is reset and to disengage from the at least one of the plurality of fitting buckles when the press button is pressed.

19. The window air conditioner according to claim 18, wherein the press button includes:

a cantilever segment having one end coupled with an inner wall of the slide cavity, the lock buckle being disposed at the cantilever segment and spaced apart from the one end of the cantilever segment; and a press button body coupled with the cantilever segment and spaced apart from the one end of the cantilever segment, the press button body extending in a direction perpendicular to the cantilever segment and at least a portion of the press button body extending into the escape hole.

20. The window air conditioner according to claim 19, wherein the lock buckle and the press button body are located at a free end of the cantilever segment, and the lock buckle is located at one side of one end of the press button body away from the cantilever segment.

* * * * *